US010577056B2

(12) United States Patent
Lisland

(10) Patent No.: US 10,577,056 B2
(45) Date of Patent: Mar. 3, 2020

(54) MOORING PULLEY TENSIONING SYSTEM

(71) Applicant: SCANA OFFSHORE AS, Vestby (NO)

(72) Inventor: Torkjell Lisland, Drøbak (NO)

(73) Assignee: SCANA OFFSHORE AS, Vestby (NO)

( * ) Notice: Subject to any disclaimer, the term of this patent is extended or adjusted under 35 U.S.C. 154(b) by 0 days.

(21) Appl. No.: 15/335,191

(22) Filed: Oct. 26, 2016

(65) Prior Publication Data

US 2017/0349243 A1 Dec. 7, 2017

(30) Foreign Application Priority Data

Jun. 3, 2016 (NO) ..... 20160964

(51) Int. Cl.

| | |
|---|---|
| ***B63B 21/00*** | (2006.01) |
| ***B63B 21/50*** | (2006.01) |
| ***B63B 21/10*** | (2006.01) |
| ***B63B 21/18*** | (2006.01) |
| *B63B 21/16* | (2006.01) |

(52) U.S. Cl.

CPC ..... *B63B 21/50* (2013.01); *B63B 21/10* (2013.01); *B63B 21/18* (2013.01); *B63B 21/16* (2013.01); *B63B 2021/003* (2013.01); *B63B 2708/00* (2013.01)

(58) Field of Classification Search

CPC ..... B63B 21/00; B63B 21/04; B63B 21/10; B63B 21/16; B63B 21/18; B63B 21/20; B63B 21/24; B63B 2021/00; B63B 2021/003; B63B 2021/20; B63B 2021/203; B63B 2021/24; B63B 2021/50; B63B 2708/00; B63B 2708/02; B63B 21/50

USPC ... 114/230.1, 230.2, 230.22, 230.23, 230.25, 114/293, 294

See application file for complete search history.

(56) References Cited

U.S. PATENT DOCUMENTS

| | | | | |
|---|---|---|---|---|
| 3,151,594 | A | 10/1964 | Collipp | |
| 3,300,187 | A * | 1/1967 | Krogstad | B66D 1/02 114/230.22 |
| 3,654,649 | A * | 4/1972 | Richardson | B63B 21/22 114/294 |
| 3,842,780 | A * | 10/1974 | Allens | B63B 21/20 114/230.23 |
| 3,985,093 | A * | 10/1976 | Eidem | B63B 21/22 114/230.23 |
| 4,090,462 | A | 5/1978 | Mount | |
| 4,130,077 | A | 12/1978 | Person et al. | |
| 5,390,618 | A | 2/1995 | Wolff et al. | |
| 5,566,636 | A | 10/1996 | Wolf et al. | |
| 6,983,714 | B2 * | 1/2006 | Dove | B63B 21/04 114/230.2 |

(Continued)

FOREIGN PATENT DOCUMENTS

| | | | |
|---|---|---|---|
| DE | 102008029982 | A1 | 12/2009 |
| EP | 1318072 | A2 | 6/2003 |
| WO | WO-03013950 | A1 | 2/2003 |

*Primary Examiner* — Daniel V Venne

(74) *Attorney, Agent, or Firm* — Winstead PC

(57) ABSTRACT

A mooring tensioning arrangement for a floating structure or vessel (11), comprising an anchor (2), a mooring line (3), a mooring tensioner (4) and a working line (5), said mooring tensioner (4) having a tensioning pulley (20). A tensioning force is imposed on said mooring line (3), which is directed towards said floating structure or vessel (11).

23 Claims, 76 Drawing Sheets

(56) References Cited

U.S. PATENT DOCUMENTS

| | | | | |
|---|---|---|---|---|
| 2002/0189522 | A1 | 12/2002 | Dove et al. | |
| 2004/0231579 | A1* | 11/2004 | Macrae | B63B 21/20<br>114/293 |
| 2014/0216323 | A1 | 8/2014 | Macrae | |
| 2016/0185427 | A1* | 6/2016 | Macrae | B63B 21/50<br>114/230.22 |

* cited by examiner

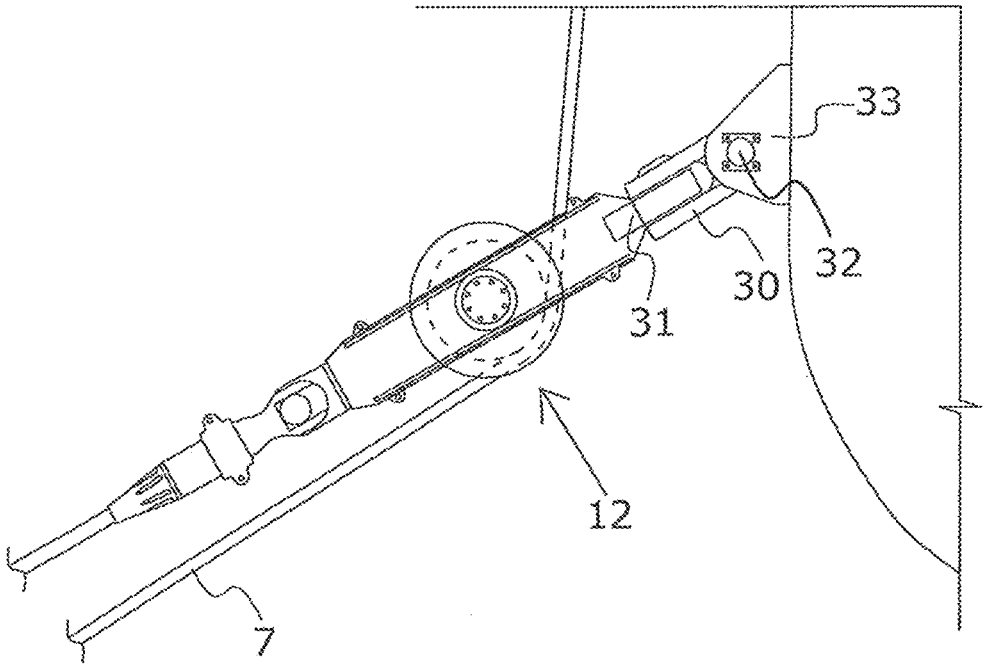
Fig. 2C1
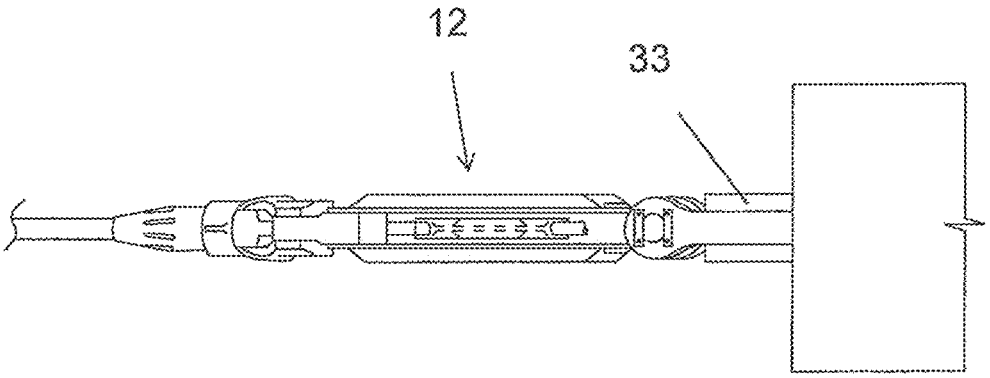
FIG. 2C2

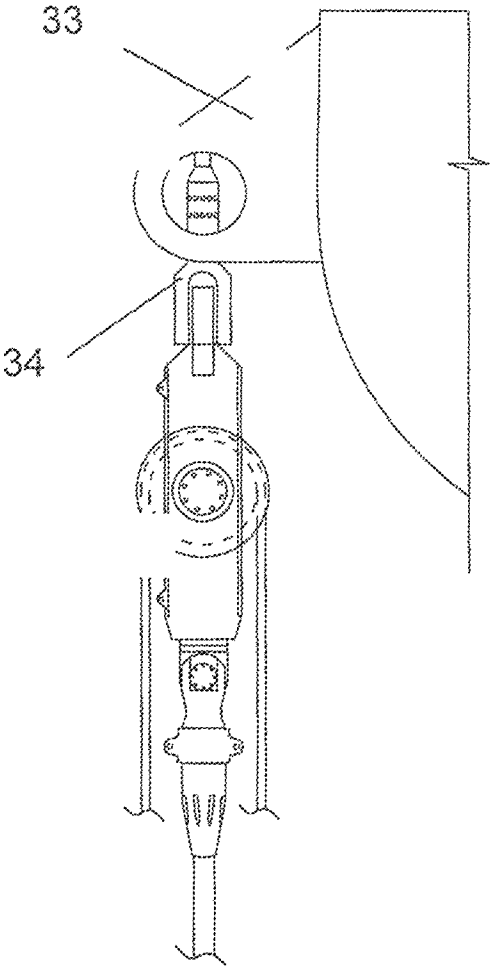
Fig. 2D2
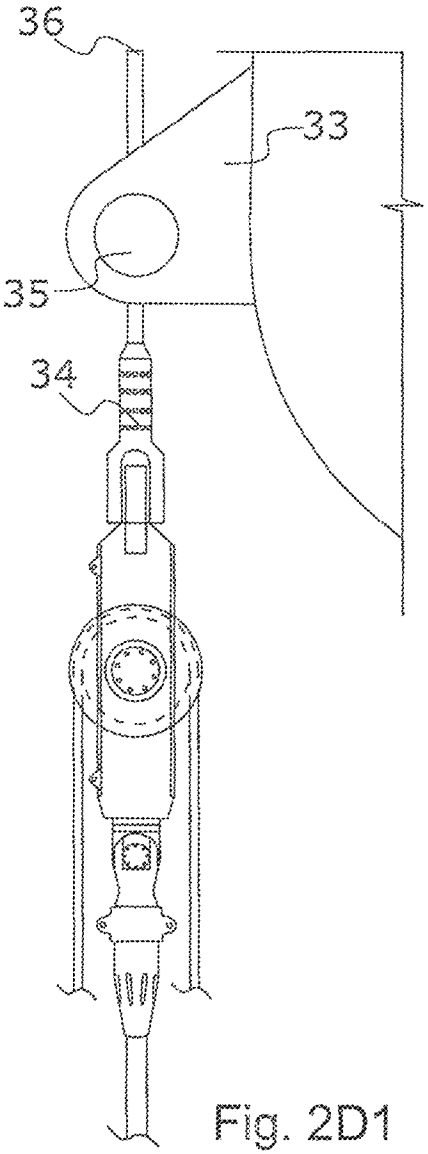
Fig. 2D1

MOORING PULLEY TENSIONING SYSTEM

FIELD OF INVENTION

The present invention relates to mooring and tensioning of mooring lines for floating structures or vessels, such as Floating Production, Storage and Offloading vessels (FPSO's), semi-submersible platforms, turret moored vessels, floating drilling rigs, drilling ships and other floating structures which are moored to the seabed.

The invention is more specifically directed to a mooring arrangement and an installation method.

BACKGROUND OF THE INVENTION

Structures and vessels that are supposed to stay moored at the same location for a long time, such as months or years, needs to be moored with a prescribed tensioning. The traditional method is to use chain tensioning equipment on deck for pull-in and tensioning. Normally this equipment is used during the installation period and left on the vessel for several years without being used or maintained. When the mooring lines slacken sufficiently over time, due to wear of chains, shifting of anchors, creep in fiber mooring lines etc, the mooring lines need to be re-tensioned, repositioned (typically move the chain one or two chain links in order to engage the chain stopper on a new chain link) or replaced. In this period between the installation and the next operation, the equipment has normally seized or corroded and requires refurbishment.

Another issue is the weight and deck space. Deck space is often limited and weight on deck an important factor for the stability of the vessel.

The aim of this patent application is to provide arrangements and methods where there is little or no requirement for equipment on the deck of the vessel and still be able to perform the installation, tensioning, re-tensioning, re-positioning and replacement operations.

US 2014/0216323 describes a mooring arrangement and a method of installing the mooring arrangement. An anchor chain is attached to the seabed by an anchor. A submerged chain stopper is attached to an upper end of the anchor chain. A pull chain or installation chain extends from the structure to be anchored through the chain stopper. The lower end of the installation chain is pulled upwards by the use of a winch on the support vessel until the installation chain passes through the chain stopper, a prescribed tension is achieved and the chain stopper engages on the permanent part of the mooring line, here described as the work chain.

US 2002/0189522 describes a similar arrangement and method as above.

WO 03/013950 also describes a similar mooring arrangement and method.

The main difference between the above mentioned patents are that the US 2014/0216323 A1 may use a wire from a winch on the anchor handler towards the platform. By doing this it is possible to tension the mooring line with a force based on the winch capacity. The actual tension force will depend on factors such as angle of the mooring chain with respect to the platform and the support vessel. If the mooring line is close to vertical, the effect of this method is close to zero.

In these references the arrangement and method are relied on pulling the installation chain of the mooring chain vertically or close to vertically upwards to an installation vessel in order to tension the chain. The benefit of both these systems is that there is no chain and chain handling equipment on the deck of the FPSO. However, the main disadvantages are that all mooring line tensioning requires an installation vessel and fine tuning of each mooring line may be difficult. Additionally, the installation requires an additional length of installation chain.

It is expensive to use an installation vessel every time a re-tensioning of the mooring is required.

The vertical, or close to vertical, pulling of the chain will also pull the submerged chain tensioner upwards, so that an obtuse angle is created between the chain below the chain tensioner and the chain above the chain tensioner extending between the anchor at the seabed and the moored structure, as can readily be seen in the figures of the two references. The size of this angle will depend on several factors, such as pulling tension, weight of the chain, friction in reversing pulley of the chain tensioner, sea currents etc. Due to the angle, the length of the chain between the anchor and the floating structure is somewhat greater than the linear distance between the anchor and the floating structure.

Especially if the anchor is at a great distance from the floating structure or the water depth is small, the mooring line can extend at a very shallow angle from the seabed. In such cases the pull to tighten the mooring can be almost at right angle to the mooring line. This will result in the angle between the two parts of the mooring line, below and above the chain tensioner, becoming smaller and thus the length of the mooring line during tensioning will become far greater than the direct distance between the anchor and the floating structure.

When the mooring has been tightened to the prescribed tension, the upper end of the installation chain will be released. Hence, the chain tensioner will sink until it finds itself approximately on the straight line between the anchor and the floating structure. This inevitably leads to a slackening of the mooring. Hence, the mooring must be tightened somewhat beyond the required tension to account for this slackening.

However, it is difficult to predict how much overtightening is required to achieve the correct tension.

There are several other disadvantages as well, such as:

- The weight of the chain stopper arrangement may be a problem for the mooring line and the mooring characteristics.
- After the chain installation and tensioning is finished, the excess mooring chain has to be cut off to reduce the additional weight midwater. This will typically require a ROV operated subsea chain cutter unit.
- If you want to pay out the mooring chain, the chain stopper will have to be operated with an ROV. The chain tensioning arrangement will typically be located 50-100 meters below the surface.

Objectives of the Present Invention

The present invention has as a first main objective to avoid additional weight midwater on the mooring line from the chain stopper structure and the excess mooring chain. A wire sheave positioned mid-water has considerable less weight than a chain stopper pulley and excess mooring chain.

The mid-water sheave may, in an alternative embodiment, be a temporary sheave arrangement, which is removed after the installation has been completed.

The present invention has as a second main objective to avoid the problem of having to account for a certain amount of overtightening when installing a mooring or re-tensioning a mooring.

A further objective of the present invention is to provide an arrangement and method for installation, tensioning and replacement of mooring lines where there is no requirement for chain handling on the deck of the floating structure.

Tensioning can be performed from an installation vessel and in particular smaller vessels due to multiplication of the tensioning force from the pulley arrangement. The multiplication factor is close to 3 depending on actual angle and friction.

Additionally, a slightly longer work chain can be used instead of an installation chain. An installation wire may act as the main part of the installation chain.

Yet another advantage of the invention is that the chain tensioning may be operated from the FPSO by a wire, rope or hydraulic cylinder.

Another advantage of the present invention is that the weight of the excess top chain is carried mainly by the hull bracket.

SUMMARY

The present invention relates in a first aspect to a mooring tensioning arrangement for a floating structure or vessel, wherein the mooring tensioning arrangement comprises: an anchor, a mooring line, a fairlead chain stopper arrangement arranged on the floating vessel, a midwater pulley device and a pulling system, said mooring line is attached to the anchor at a first end and attached to the pulling system at the second end, said mooring line extending from the anchor through the fairlead chain stopper arrangement, said midwater pulley device is positioned on a part of the mooring line extending between the anchor and the fairlead chain stopper arrangement, said fairlead chain stopper arrangement comprising a chain stopper interacting with said mooring line and a chain wheel guiding the mooring line through the fairlead chain stopper arrangement and back towards the midwater pulley device and from said midwater pulley device towards said pulling system.

In a second aspect the invention relates to a method for tensioning a mooring arrangement on a floating structure or vessel according to the invention, wherein said method comprises the following steps:

a) transferring a first installation wire to and from the pulling system, said first installation wire is extending through the fairlead chain stopper arrangement, b) pulling in the mooring chain by the pulling system, c) connecting the first installation wire and the mooring chain together to a mooring line, d) lowering the mooring line from the pulling system into the sea, e) tensioning the mooring line by the pulling system and the fairlead chain stopper arrangement, f) transferring a second installation wire between the floating structure and the pulling system, g) extending the mooring line around the midwater pulley device, h) tensioning the mooring line by the pulling system.

In a third aspect the present invention ensures that the tensioning force acting upon the mooring line is directed towards the floating structure or vessel, preferably towards the attachment point of the mooring line on the structure or vessel. This ensures that the mooring line extends in a substantially straight line from the anchor to the floating structure or vessel.

The weight of the mooring line and sea currents will of course influence on the course of the mooring line also in the case of the present invention. Consequently, the mooring line may not extend in a perfectly straight line.

This object of the invention may be achieved by two somewhat different alternative aspects of a mooring tensioning arrangement.

In a first of these aspect of the mooring tensioning arrangement of the present invention it comprises an anchor, a mooring line, a mooring tensioner and a working line, said mooring tensioner having a tensioning pulley, said mooring line being attached at a first end to said anchor and at a second end to said mooring tensioner, said working line being attached at a first end to said floating structure or vessel and extending over said tensioning pulley, and said working line being attached to a pulling unit at a second end; said working line having a portion that extends between said attachment to said floating structure or vessel and said tensioning pulley, and a portion that extends from said tensioning pulley towards said pulling unit, which is characterized in that portions of said working line are substantially parallel.

In this first aspect of the invention, a portion of said working line may extend over a fairlead pulley that is attached to said floating structure or vessel close to, or at the same position as, said attachment of said first end of said working line to said floating structure or vessel, so that portion of said working line extends substantially parallel with portion between said tensioning pulley and said fairlead pulley.

In an alternative of said first aspect of the invention, the pulling unit may be situated close to said attachment of said first end of said working line to said floating structure or vessel, so that a portion of said working line extends substantially parallel with a portion between said tensioning pulley and said pulling unit.

In a second of these aspects of the mooring tensioning arrangement of the invention, it comprises an anchor, a mooring line, a mooring tensioner and a pulling system, said mooring tensioner having a tensioning pulley, said mooring line being attached at a first end to said anchor, which is characterized in that said mooring tensioner is attached to said floating structure or vessel, and that said mooring line extends over said tensioning pulley towards said pulling system, so that said mooring line extends substantially in a straight line between said anchor and said floating structure or vessel while being tensioned.

In one embodiment, the mooring line or said working chain may be coupled to a pull-line, which in turn is coupled to said pulling system.

In a further embodiment, said mooring tensioner comprises a chain stopper that is adapted to lock said mooring line or said working chain and prevent the same form moving relative to said mooring tensioner.

The pulling system is conveniently a winch on an installation vessel, said vessel. or a combination of winches and the installation vessel.

In a third aspect the present invention relates to a method for tensioning a mooring arrangement wherein the tensioning force that is imposed on said mooring line is directed towards said floating structure or vessel.

In one embodiment said tensioning force is acting via a block and tackle configuration, which multiplies the tensioning force on the mooring line.

The tensioning force is conveniently created by a pulling system, which is a winch on an installation vessel, said vessel, or a combination of winches and the installation vessel.

BRIEF DESCRIPTION OF THE DRAWINGS

The foregoing features of the invention will be more readily understood by reference to the following detailed description taken with reference to the accompanying drawings.

FIGS. 2*c*1 and 2*c*2 show a further alternative solution for the fairlead construction, FIGS. 2*d*1 and 2*d*2 show an alternative embodiment of the fairlead construction, FIGS. 3*a-c* show a first step in the first and second embodiment shown of a method of tensioning according to the present invention, FIGS. 14*a-c* show an embodiment where the midwater pulley device is a temporary midwater pulley device, FIG. 14*d* shows an embodiment where the midwater pulley device is an integrated pulley device, FIG. 14*e* shows an embodiment where the midwater pulley device is a permanent midwater pulley device, FIGS. 18*a-b* show the embodiment with a temporary midwater pulley device.

FIG. 18*c* shows a further embodiment where the midwater pulley device is an integrated midwater pulley device, FIG. 18*d* shows a further embodiment where the midwater pulley device is a permanent midwater pulley device, FIG. 21 shows the anchored floating structure or vessel after the tensioning process according to the first and second embodiments.

DETAILED DESCRIPTION

Figure 1:
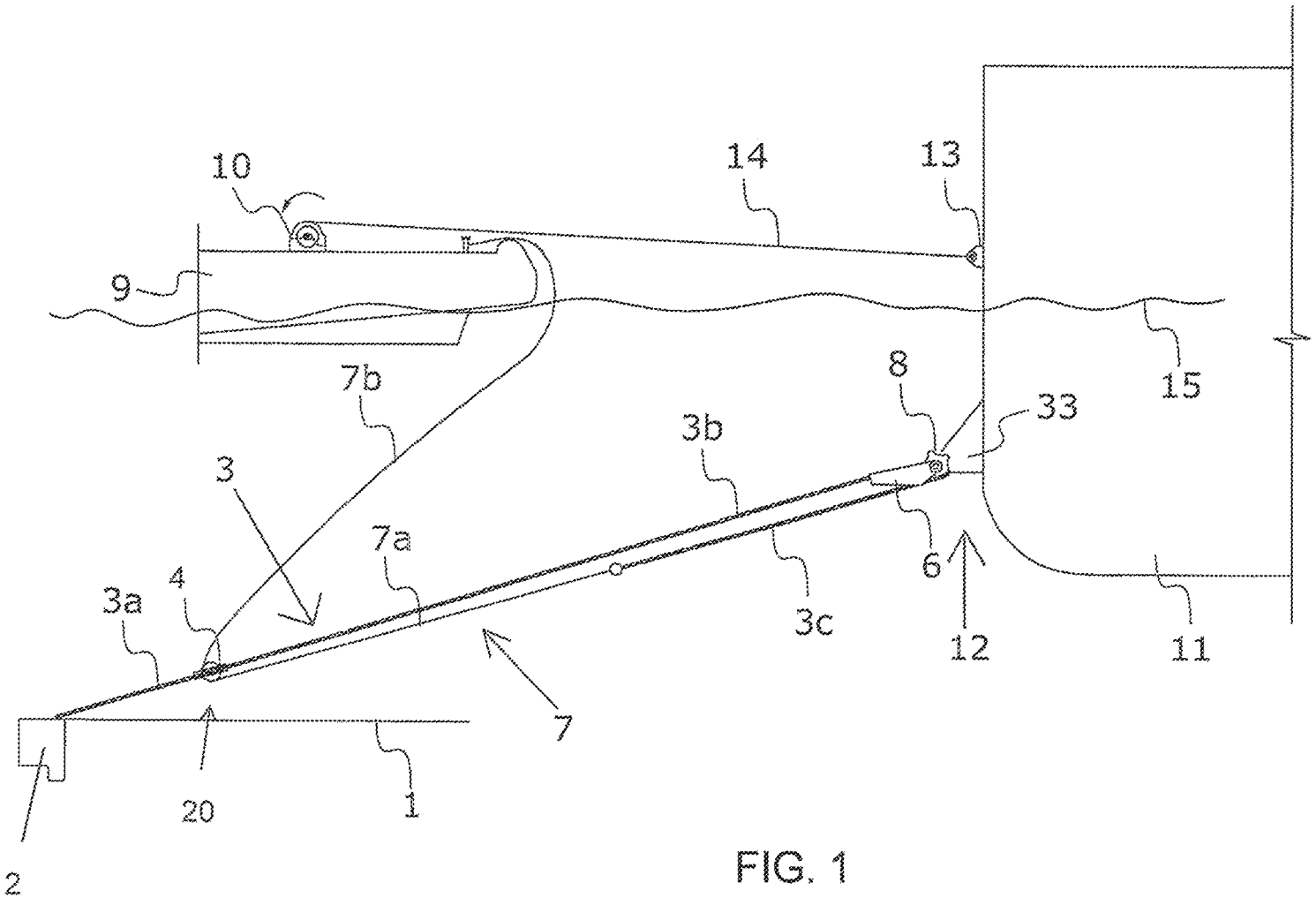
FIG. 1 shows a mooring tensioning arrangement for a floating structure or vessel according to a first embodiment of the invention.

The definitions in the application shall be interpreted broadly throughout the application.

The mooring chain 3 and the first installation wire 7 are referred to as several mooring chain parts 3*a*, 3*b*, 3*c* and first wire segment 7*a*, second wire segment 7*b*, and third wire segment 7*c* throughout the description. This is done to simplify the description of the tensioning mooring arrangement and the different embodiments. The mooring chain parts 3*a*, 3*b*, 3*c* could form one continuous mooring chain 3. The first wire segment 7*a*, second wire segment 7*b*, could likewise form a continuous first installation wire 7. The mooring chain 3 and the first installation wire 7 could also be made of segments joined together.

The mooring chain 3 and the first installation wire 7 could also be joined to together in one continuous length. This is referred to as a mooring line in the claims. Parts 3*a*, 3*b* of mooring chain 3 make up a portion of the mooring chain 3 and the first installation wire 7 that extends between an anchor 2 and a fairlead chain stopper arrangement 12. Parts 3*c*, 7*a* of installation wire 7 make up another portion of the mooring chain 3 and installation wire 7 that extends between the fairlead chain stopper arrangement 12 and a midwater pulley device 4.

The term midwater referred to below is to be interpreted broadly and not as an indication that the midwater has to be positioned midwater in the sea. The term indicates that a midwater pulley device 4, 4', 4" can be installed anywhere on the mooring chain 3 between an anchor 2 and a fairlead chain stopper arrangement 12.

Figure 2A:
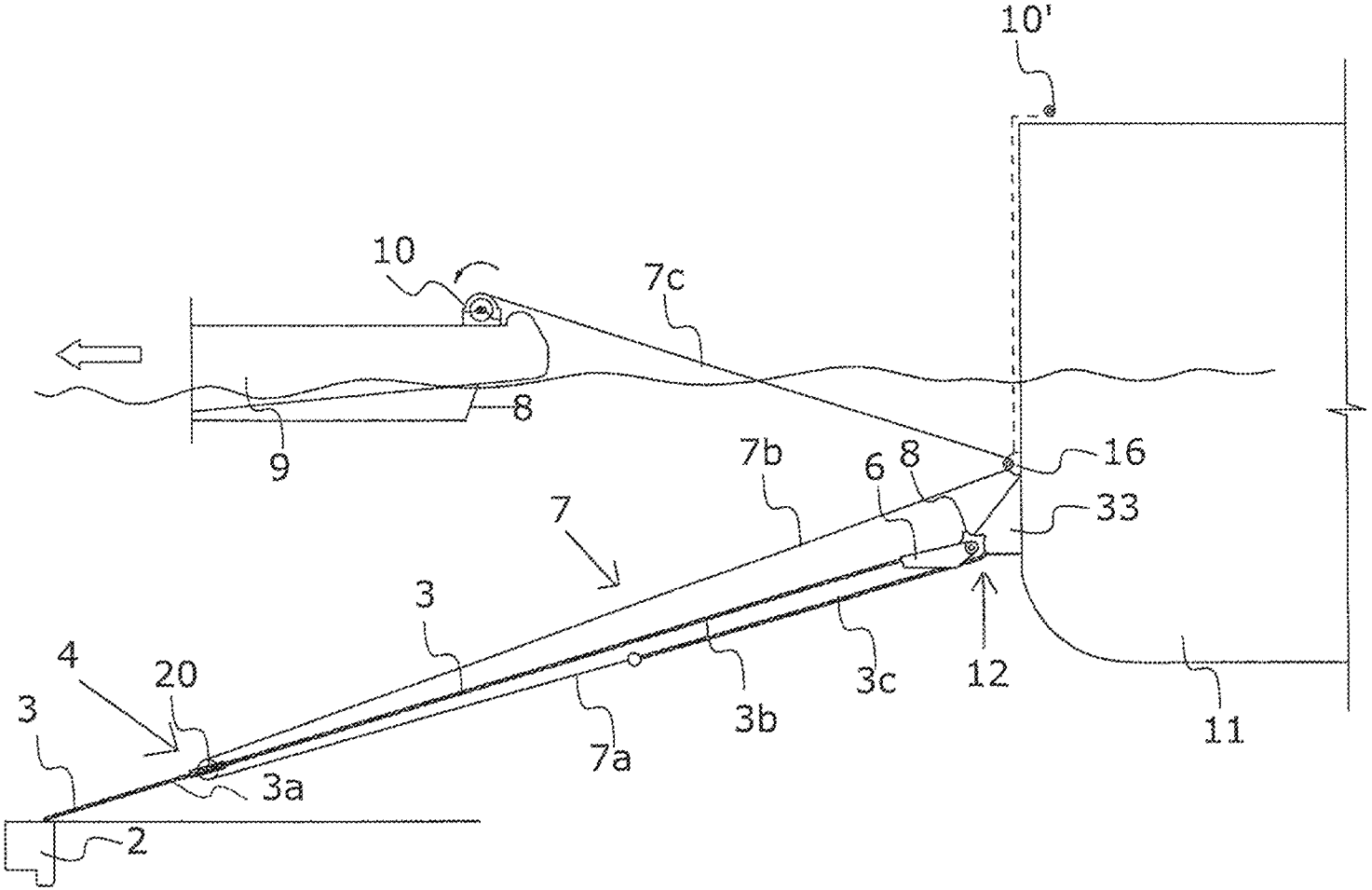
FIG. 2*a* shows a mooring tensioning arrangement according to a second embodiment of the invention.
Figure 2B:
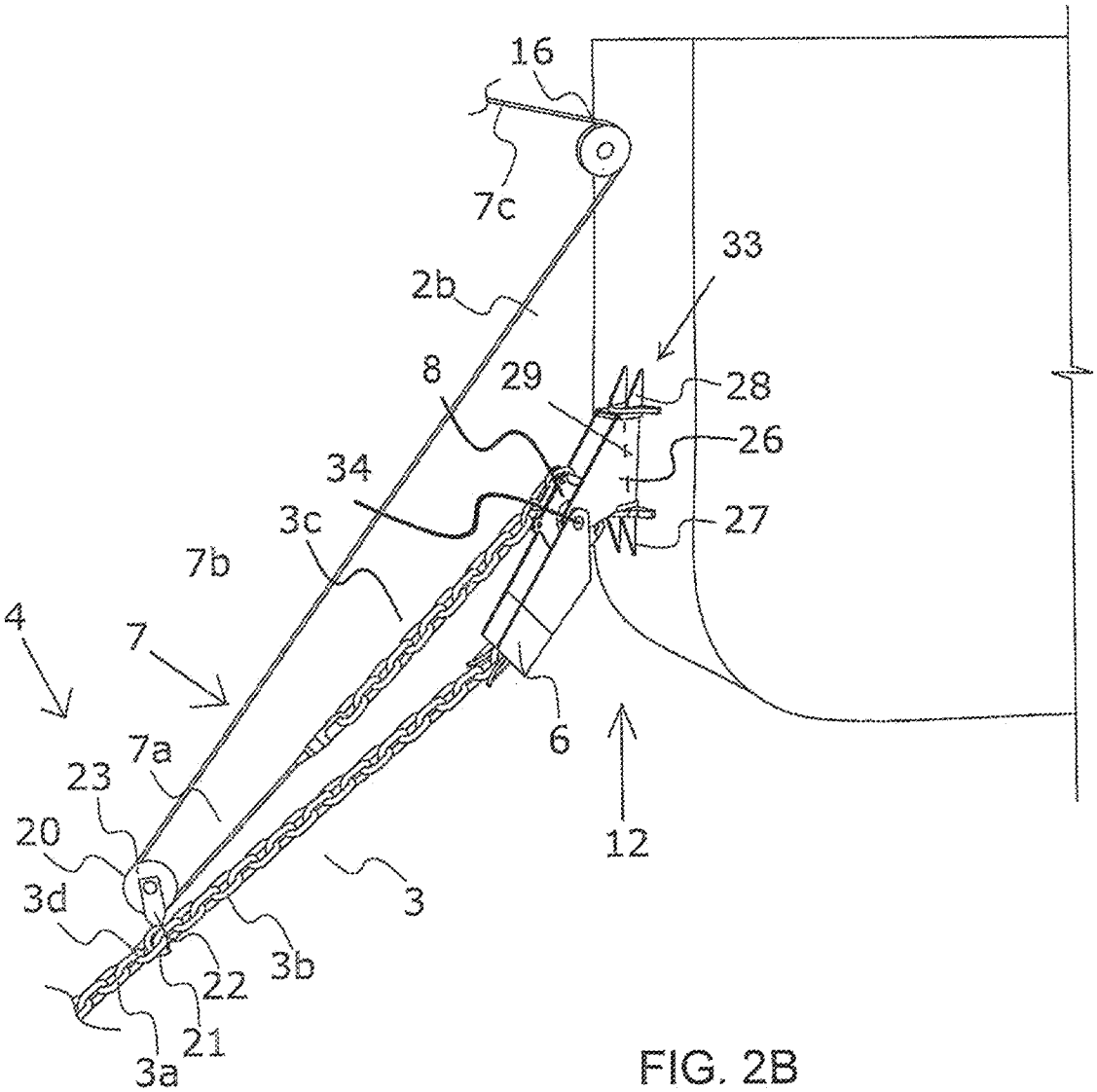
FIG. 2*b* shows a detail view of the fairlead construction of the present invention according to the second embodiment of the invention with a temporary midwater pulley device.
Figure 14A:
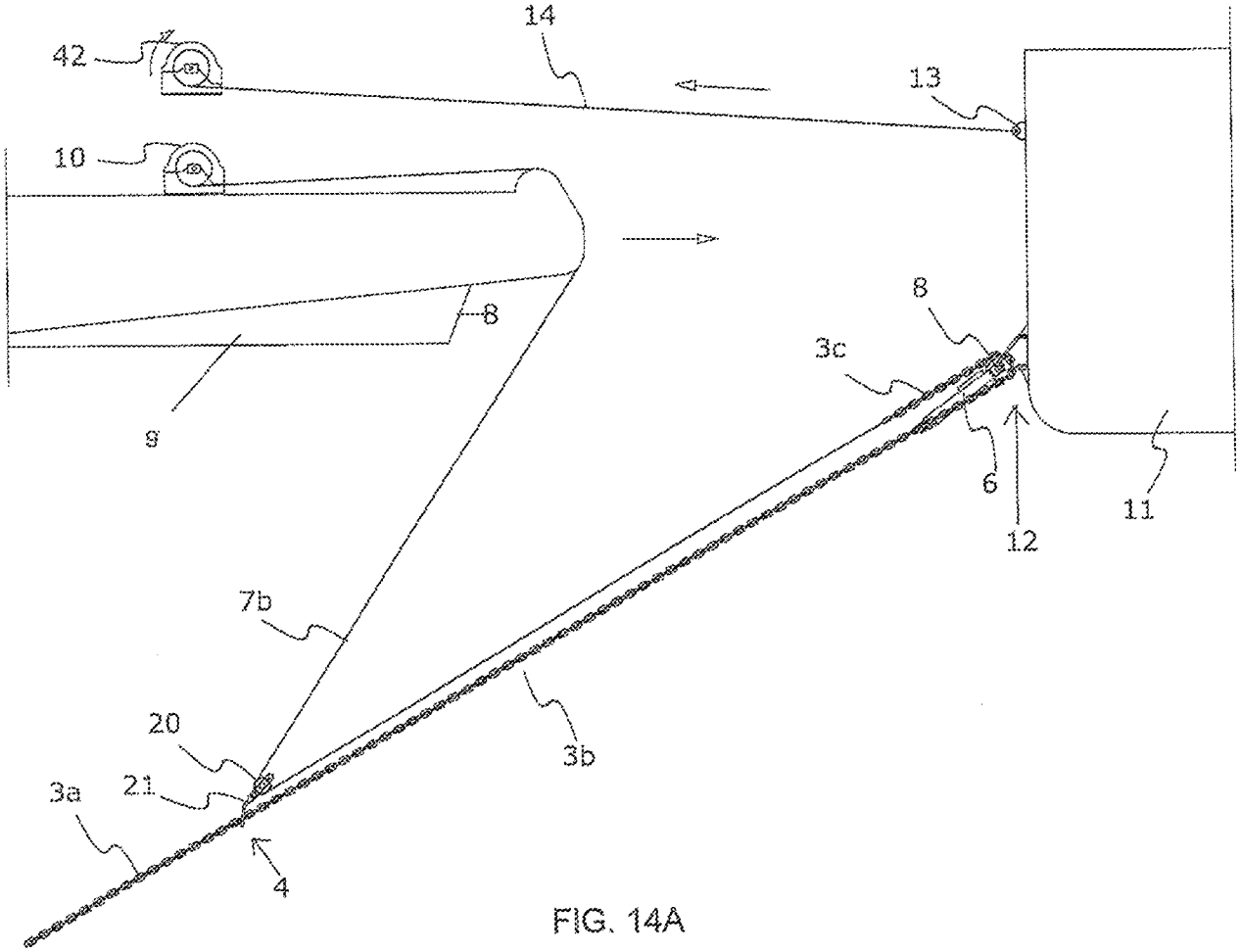
FIGS. 14*a-e* show a twelfth step in a first embodiment of a method of tensioning according to the present invention, where the tensioning of the mooring arrangement is performed.
Figure 14B:
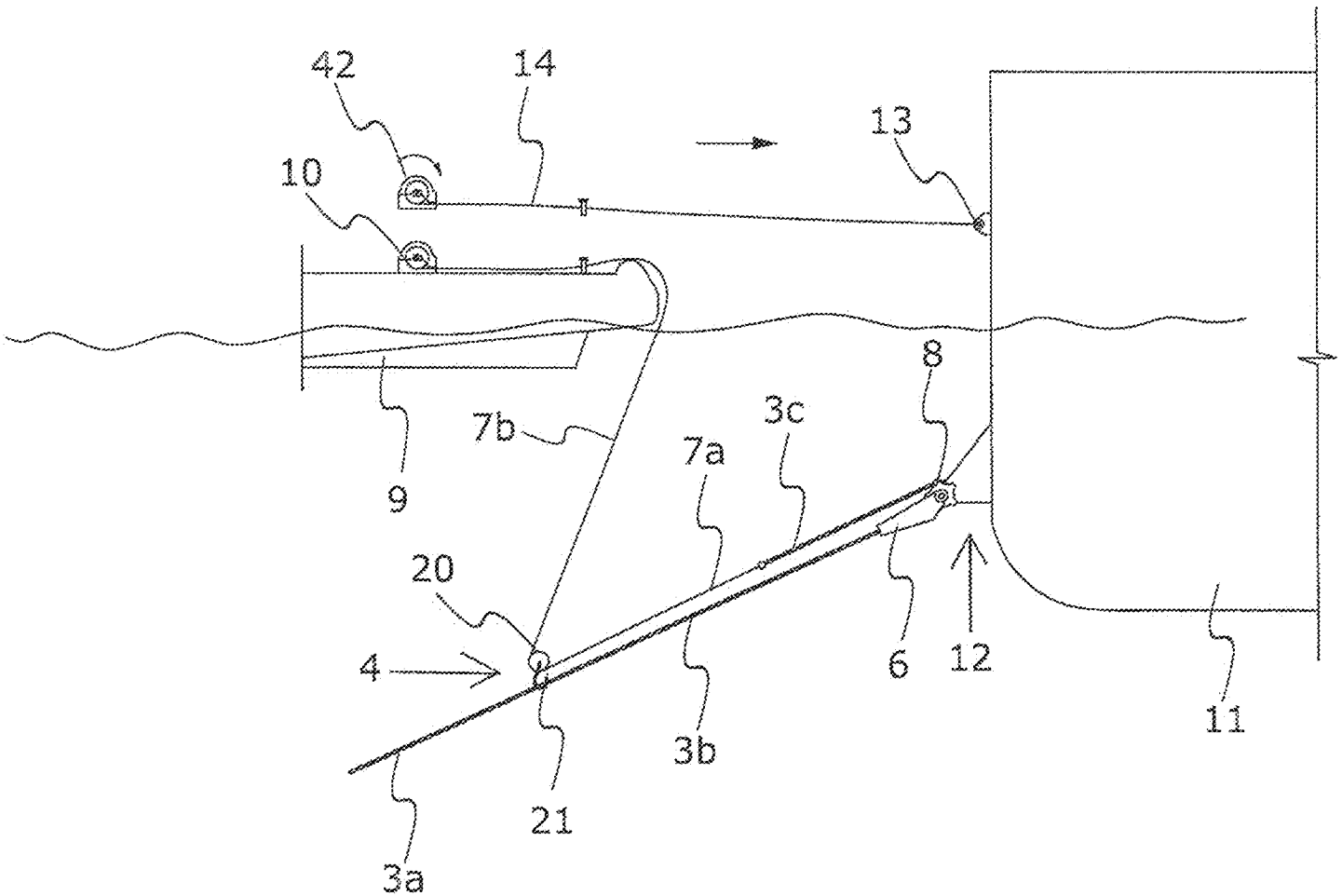
Figure 14C:
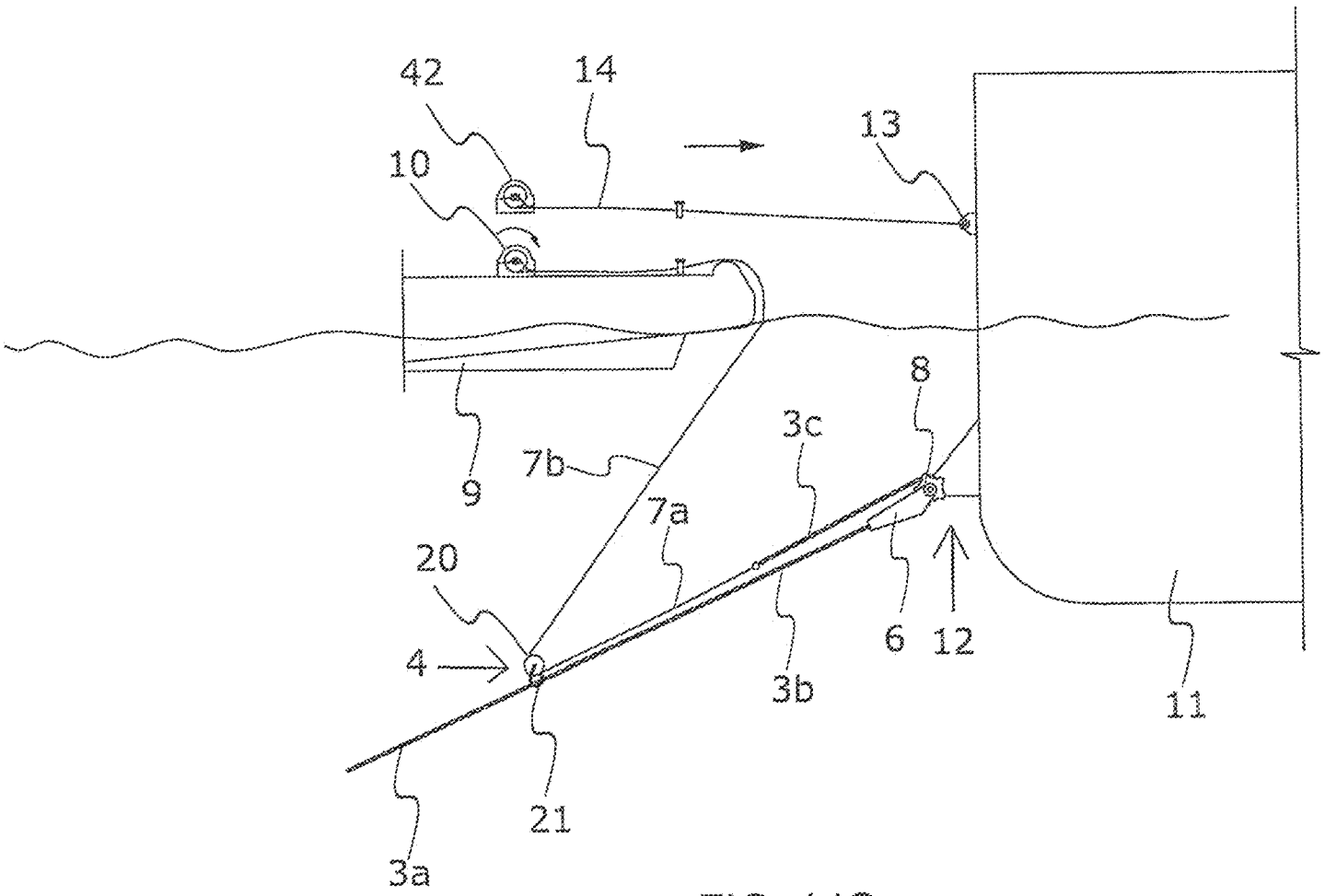
Figure 14D:
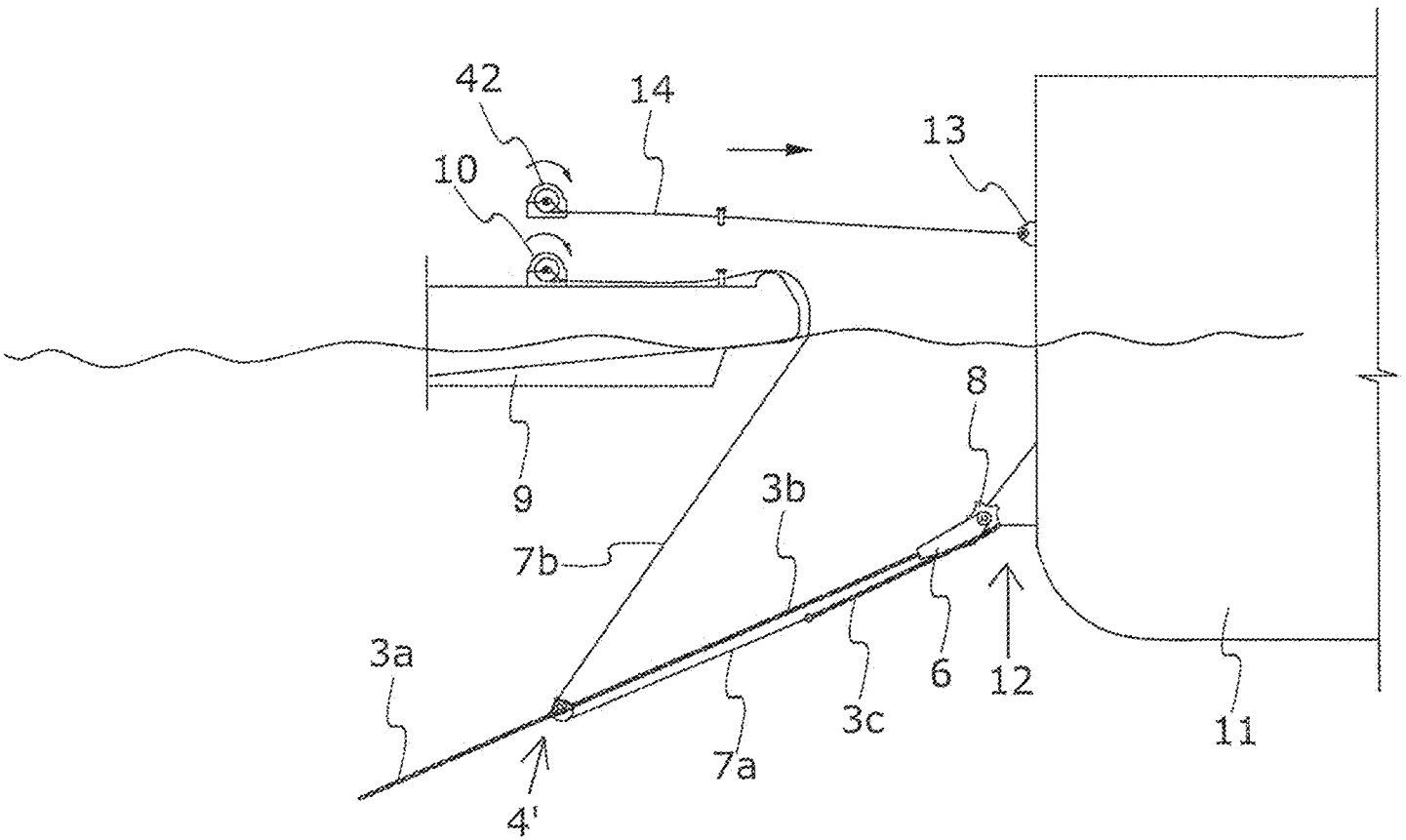
Figure 14E:
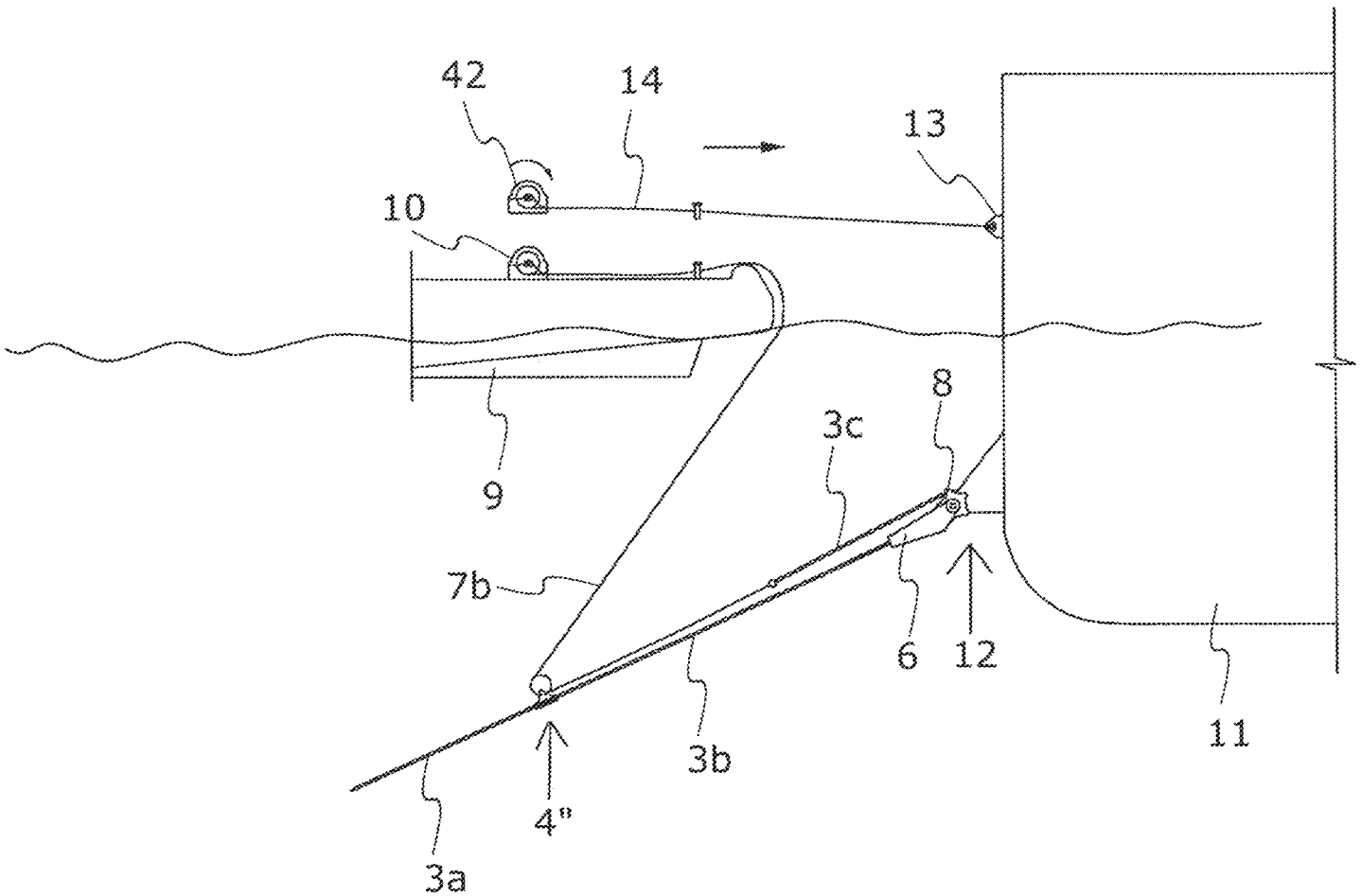
Figure 18A:
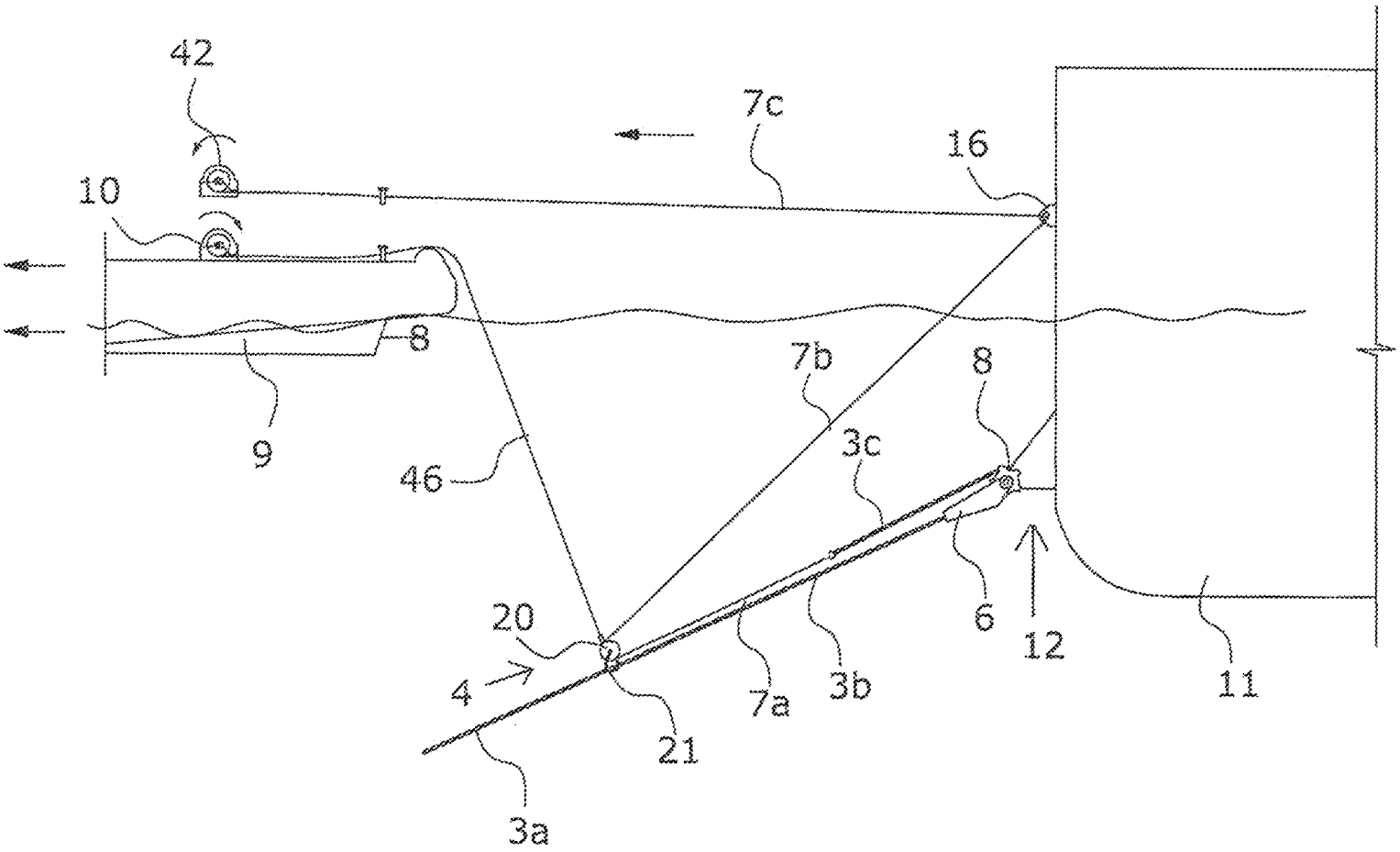
FIGS. 18*a-d* show a twelfth step in a second embodiment shown in FIG. 2 of a method of tensioning according to the present invention, where the tensioning of the mooring arrangement is performed. Tensioning with the bollard pull of the vessel.
Figure 18B:
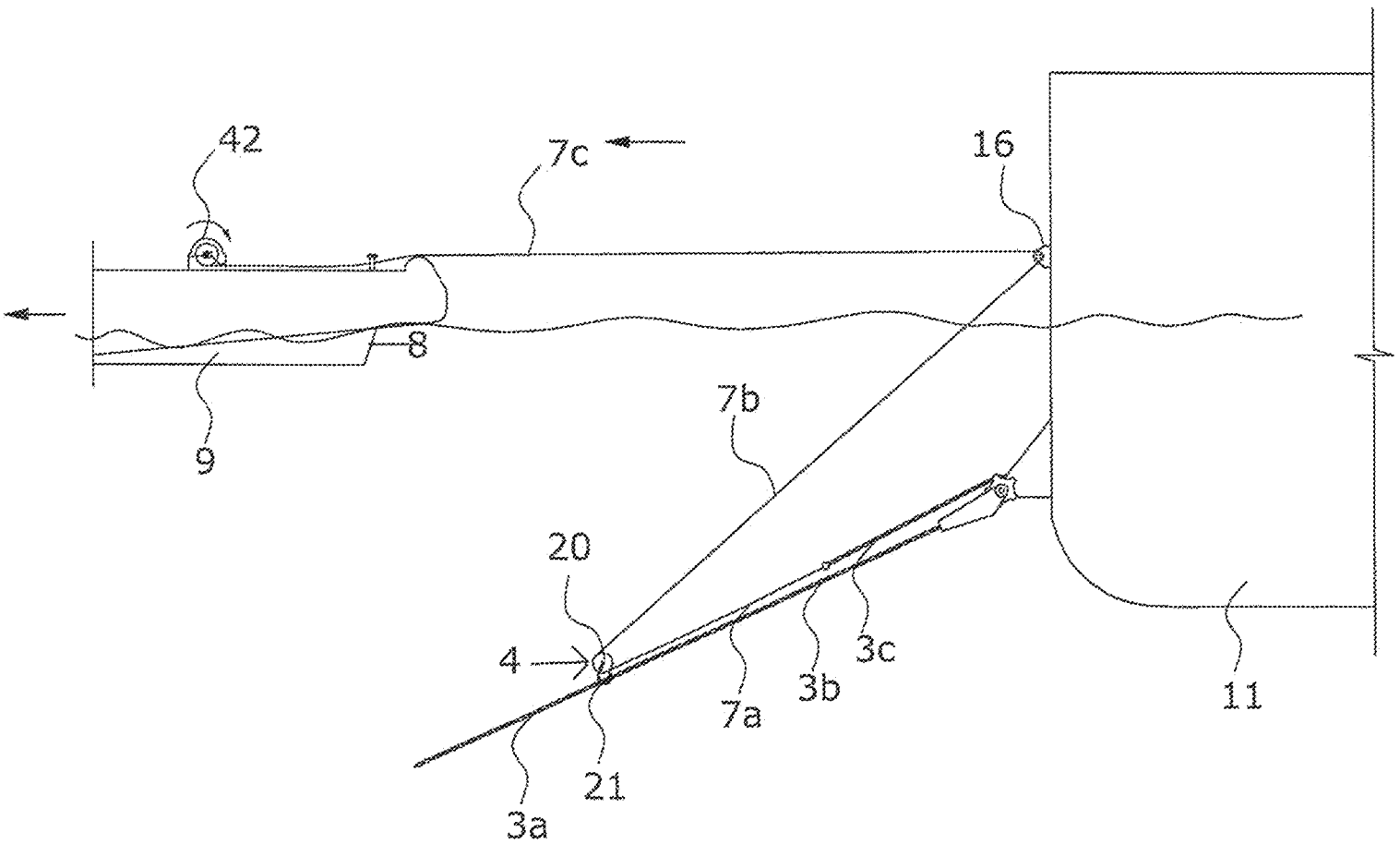
Figure 18C:
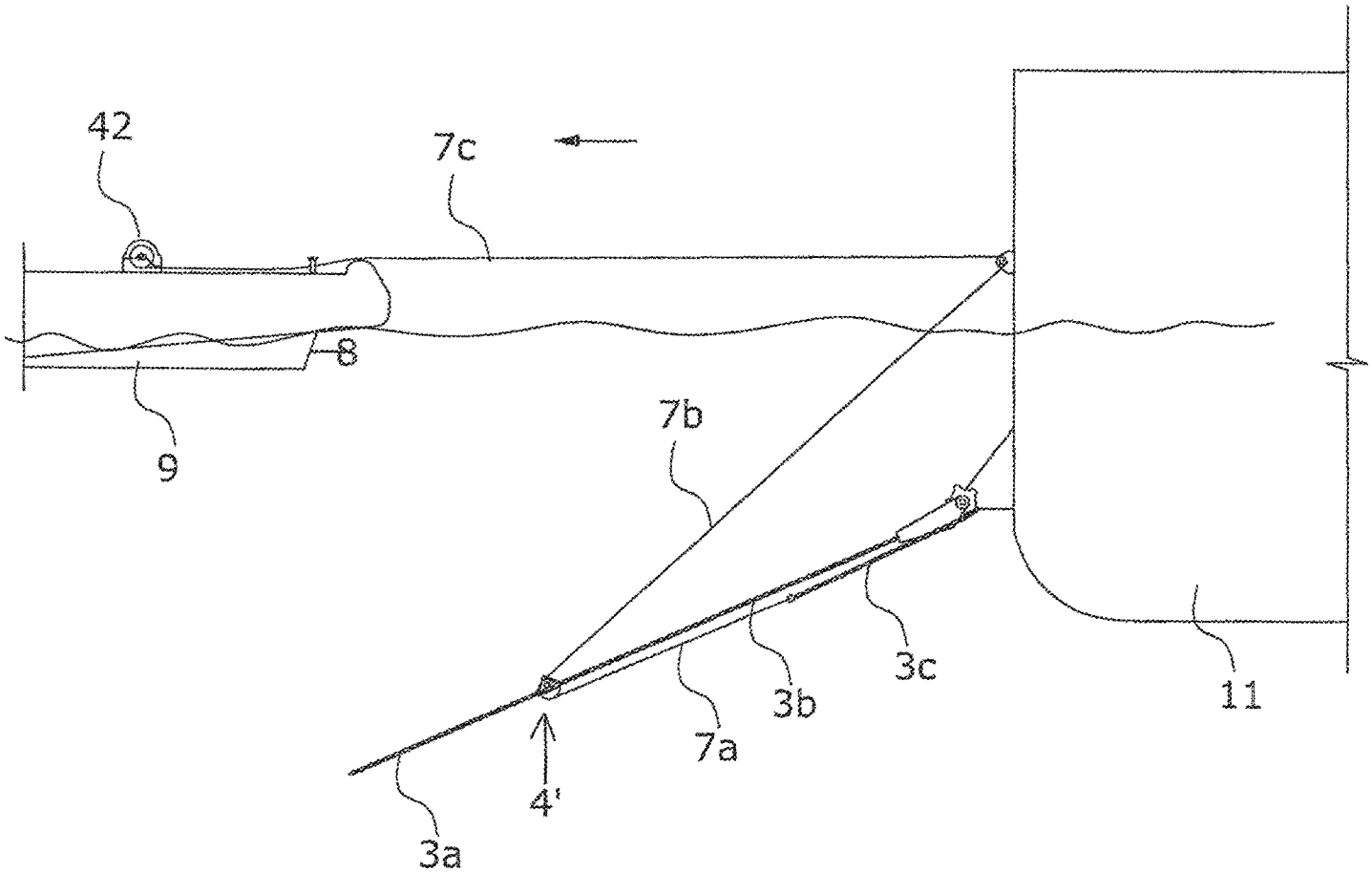
Figure 18D:
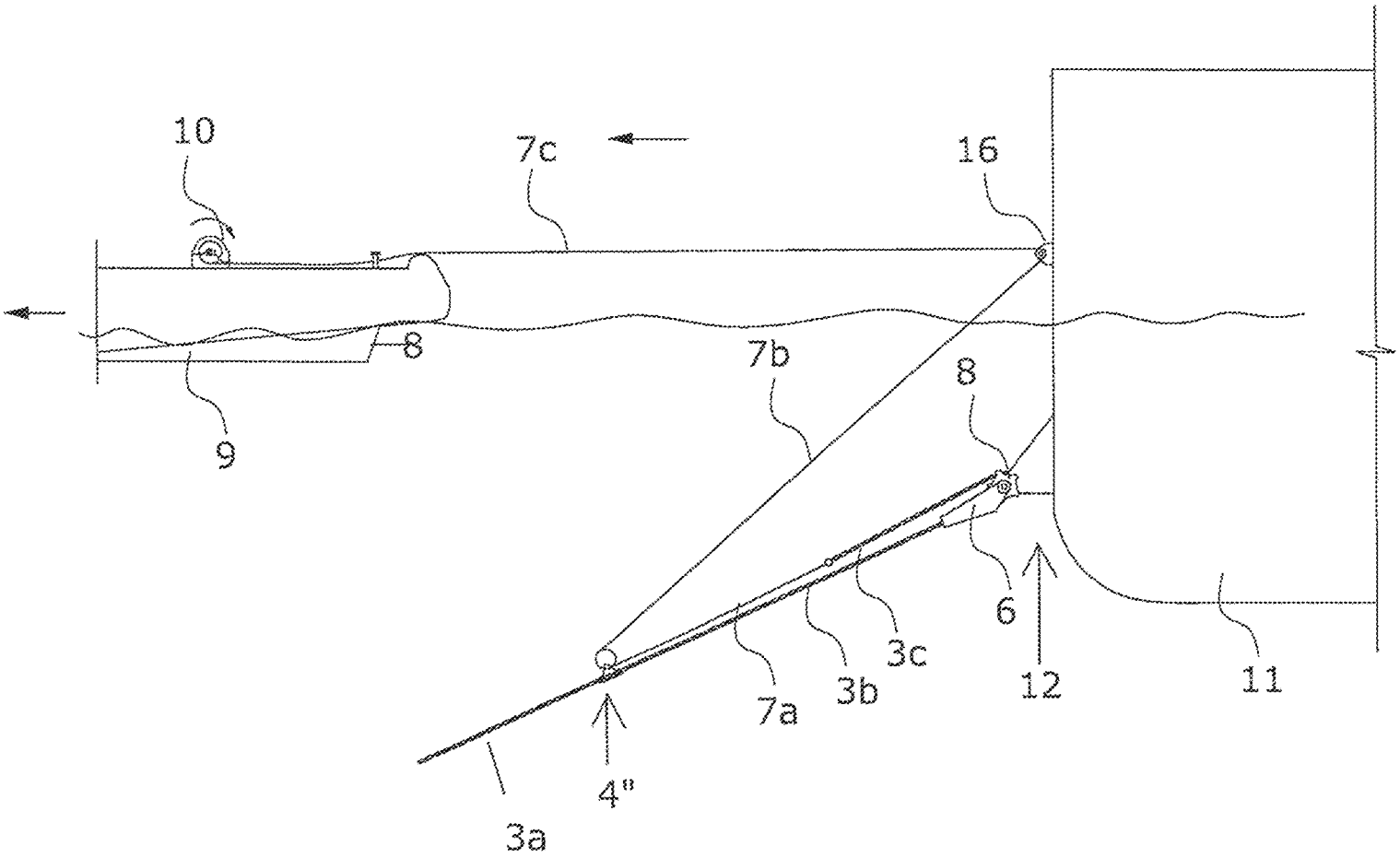

The term midwater pulley device may refer to any of the following: a temporary midwater pulley device 4 as shown in detail in FIG. 2*b*, a permanent midwater pulley device 4" as shown in FIGS. 14*e* and 18*d*, or an integrated midwater pulley device 4' as shown in FIGS. 14*d* and 18*c*. The temporary midwater pulley device 4 is adapted to be hooked onto the mooring chain 3 temporarily, while the permanent midwater pulley device 4" is fixedly connected to a chain part of the mooring chain 3. The integrated midwater pulley device 4' constitutes an integrated part of the mooring chain 3, separating the mooring chain 3 in two parts connected at each side of the integrated midwater pulley device 4'.

The term pulling system may refer to the winches 10, 42, 110 arranged on the installation vessel 9, 109 or the installation vessel 9, 109. The term pulling system may also refer to a combination of the winches 10, 42 and the installation vessel 9, 109 to tension the mooring line or a winch 10', 113 arranged on the floating structure.

FIG. 1 shows a mooring arrangement according to a first embodiment of the present invention. The mooring arrangement is installed between an anchor 2 that has been attached to the seabed 1 and a floating structure 11, such as an FPSO. The installation process will be further explained in detailed later.

The anchor 2 is conveniently a suction anchor but may alternatively be any type of anchor known in the field.

The tensioning mooring arrangement further comprises a mooring chain 3, a temporary midwater pulley device 4 with a midwater pulley 20, and a first installation wire 7. A hull bracket 33, a chain wheel 8 and a chain stopper 6 are arranged in a fairlead chain stopper arrangement 12, which is capable of retaining the mooring chain 3 in tension, preferably at the lower portion of the floating structure 11. Any position on the hull of the floating structure 11 is however possible.

The mooring chain 3 may also be a steel wire, polyester rope or a combination of these. The mooring chain 3 could be one continuous chain or the chain could be divided by an integrated midwater pulley device 4'. The mooring chain 3 may also comprise several segments of these.

Conveniently, the chain wheel 8 is attached to the hull bracket 33 by a shaft and the chain wheel 8 may rotate about a vertical axis.

A chain stopper 6 is also attached to the hull bracket 33. A detailed view of the fairlead chain stopper arrangement 12 comprising the hull bracket 33, chain wheel 8 and the chain stopper 6 is shown in FIG. 2*b*. This figure illustrates the second embodiment of the mooring tensioning arrangement. The fairlead chain stopper arrangement 12 is however equal in both embodiments of the mooring tensioning arrangements.

The chain wheel 8 is rotatable connected to a steel structure 26 of the hull bracket 33. The hull bracket 33 further comprises a lower hull support 27 and an upper hull support 28. A vertical shaft 29 connects the steel structure 26 with the lower hull support 27 and the upper hull support 28 so that the steel structure 26 can rotate about a vertical axis.

The chain stopper 6 is not shown in further detail. The chain stopper 6 comprises a channel through which the mooring chain 3 can pass. The chain stopper 6 may have a single latch or consist of two latches, both are known per se. The latch or latches may be operated by a spring which closes the latch or latches towards a closed position to ensure safe closing of the lath or latches. Opening the chain stoppers 6 may be performed by a permanent hydraulic cylinder, mechanically with lever arm, links and/or wires or as another option with a temporary mechanical or hydraulic tool operated from the FPSO or the vessel performing the chain operation.

From FIG. 2*b* it is shown that the fairlead chain stopper 6 is attached to the hull bracket 33 in one end and having a free end extending away from the floating structure 11. In the FIG. 2*b*, the chain stopper 6 and the chain wheel 8 are attached to the hull bracket 33 by a common shaft (i.e., the male part 34). This connection allows the chain wheel 8 to rotate around its horizontal center axis and the chain stopper 6 to pivot about the same horizontal center axis.

In FIG. 2*b*, the fairlead chain stopper 6 and chain wheel 8 are arranged so that the mooring chain 3 is extending upwards around the chain wheel 8. In FIGS. 1 and 2*a* there are shown a fairlead chain stopper arrangement 12 where the fairlead chain stopper 6 is arranged above the chain wheel 8 so that the chain is extending downwardly around the chain wheel 8. Both these arrangements are possible embodiments of the invention.

Other connection arrangements between the hull bracket 33, chain wheel 8 and the chain stopper 6 are also possible. The relation between the chain stopper 6 and the chain wheel 8 must however be such the mooring chain 3 extending through the chain wheel 8 is always following a straight line that is tangential to the outer circumference of the chain wheel 8 in every position of the chain stopper 6. The chain stopper 6 is preferably also pivotably connected to the hull bracket 33 so that the lower free end could move due to the direction of the mooring chain 3.

FIG. 2*b* also shows the connection fairlead construction and the attachment to the floating structure in further detail. This could also be equal in both the embodiments of the stopper arrangements.

A further alternative solution for the fairlead construction is shown in FIGS. 2*c*1 and 2*c*2. In this embodiment, the steel structure 26 is connected to the hull via a hull bracket 33 and a connecting link 30. Two shafts 31, 32 ensures freedom of movement in two planes. Alternatively, the connecting link can be replaced with a shackle.

In the alternative embodiment of FIGS. 2*d*1 and 2*d*2, the connecting link 30 and shaft 32 has been replaced by a connector comprising a male part 34 and a female part 35, the female part 35 being capable of retaining the male part 34 within a hole in the female part 35 in a conventional male-female connection. The female part 35 is rotatable about a horizontal axis with respect to the hull bracket 33.

A rope or wire 36 is initially connected at the end of the male part 34. The rope or wire 36 is fed through the hole in the female part, and by pulling the rope or wire 36, the male part 34 can be brought to enter the hole of the female part 35.

The embodiments of the connection between the chain tensioner and the floating structure or vessel are illustrated without the chain stopper. A similar chain stopper 6 as described above are connected to all the embodiments shown in FIGS. 2*c*1 and 2*c*2 and FIGS. 2*d*1 and 2*d*2.

The hull bracket 33, the steel structure 26 and shaft 24 and 29 are part of the mooring load line and must be strong enough to carry the mooring load.

The temporary midwater pulley device 4 is in FIG. 1 arranged in connection with the mooring chain 3. Preferably, the temporary midwater pulley device 4 is releasable connected to the mooring chain 3, but an integrated or permanent midwater pulley device 4', 4" are also possible embodiments of the invention. These could be seen in FIG. 14*d-e* and FIG. 18*c-d*. The temporary midwater pulley device 4 is dividing the mooring chain 3 physically into a first mooring chain part 3*a* extending between the anchor 2 and the temporary midwater pulley device 4, and a second mooring chain part 3*b* extending from the temporary midwater pulley device 4 towards the floating structure 11. The temporary midwater pulley device 4 is attached to the first mooring chain part 3*a* and the second mooring chain part 3*b* in opposite ends of the temporary midwater pulley device 4.

An embodiment of a temporary midwater pulley device 4 is shown in detail in FIG. 2*b* and also FIGS. 12, 13*a-c*, 14*a-c* and FIGS. 16*a*-18*b*. The temporary midwater pulley device 4 could also be equal in both embodiments of the mooring tensioning arrangement. The temporary midwater pulley device 4 comprises a midwater pulley 20 rotatable coupled to a connector 21. The connector 21 could for instance be a hook or a hooked device suitable to engage with a chain link 3*d* of the mooring chain 3 as shown in the FIG. 2*b*. An ROV may be used to assist this operation.

The midwater pulley 20 and the connector 21 could for instance be connected to each other via a structure 22. The midwater pulley 20 could for instance be arranged rotatable about a shaft 23 that is mounted in the structure 22 and the connector 21 could form an integrated part of the structure as illustrated in the FIG. 2*b*.

As seen in FIG. 1, the temporary midwater pulley device 4 is positioned on the mooring chain 3 a distance from the floating structure 11. The mooring chain 3 is further divided into three parts to make it easier to describe how the mooring tensioning arrangement is arranged. As described earlier these parts could form one continuous mooring chain 3 from the anchor 2 to the first installation wire 7.

The mooring chain 3 is in one end attached to the anchor 2 at the seabed 1. The mooring chain 3 is extending from the anchor 2 through the chain stopper 6 and around the chain wheel 8 of the fairlead chain stopper arrangement 12. The first mooring chain part and the second mooring chain part have numerals 3*a* and 3*b*, respectively. The mooring chain 3 further extends back along the second mooring chain part 3*b*. A third mooring chain part 3*c* is attached to a first wire segment 7*a* between the temporary midwater pulley device 4 and the fairlead chain stopper arrangement 12 and the first installation wire 7 is further extending as a second wire segment 7*b* around the midwater pulley 20 back to the second wire pulley 16 and then towards an installation vessel 9. The first installation wire 7 is connected to the installation vessel 9 in a number of possible ways.

For instance, could the first installation wire 7 be connected to a winch 10, 42 on the support vessel, fixed by shark jaw 51, 52 or loosely connected to the support vessel 9. The first installation wire could also be connected to a winch 10' at floating structure. Support vessel 9, winches 10, 10' 42 and shark jaw 51 and 52, collectively comprise and are referred to herein as a pulling unit (wherein each are shown individually in the Figures).

In addition to the arrangement with the mooring chain 3, the embodiment of FIG. 1 also comprises a second installation wire 14. The second installation wire 14 is extending between a fixed point 13 on the floating structure 11 and the installation vessel 9. The fixed point 13 could for instance be a steel plate with a hole there-through, a mooring ring or mooring post, etc. arranged on the hull of the floating structure 11. The second installation wire 14 is preferably connected to a first winch 10 or a second winch 42 or other pulling equipment on the installation vessel 9.

In the FIG. 1 the fairlead chain stopper arrangement 12 is arranged below the seawater 15. The fixed point 13 for the second installation wire 14 is arranged above the seawater. This is for illustration only. Other positions for the fairlead chain stopper arrangement 12 and the fixed point are possible.

FIG. 2*a* shows the tensioning mooring arrangement according to a second embodiment of the invention. Features that are equal in the two embodiments have the same numeral in the figures.

The embodiment of FIG. 2*a* is similar to the arrangement shown in FIG. 1 except that the first installation wire 7 is extending between the midwater pulley 20 and a second wire pulley 16 arranged on the floating structure 11 before the first installation wire 7 is coupled to the installation vessel 9.

This arrangement replaces the fixed point 13 with the second wire pulley 16 and the independently arranged second installation wire 14 with a third wire segment 7*c* which is an elongation of the first wire segment 7*a* and second wire segment 7*b* from the first embodiment.

FIG. 2*b* shows the embodiment in detail. The positioning of the second wire pulley 16 could be anywhere on the hull of the floating structure 11, either close to the fairlead chain stopper arrangement 12 as indicated in FIG. 2*a* or a distance from the fairlead chain stopper arrangement 12 as shown in FIG. 2*b*. The second wire pulley 16 may be situated above the fairlead chain stopper arrangement 12, but may also be situated on the same level next to the fairlead chain stopper arrangement 12 or even below.

An installation sequence according to the invention will now be described.

Figure 19:
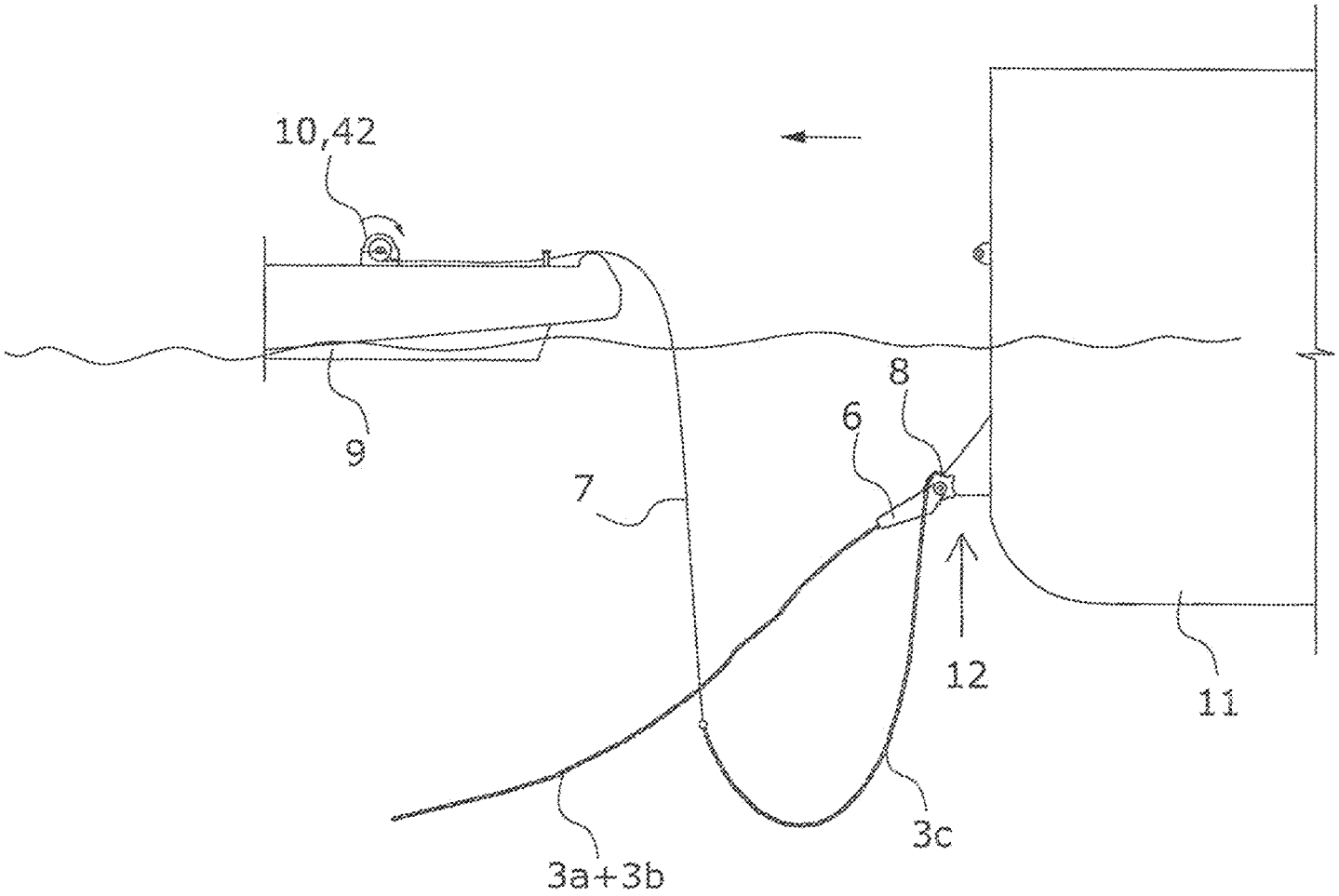
FIG. 19 shows a thirtieth step in the first and second embodiment of a method of tensioning according to the present invention, where the tensioning mooring arrangement is removed from the mooring arrangement.
Figure 20:
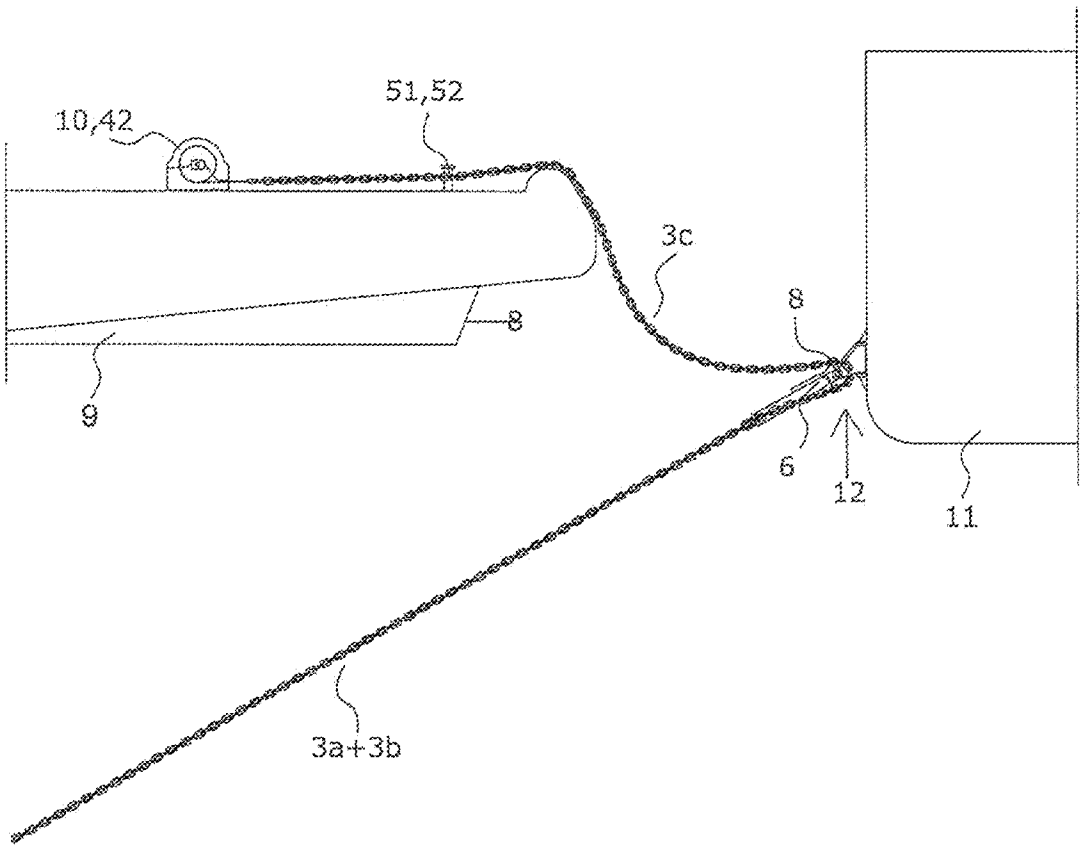
FIG. 20 shows a thirty-first step in the first and second embodiment of a method of tensioning according to the present invention, where the mooring chain is cut to a suitable length.
Figure 21:
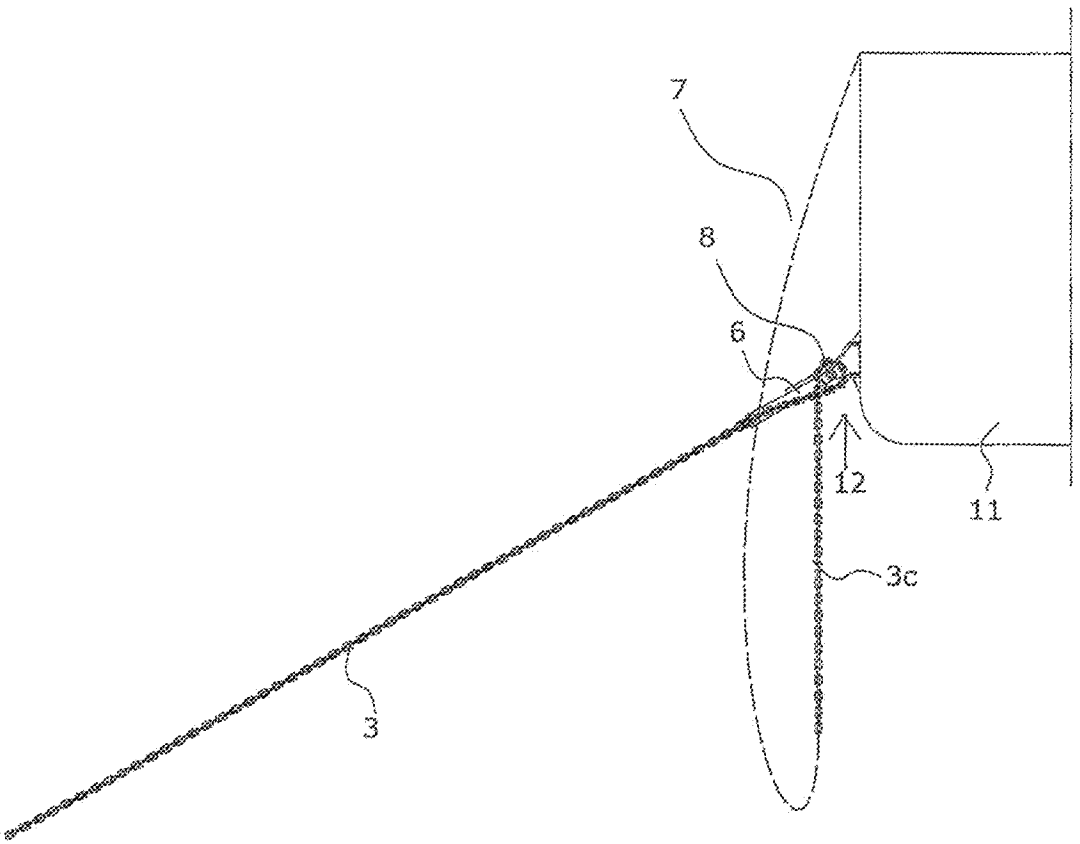

FIGS. 3-10 are common installation sequences for both embodiments in FIGS. 1 and 2. FIGS. 11-14 show the further installation sequences to the embodiment shown in FIG. 1. FIGS. 15-18 show the further installation sequences to embodiment shown in FIG. 2. FIGS. 19-21 show the sequences after tensioning the mooring arrangement when the temporary midwater pulley device 4 is removed. These sequences are also common in both embodiments.

During the installation, a number of additional ropes, wires and winches than described above are typically used. These items will be described below. However, other additional conventional equipment may be used, and this shall not limit the method.

Figure 3C:
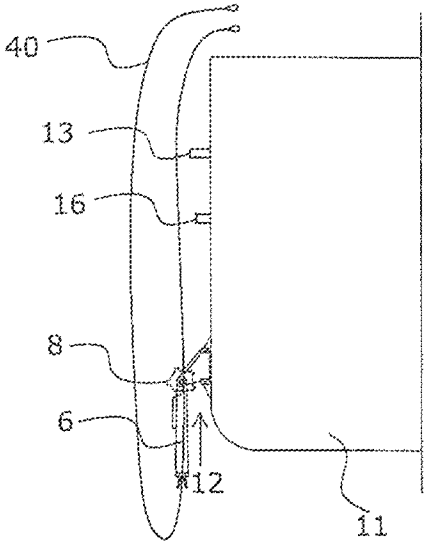
FIGS. 3*a-c* to 21 show typical installation procedures of the first and second embodiment of the invention. It should be noted that this is based on an approach where the first part is to get the FPSO storm safe or safely moored sufficiently for the final tensioning to be performed. This means that all of the mooring lines shall be connected with a link on the mooring chain to the FPSO. When all the mooring lines are connected, final tensioning can be performed.
Figure 3A:
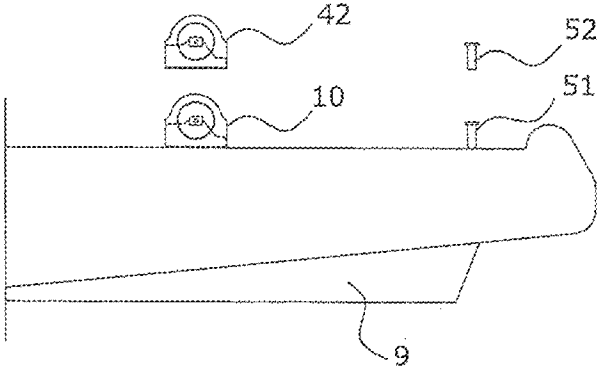
Figure 3B:
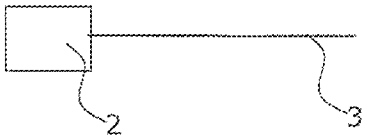

FIG. 3 shows the floating structure 11 at the start of the installation of the mooring tensioning arrangement. A forerunner 40 of the first installation wire 7 has been led through the chain wheel 8 and the chain stopper 6. The installation vessel 9 or specialized anchoring vessel has installed the anchor 2 at the seabed 1. Typically, the mooring chain 3 has been left on the seabed attached to a rope 37 (FIG. 6) with a buoy (not shown) at the free end. The installation vessel 9 having one or more winches 10, 42 (first and second winch) and one or more shark jaws (first shark jaw 51 and second shark jaw 52) to facilitate the mooring pull-in and tensioning operation. Both of these features are arranged on the deck of the installation vessel 9 as indicated in FIG. 1. Shark jaws and winches as such are well known per se.

Figure 4:
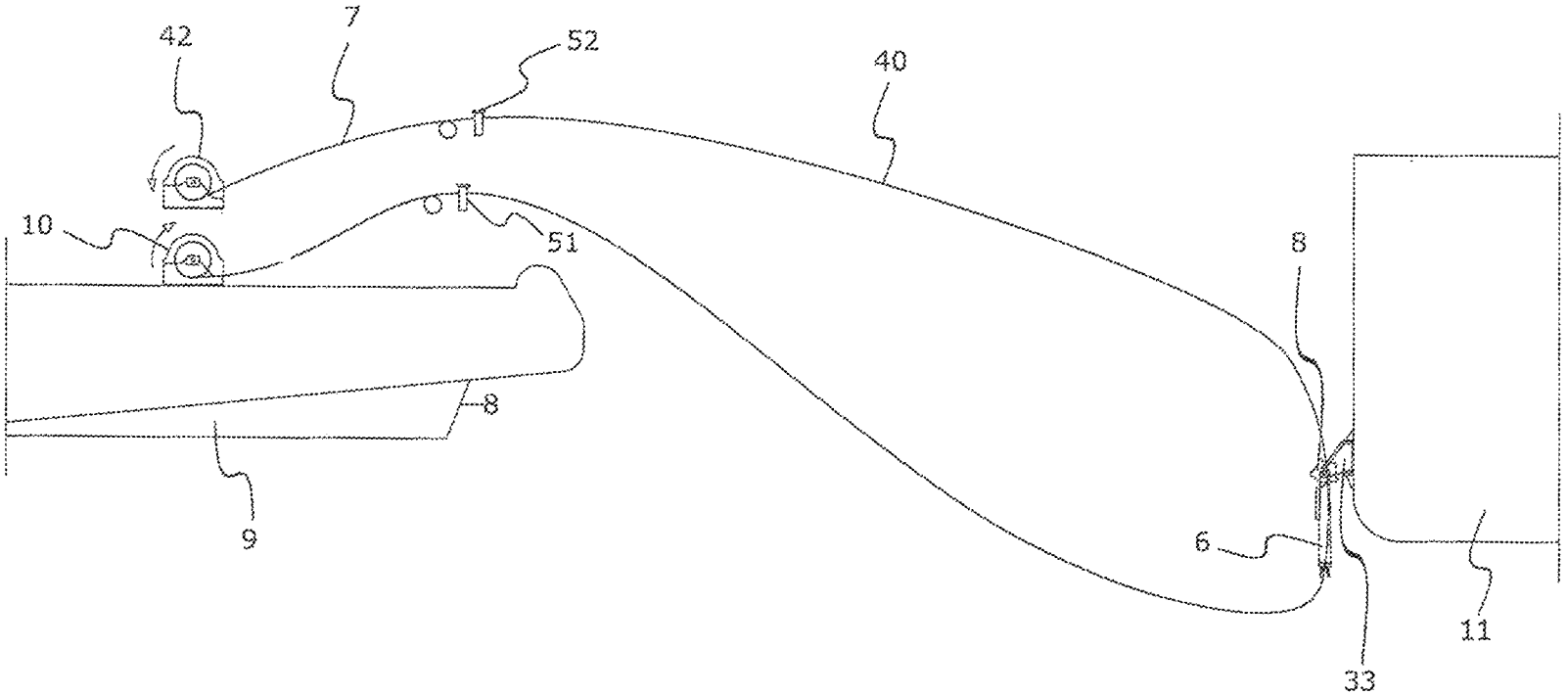
FIG. 4 shows a second step in the first and second embodiment of a method of tensioning according to the present invention, where a forerunner has been installed between the floating structure and the installation vessel.
Figure 5:
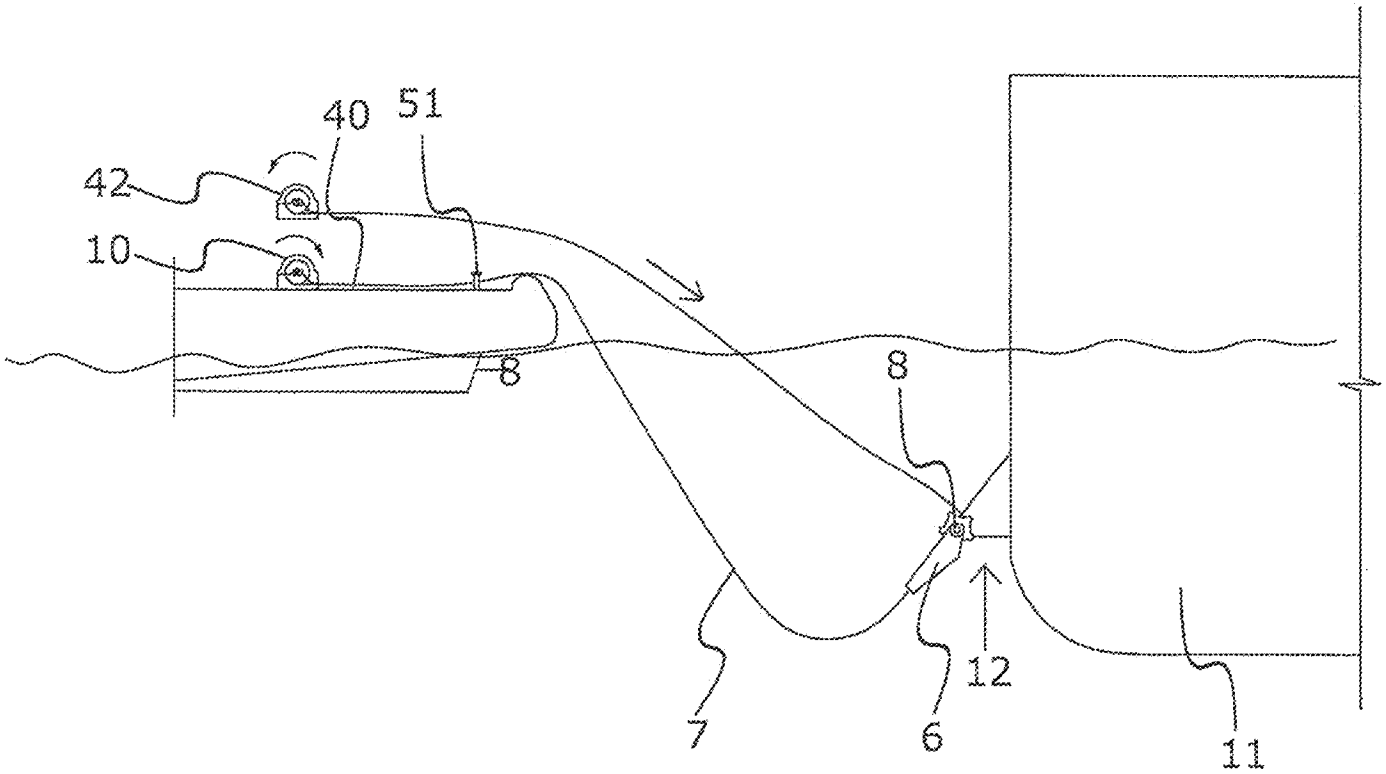
FIG. 5 shows a third step in the first and second embodiment of a method of tensioning according to the present invention, where a first installation wire is replacing the forerunner.

As shown in FIG. 4, both ends of the forerunner 40 are transferred from the floating structure 11 to the installation vessel 9. One end of the forerunner 40 is then connected to the first installation wire 7 which is connected to a second winch 42. The other end of the forerunner 40 is then connected to a first winch 10 or other connecting arrangements on the installation vessel 9. The forerunner 40 is extending over the first shark jaw 51 and the second shark jaw 52 on the installation vessel 9. The first winch 10 is pulling in the forerunner 40 which result in that the first installation wire 7 is run through the chain wheel 8 and around the chain stopper 6, replacing the forerunner 40 as shown in FIG. 5. The shark jaw 51 is locking the first installation wire 7 in a fixed position after replacing the forerunner 40 in the arrangement.

Figure 6:
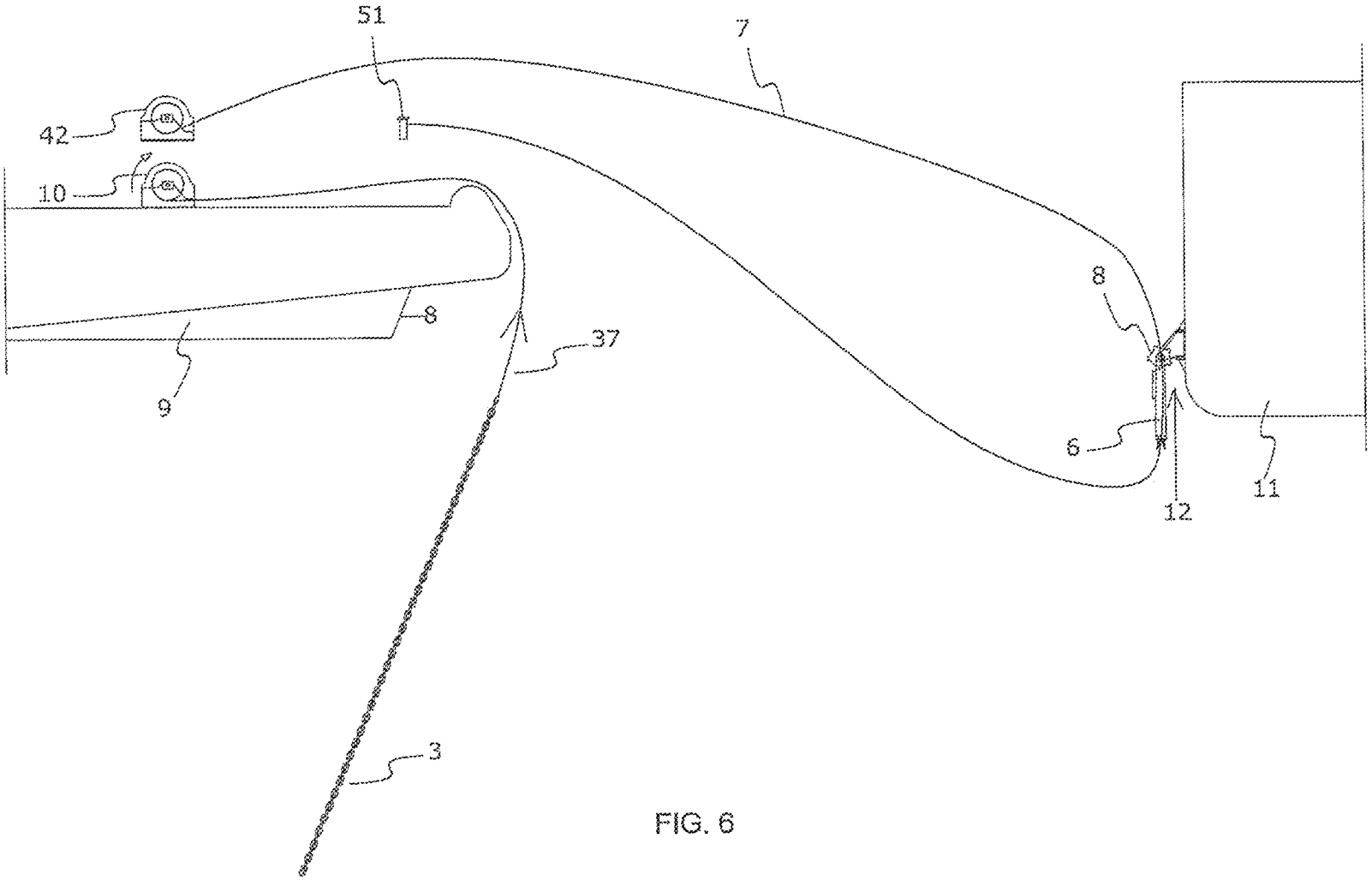
FIG. 6 shows a fourth step in in the first and second embodiment of a method of tensioning according to the present invention, where a mooring chain is pulled in by the installation vessel.

As shown in FIG. 6 the rope 37 and buoy connected to the mooring chain 3 has been picked up and the first winch 10 of the installation vessel 9 is pulling in the mooring chain 3. The first installation wire 7 is maintained in the fixed position by the shark jaw 51.

Figure 7:
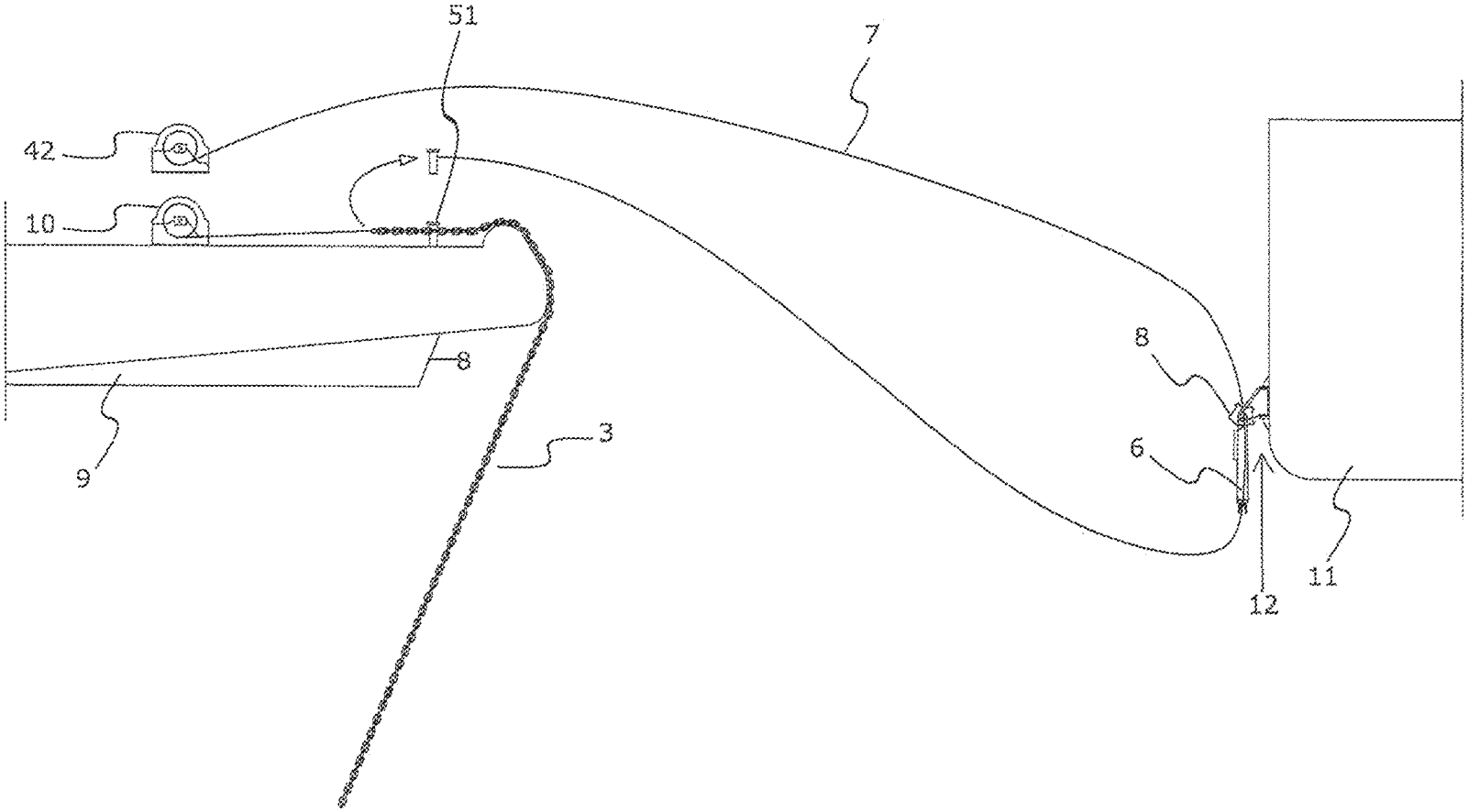
FIG. 7 shows a fifth step in the first and second embodiment of a method of tensioning according to the present invention, where the first installation wire and mooring chain is connected together at the installation vessel.

FIG. 7 shows the step of connecting the mooring chain 3 and on end of the first installation wire 7 together. The mooring chain 3 disconnected from the first winch 10 and held in a fixed position in the shark jaw 51 before connection with the first installation wire 7. The other end of the first installation wire 7 is connected to the second winch 42.

Figure 8:
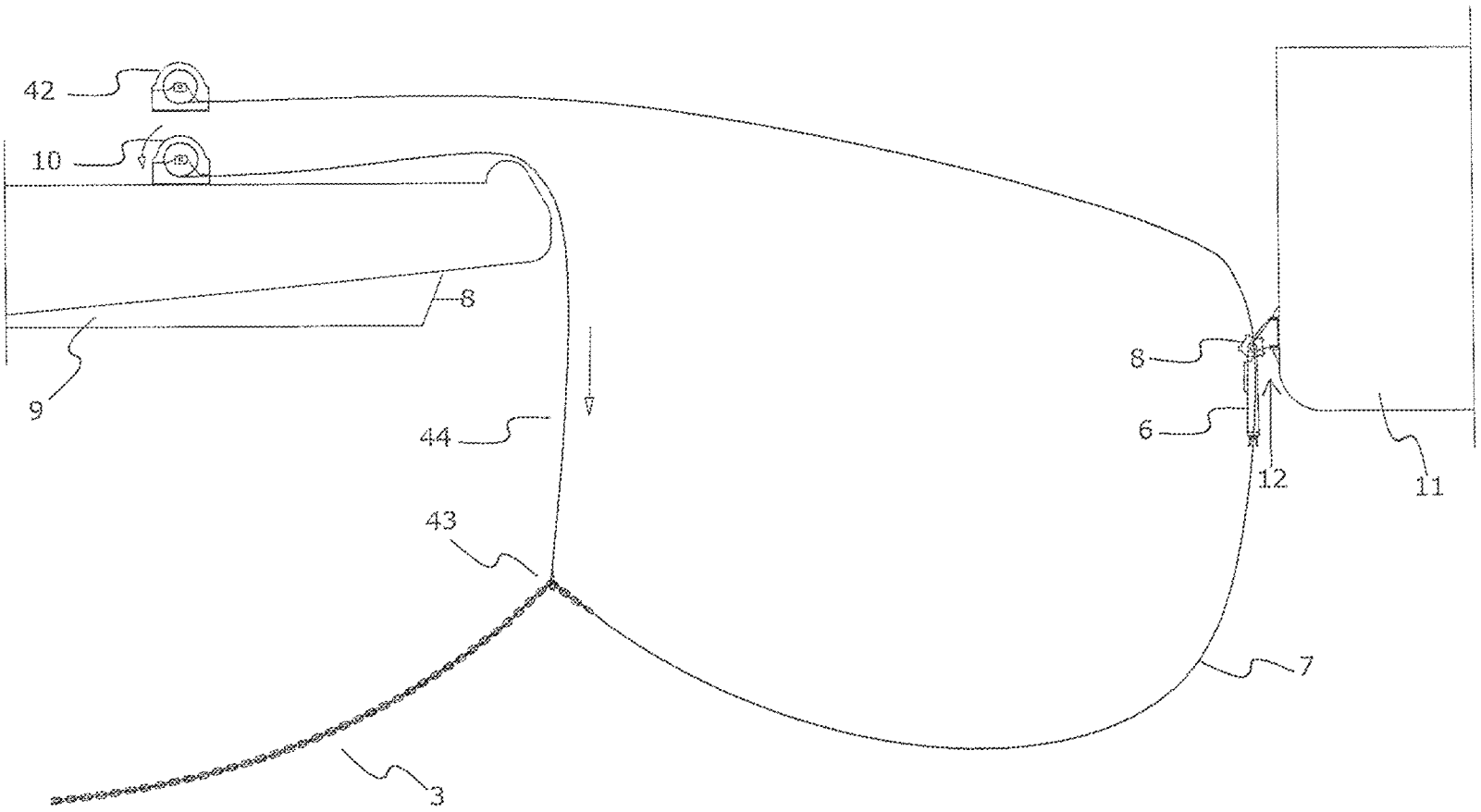
FIG. 8 shows a sixth step in the first and second embodiment of a method of tensioning according to the present invention, where the connection part between the first installation wire and the mooring chain is lowered down into the sea by lowering means.

As shown in FIG. 8 the connected mooring chain 3 and the first installation wire 7 is lowered from the installation vessel 9 into the sea. This could preferably be performed by a hook 43 that is connected to a hook wire 44. The first winch 10 could pay out the hook wire 44. This ensures a safe and controlled lowering of the mooring chain 3 together with the first installation wire 7 into the sea.

Figure 9:
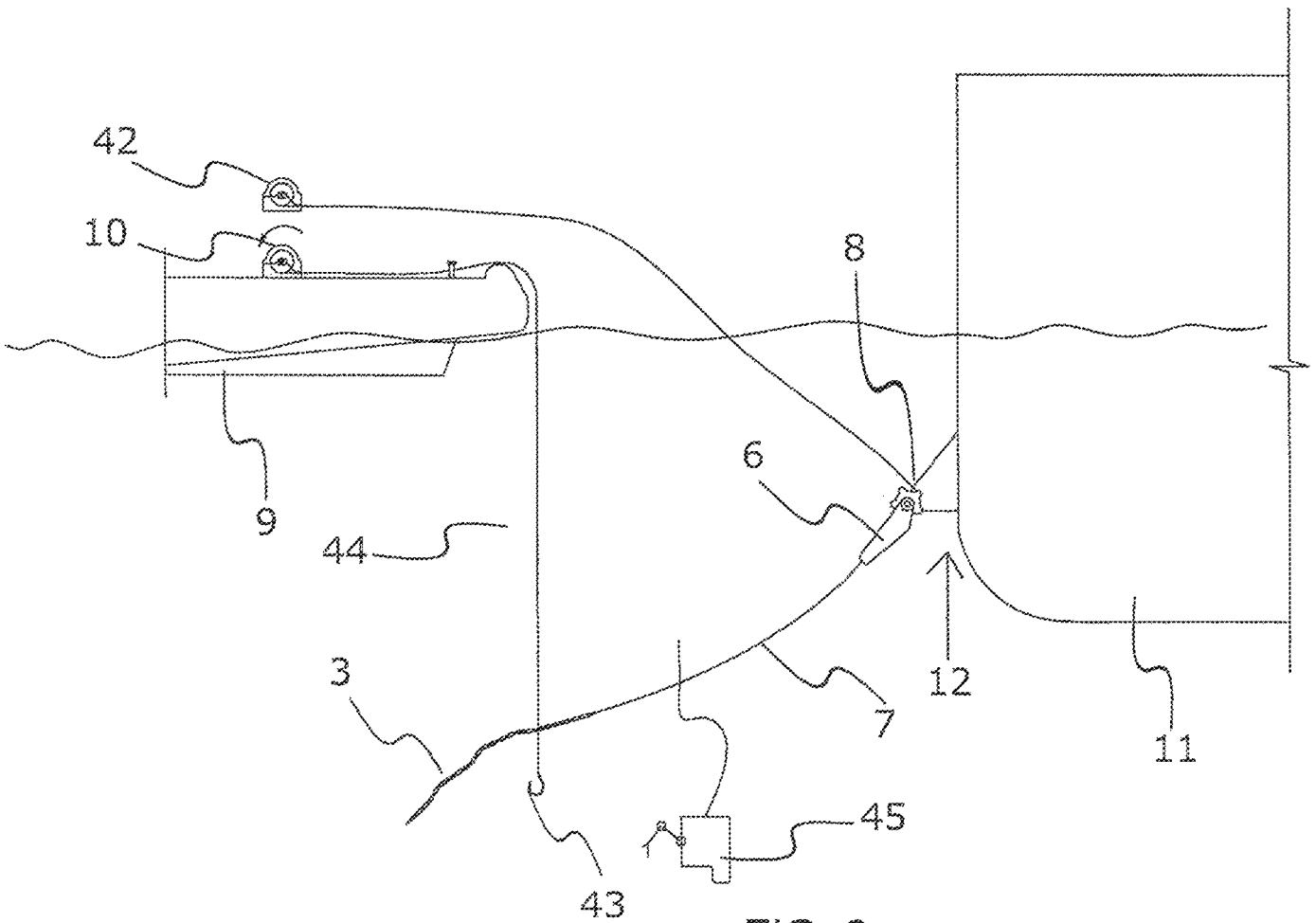
FIG. 9 shows a seventh step in the first and second embodiment of a method of tensioning according to the present invention, where the lowering means are released from the mooring chain.

The mooring chain 3 and the first installation wire 7 are lowered down from the installation vessel 9 until there is no tension on the hook 43. The hook 43 is then released. The releasing of the hook 43 could for instance be performed by an ROV 45. This is shown in FIG. 9. The releasing of the hook 43 could also be performed by paying out the hook 43.

Figure 10:
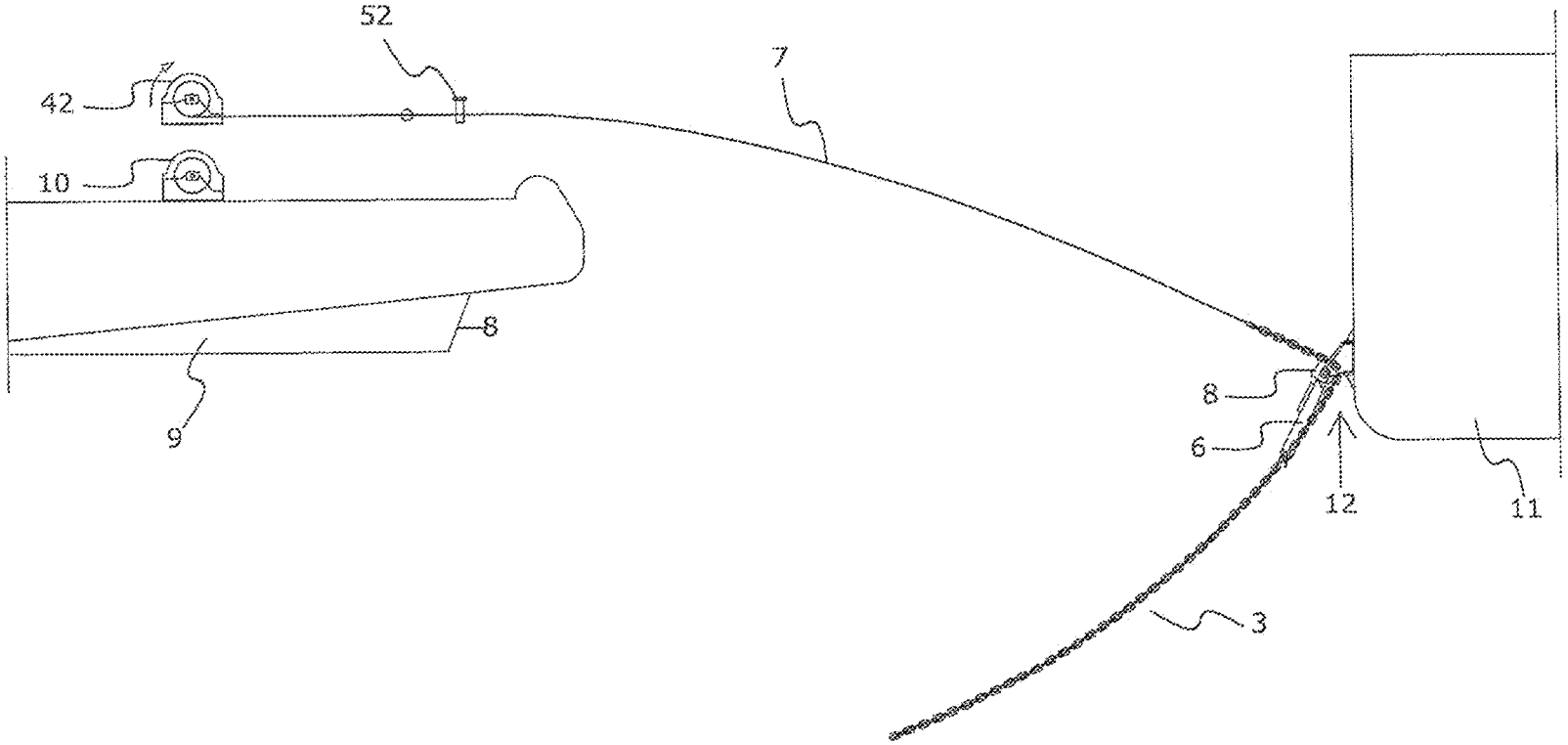
FIG. 10 shows an eight step in the first and second embodiment of a method of tensioning according to the present invention, where the first installation wire and the mooring chain are tensioned by the installation vessel.

As shown in FIG. 10 the mooring chain 3 with the first installation wire 7 is pulled in by the second winch 42 so that the mooring chain 3 extends through the chain stopper 6 and around the chain wheel 8.

At this point the floating structure 11 is storm safe but the mooring is not final assuming the pretension requirement exceeds the bollard pull of the installation vessel 9. The first installation wire 7 is now held in a fixed position in the second shark jaw 52 and could be disconnected from the second winch 42.

Figure 11:
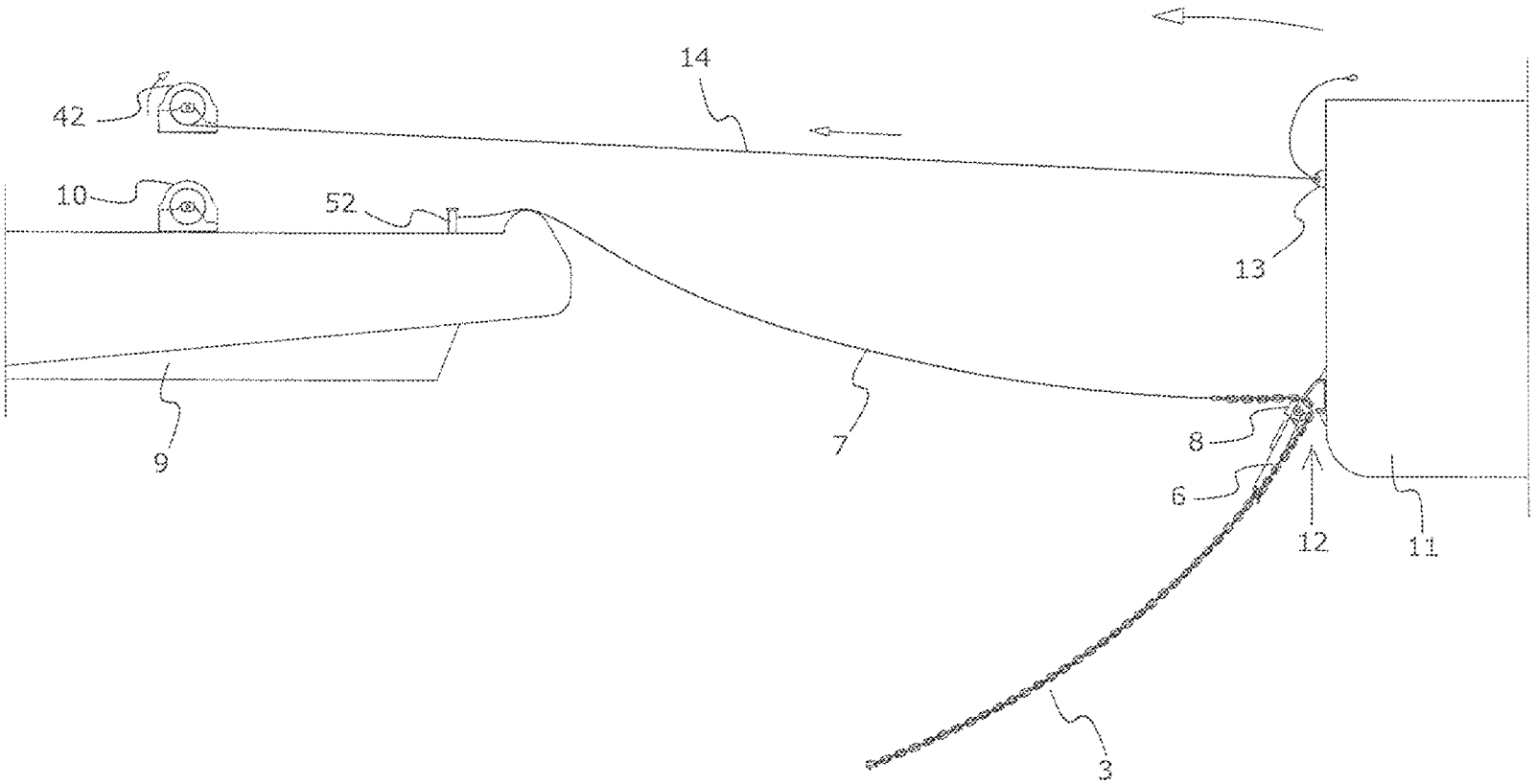
FIG. 11 shows a ninth step in the first embodiment of a method of tensioning according to the present invention, where a second installation wire is transferred from the floating structure towards the installation vessel.

FIG. 11 shows the next mooring tensioning sequence according to the first embodiment of the invention. The second installation wire 14 is fixedly attached to the hull of the floating structure 11 in the fixed point 13 in one end. The opposite free end of the second installation wire 14 is transferred to the second winch 42 on the installation vessel 9.

In this sequence, the installation vessel 9 is moved closer to the floating structure 11. The chain stopper 6 prevents the movement of the parts of the first mooring chain part 3*a* and the second mooring chain part 3*b* between the anchor 2 and the fairlead chain stopper arrangement 12. The tension of the first and second mooring chain parts 3*a* and 3*b* between the anchor and the chain stopper 6 is maintained.

The third mooring chain part 3*c* and the first installation wire 7 will however become slack as shown in the FIG. 11. This part is connected to the installation vessel 9 through the second shark jaw 52 as described above.

Figure 12:
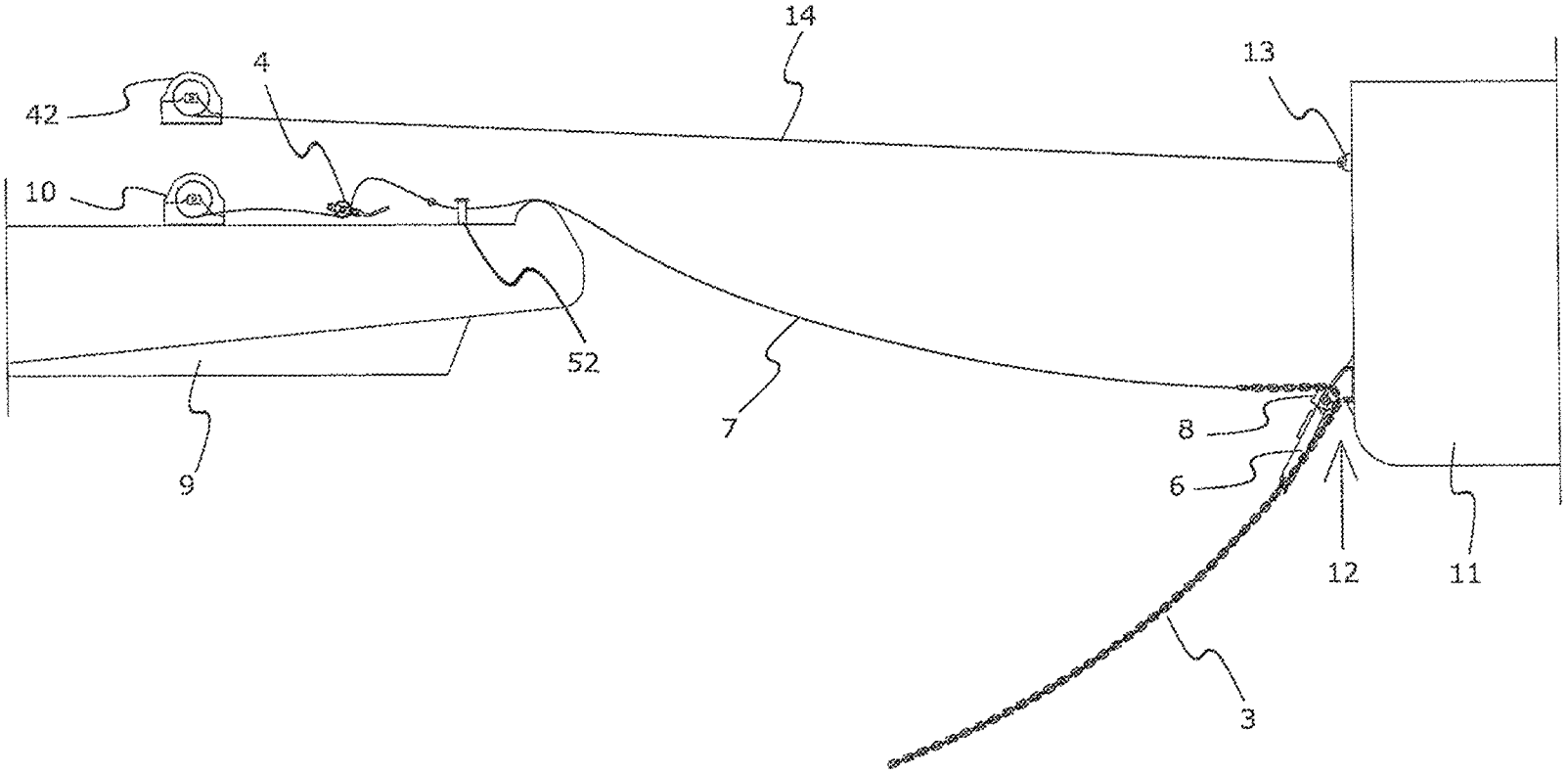
FIG. 12 shows a tenth step in the first embodiment of a method of tensioning according to the present invention, where the midwater pulley device is coupled to the first installation wire.
Figure 13A:
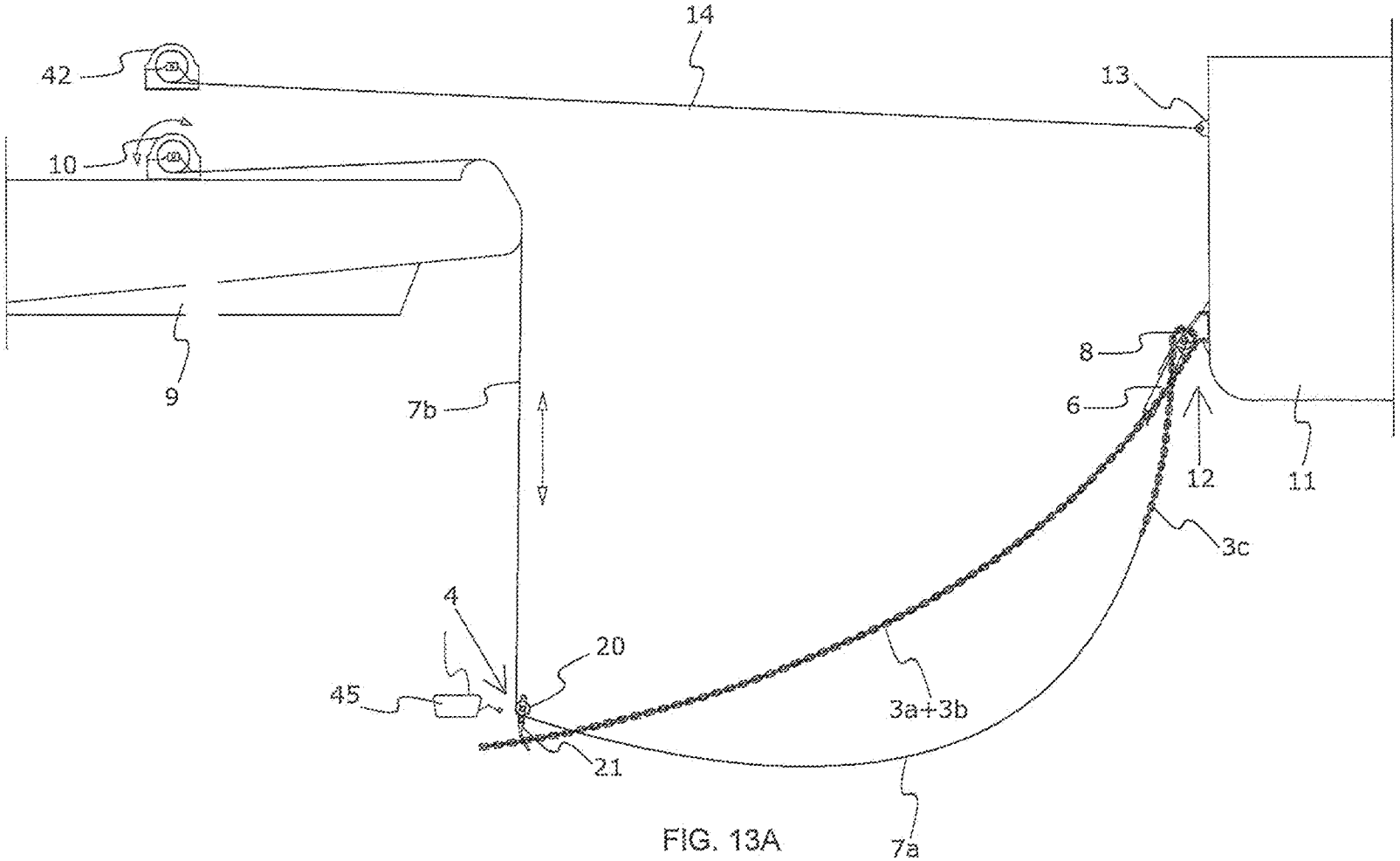
FIGS. 13*a*-13*c* show an eleventh step in the first embodiment of a method of tensioning according to the present invention, where the temporary midwater pulley device is connected to the mooring chain.
Figure 13B:
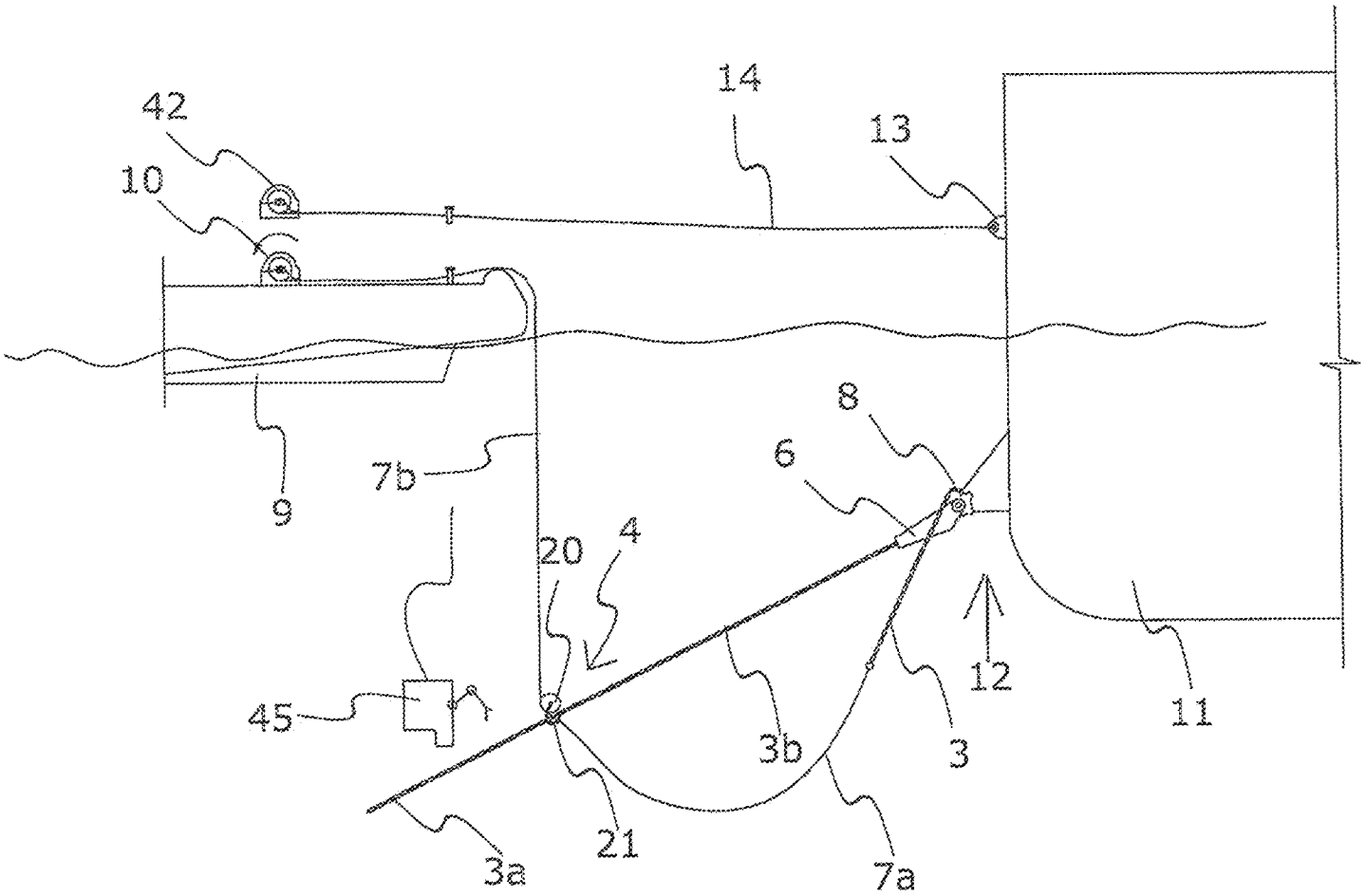
Figure 13C:
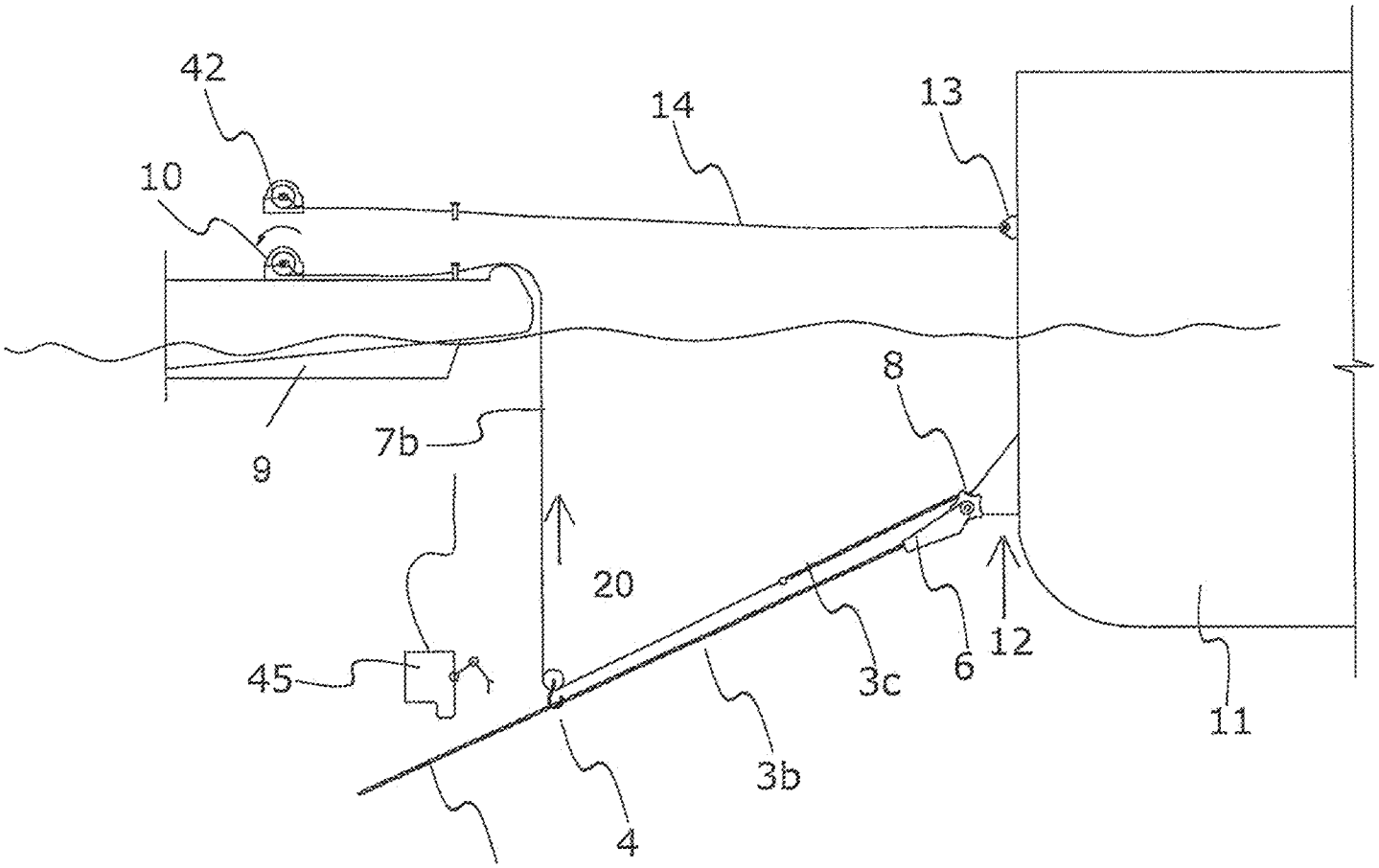

In FIG. 12 there is shown the connection of the temporary midwater pulley device 4 and the first installation wire 7. The first installation wire 7 is extending around the midwater pulley 20 of the temporary midwater pulley device 4. When the temporary midwater pulley device 4 is to be lowered towards the mooring chain, a wire has to be locked to the pulley. This may be done any type of brake, clamp or similar. The temporary midwater pulley device 4 is then lowered down towards the the first mooring chain part 3*a* and second mooring chain part 3*b* extending between the anchor 2 and the fairlead chain stopper arrangement 12. In this embodiment it is not necessary to use an additional crane or the winches to lower the temporary midwater pulley device 4. The temporary midwater pulley device 4 is then engaging with the mooring chain 3. This is shown in FIGS. 13*a*-13*c*. The connection between the mooring chain and the temporary midwater pulley 4 could preferably be performed by a ROV 45.

In FIGS. 14*a*-14*b*, a further tensioning of the mooring arrangement is performed by the winch pulling the installation vessel 9 further towards the floating structure 11. The movement of the installation vessel 9 towards the floating structure result in a tensioning force of the second wire segment 7*b*, which again forces the temporary midwater pulley device 4 to move, thus increasing the tension in the first mooring chain part 3*a*. The first installation wire 7 is in one end attached to the mooring chain 3 and in the opposite end attached to the installation vessel 9 by the first winch 10 or the second winch 42 or first shark jaw 51 or second shark jaw 52 or any other fixed point on the installation vessel 9.

The second installation wire 14 could in this tensioning position be fixed between the floating structure 11 and the installation vessel 9 and the first winch 10 could be used to pull in the second wire segment 7*b*. The second installation wire 14 could in one end be connected to the fixed point 13 on the floating structure and on the other end attached to the first winch 10 or the second winch 42.

In FIG. 14*c* the tensioning may be performed by a fixed length of the second installation wire 14 between the installation vessel 9 and the floating structure 11. The second wire segment 7*b* is pulled in by the first winch 10 or the second winch 42 obtaining basically the same result as above.

FIGS. 14*d* and 14*e* show the same mooring tensioning step as FIGS. 14*a*-14*c*. Instead of the temporary midwater pulley device 4, there could be an integrated midwater pulley device 4' or a permanent midwater pulley 4". The integrated midwater pulley device 4' could be an integrated part of the mooring chain 3, dividing the mooring chain physically in the first and second mooring chain parts 3*a* and 3*b* as described earlier and shown in FIG. 14*d* or a permanent midwater pulley device 4" could be fixedly attached to the mooring chain in other ways as shown in FIG. 14*e*.

The sequence step of the second embodiment after the tensioning of the mooring chain 3 from FIG. 10 are illustrated in FIGS. 15-18.

Figure 15:
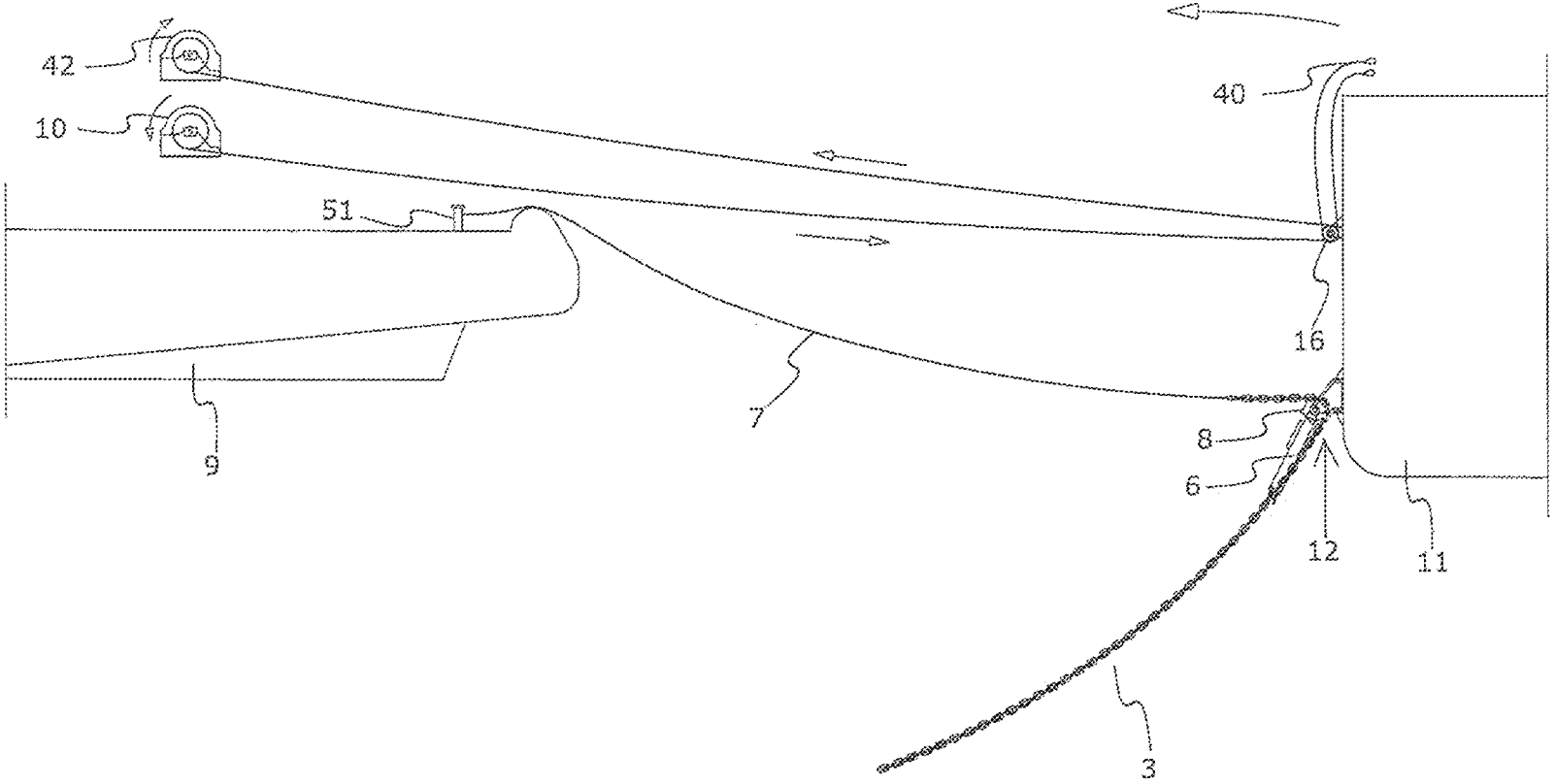
FIG. 15 shows a ninth step in the second embodiment shown in FIG. 2*a* of a method of tensioning according to the present invention, where a second installation wire is transferred between a second pulley arranged on the floating structure and the installation vessel.

FIG. 15 shows the transfer of the third wire segment 7*c* from the floating structure 11 to the installation vessel 9. The forerunner 40 is extending around the second wire pulley 16 arranged on the floating structure 11 and both ends of the forerunner 40 are transferred to the installation vessel 9. The third wire segment 7*c* is then connected to one end of the forerunner 40 and is pulled around the second wire pulley 16 by the second winch 42. One end of the second wire segment 7*b* is transferred from the first winch to the second shark jaw where it is held in a fixed position before connecting with the first wire segment 7*a*. The first wire segment 7*a* is held by the first shark jaw 51 or the second shark jaw 52 in a fixed position similar as in the embodiment described in FIG. 10 before the connection.

Figure 16A:
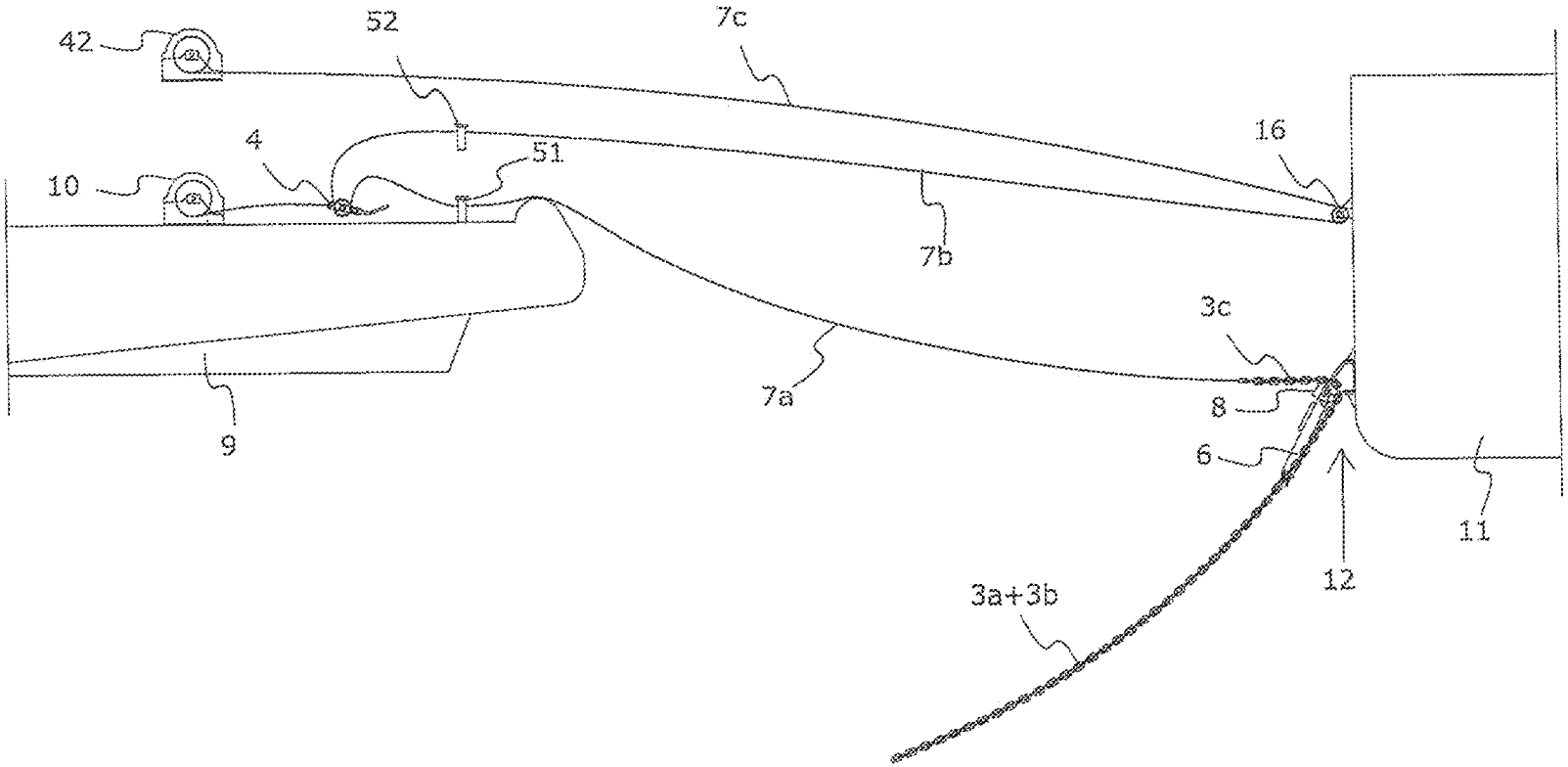
FIGS. 16*a-c* show a tenth step in the second embodiment shown in FIG. 2 of a method of tensioning according to the present invention, where the second installation wire is connected to the installation wire connected to the mooring chain and the temporary midwater pulley device is connected to the second installation wire.

The third wire segment 7*c* is then connected in one end to the first wire segment 7*a* that has in a previous step been connected to the mooring chain 3. This is shown in FIG. 16*a*.

In addition, the temporary midwater pulley device 4 is connected to the now connected first installation wire 7 in a similar way as disclosed in FIG. 12 by extending the first installation wire 7 around the midwater pulley 20.

Figure 16B:
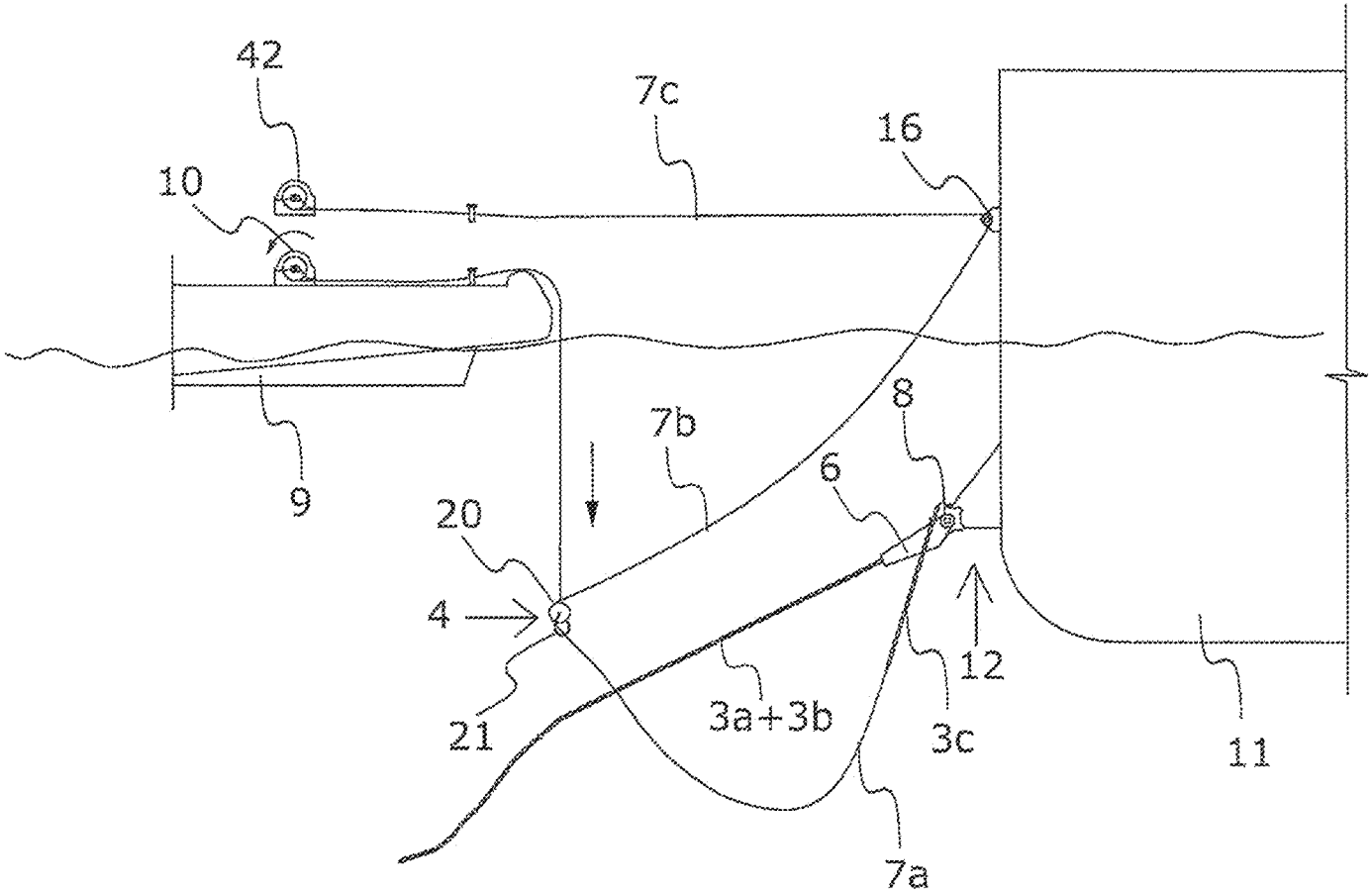
Figure 16C:
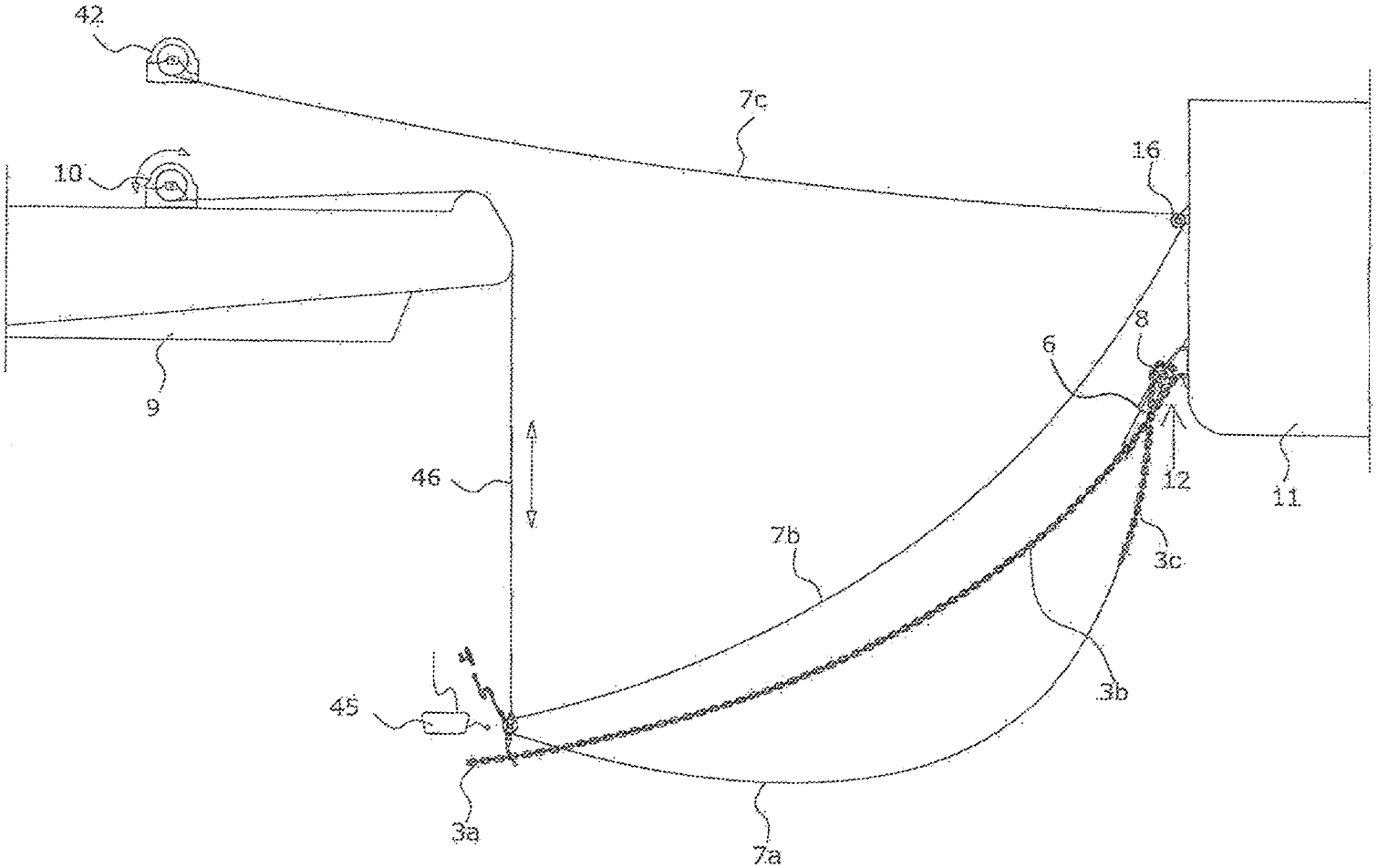

As shown in FIGS. 16*b*-16*c*, the temporary midwater pulley device 4 is then lowered down to the first mooring chain part 3*a* and the second mooring chain part 3*b* extending between the anchor 2 and the fairlead chain stopper arrangement 12. This may be done in a similar way as in the first embodiment shown in FIG. 13 by the additional crane or the first winch 10 on the installation vessel 9 and the midwater wire 46. The temporary midwater pulley device 4 is then engaging with the mooring chain 3. This can be done in a similar way as in the first embodiment by the ROV 45.

Figure 17:
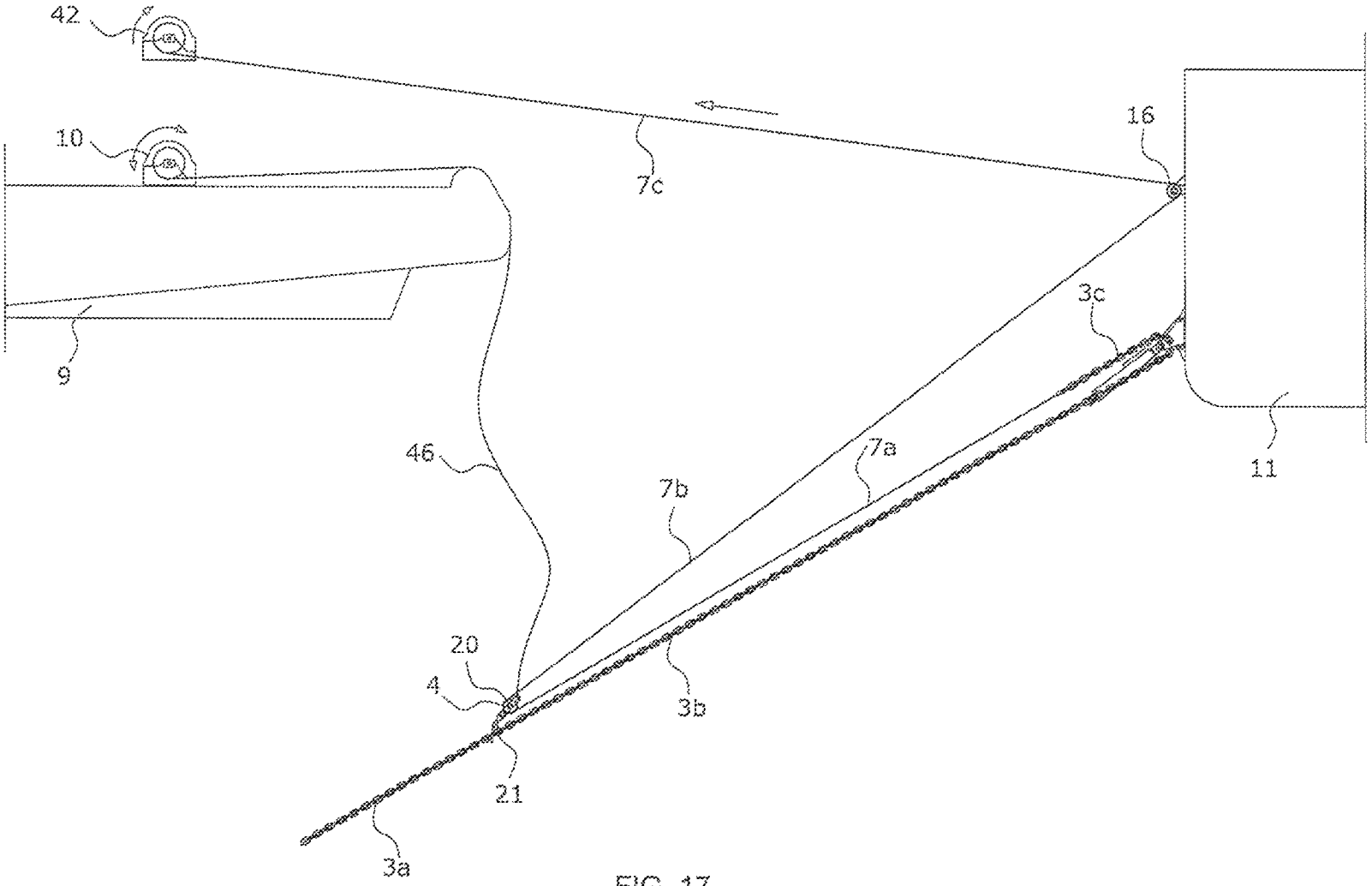
FIG. 17 shows an eleventh step in the second embodiment shown in FIG. 2 of a method of tensioning according to the present invention, where the temporary midwater pulley device is lowered into the sea and connected to the mooring chain.

FIG. 17 shows the attached temporary midwater pulley device 4 connected to the mooring chain 3.

In FIGS. 18*a*-*d* the tensioning of the mooring arrangement is performed. The installation vessel 9 is moved away from the floating structure 11 and at the same time pulling the first installation wire 7 and the mooring chain 3, increasing the tension in the mooring chain 3. Alternatively, the installation vessel 9 may stay in position, using its thrust or bollard pull to balance the force from the winch 42 pulling in, thus creating the same increase in tension of the mooring chain 3.

FIGS. 18*a*-*b* show the tensioning mooring arrangement with a temporary midwater pulley device 4 similar as described in FIG. 2*b* and in FIGS. 14*a*-14*c*. This embodiment of the tensioning mooring arrangement could also have integrated or permanent midwater pulley devices 4', 4" either integrated in the mooring chain 3 as shown in FIG. 18*c* (similar as described in FIG. 14*d*) or other ways attached to the mooring chain 3 as shown in FIG. 18*d*. (Similar as described in FIG. 14*e*).

The FIGS. 19-21 disclose the sequences after the tensioning sequences of the mooring chain is shown. The first installation wire 7 is removed from the midwater pulley device 4, 4', 4". In the second embodiment where the first installation wire 7 was extending around the second wire pulley 16 as well, the first installation wire 7 must also be released from the second wire pulley 16. The first installation wire 7 connected to the mooring chain 3 is pulled in by the first winch 10 or the second winch 42 on the installation vessel 9. It is only the third mooring chain part 3*c* that is not tensioned between the anchor 2 and the chain stopper 6 that is pulled in by the installation vessel 9.

FIG. 20 shows the sequence where the third mooring chain part 3*c* that is not tensioned in the mooring arrangement is moved onto the deck of the installation vessel 9 and held in a fixed position by the first shark jaw 51 or the second shark jaw 52. In this sequence the superfluous mooring chain 3 is cut off.

A smaller part of the third mooring chain part 3*c* will be left hanging from the fairlead chain stopper arrangement 12 as shown in FIG. 21.

A part of the first installation wire 7 could also possibly be connected to the short piece of the third mooring chain part 3*c* so that it is easier to access the third mooring chain part 3*c* in the next tensioning mooring process. This is also shown in FIG. 21.

Figure 22:
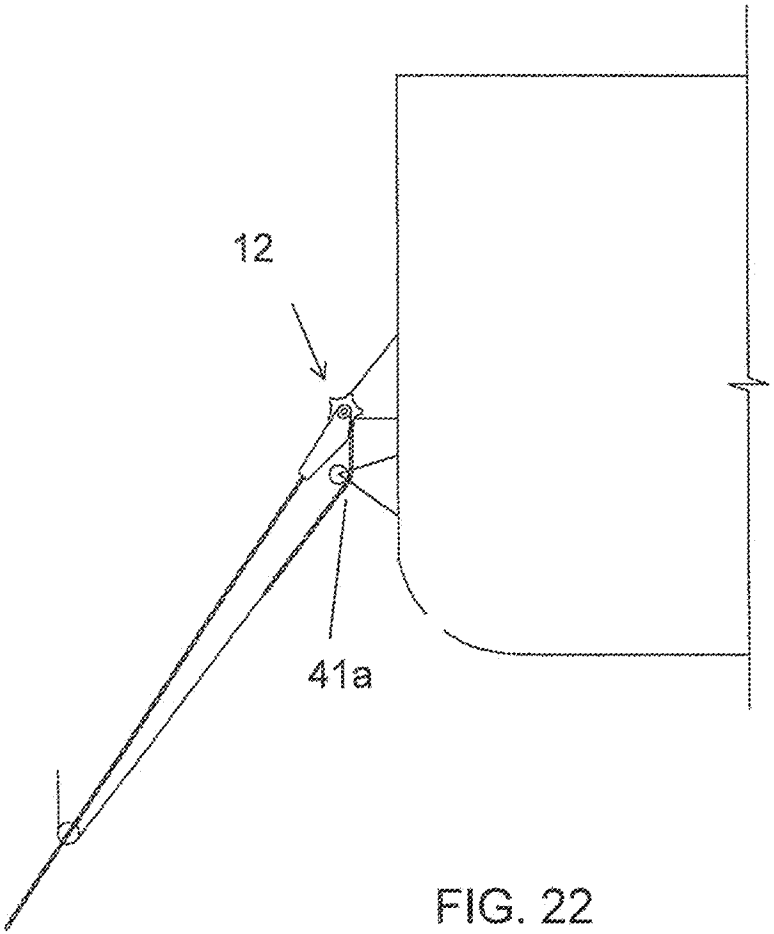
FIG. 22 shows a further alternative fairlead construction configuration of the mooring tensioning arrangement.

FIG. 22 shows an alternative configuration of the mooring tensioning arrangement, where the mooring chain has been fed above the fairlead chain stopper arrangement 12 and down to a first auxiliary sheave 41*a* below the fairlead chain stopper arrangement 12.

Figure 23:
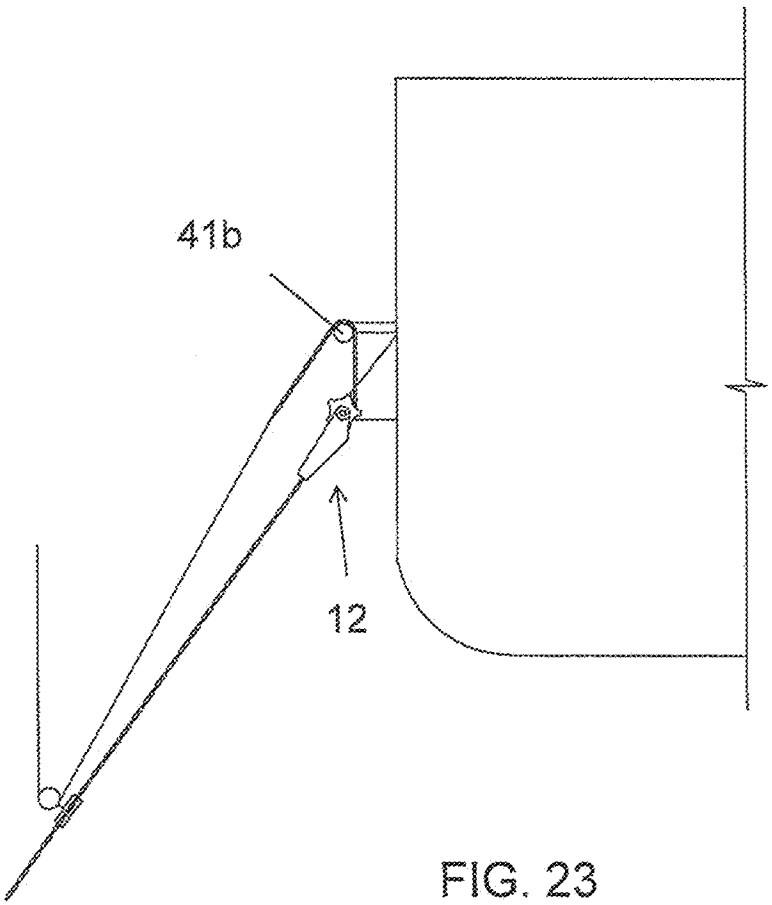
FIG. 23 shows a still further alternative configuration of the fairlead construction of the mooring tensioning arrangement.

FIG. 23 shows a further alternative arrangement where the mooring chain has been fed through the fairlead chain stopper arrangement 12 in the same direction as in FIG. 2*b*, but up to a second auxiliary sheave 41*b* arranged above the fairlead chain stopper arrangement 12 and further to the midwater pulley device 4, 4', 4".

Figure 24:
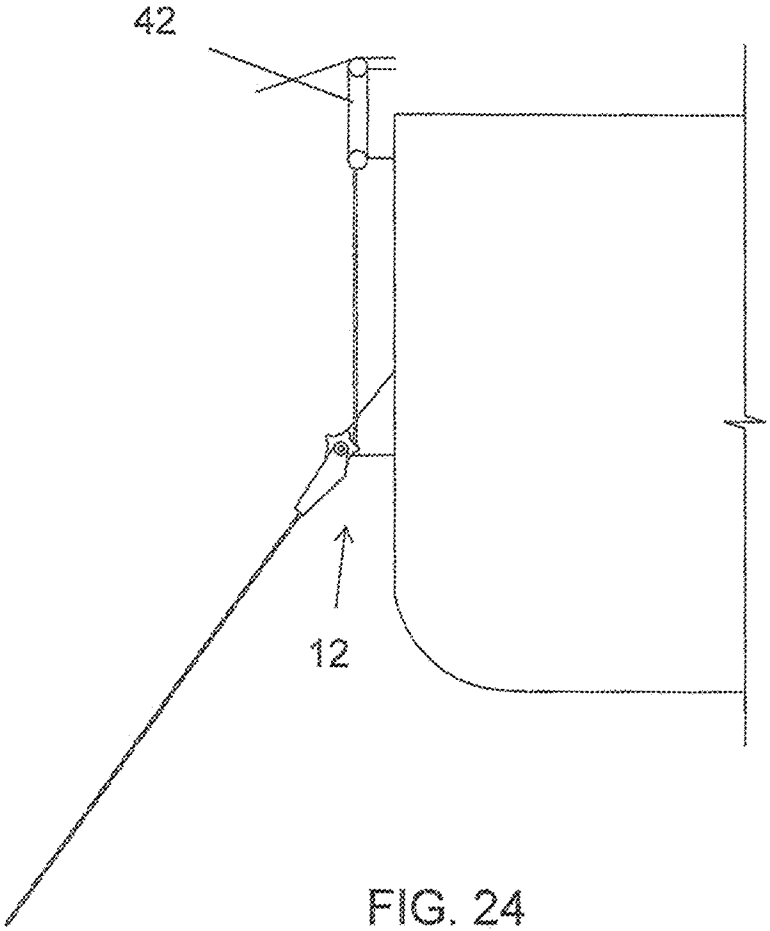
FIG. 24 shows a yet further alternative configuration of the fairlead construction of the mooring tensioning arrangement.

FIG. 24 shows yet a further alternative arrangement where a tackle arrangement 42 is coupled between the fairlead chain stopper arrangement 12 and a fixed point on the floating structure 11 above the fairlead chain stopper arrangement 12.

Figure 25:
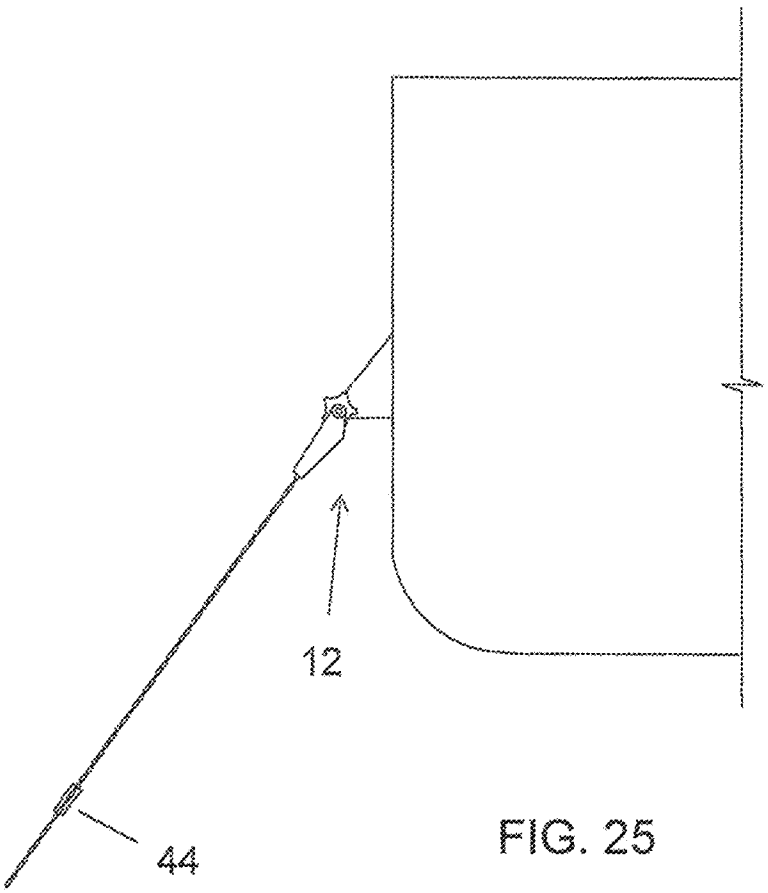
FIG. 25 shows another further alternative configuration of the mooring chain of the mooring tensioning arrangement, which is especially adapted for drilling platforms.

FIG. 25 shows the installed mooring chain with an emergency release mechanism 44 on the mooring chain 3 between the fairlead chain stopper arrangement 12 and the anchor (not shown). This is convenient if the floating structure 11 must be quickly removed from the site in an emergency situation.

Figure 26:
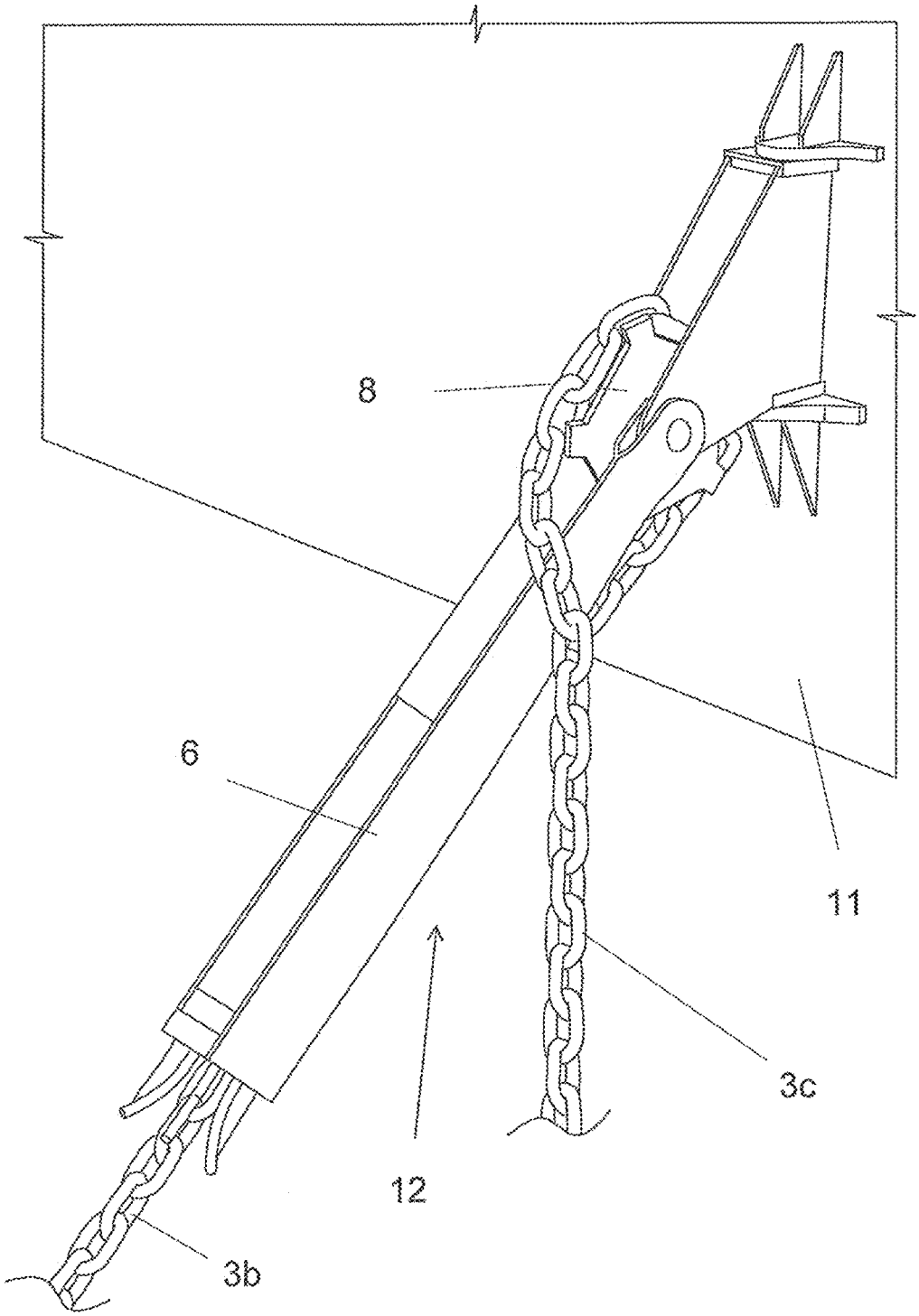
FIG. 26 shows a possible arrangement of the loose end of the mooring chain after installation.

FIG. 26 shows a possible arrangement of a loose end of the third mooring chain part 3*c* after installation. The figure shows that the mooring chain 3 has simply been cut or otherwise disconnected from the first installation wire 7 and hangs freely downwards. Alternatively, the third mooring chain part 3*c* may be fixed to the structure somewhere in the vicinity of the fairlead chain stopper arrangement 12.

Figure 27:
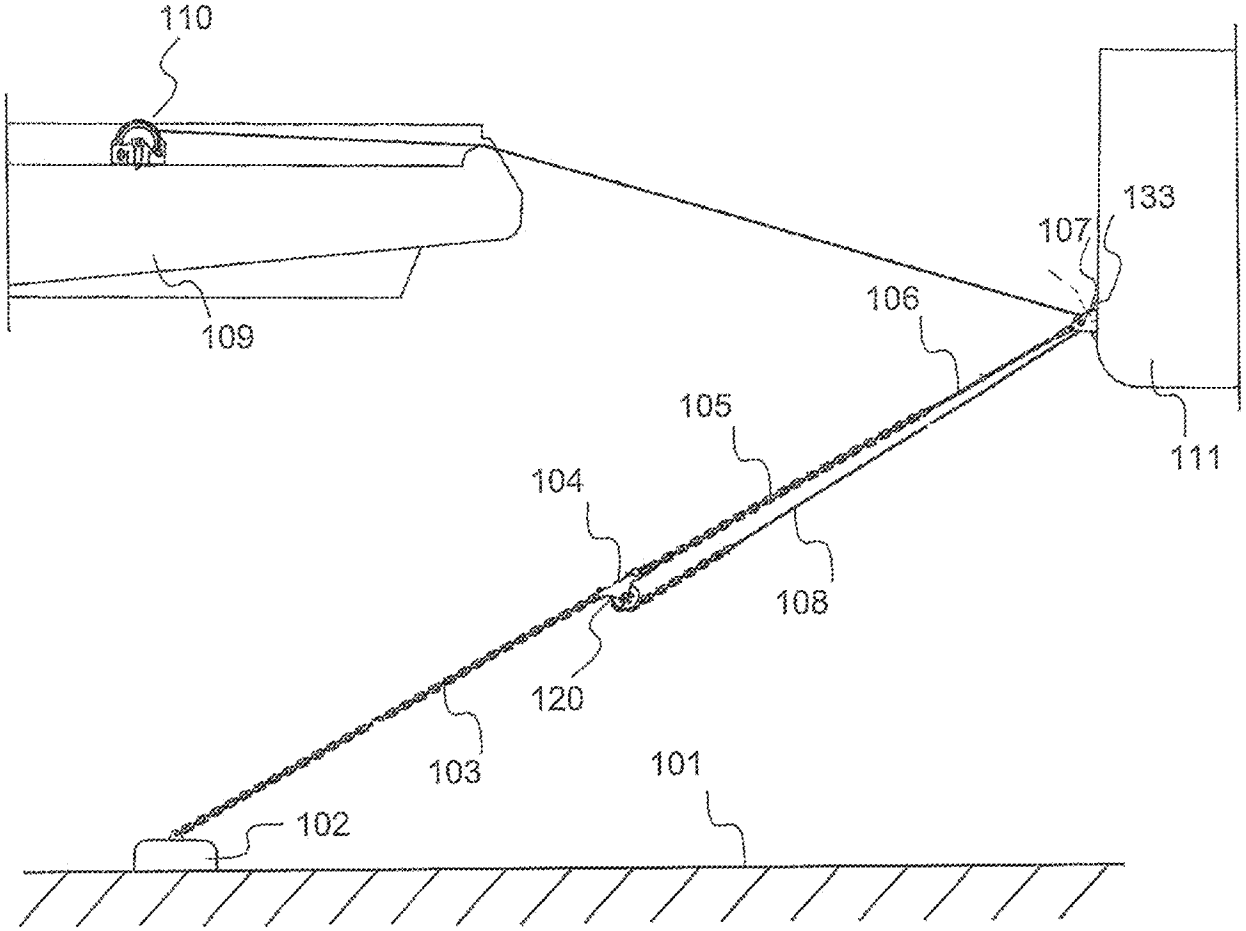
FIG. 27 shows a mooring tensioning arrangement of the invention according to a third embodiment, where the tensioning is performed by an installation vessel or a winch on the installation vessel.

FIG. 27 shows a mooring arrangement of the present invention installed between an anchor 102 that has been attached to the seabed 101 and a floating structure 111, such as an FPSO. How the installation has been achieved will be explained in detail later.

The anchor 102 is conveniently a suction anchor, but may alternatively be any type of anchor known in the field.

The mooring arrangement further comprises a mooring chain 3, a chain tensioner 4 with pulley 100, a working chain 5, a pendant line 6, a hull bracket 33, a fairlead 7 and a pull-in wire 8.

The mooring chain 103 may also be a steel wire, polyester rope or a combination of these and the working chain 105. Pendant 106 may also be a mooring chain, steel wire, polyester rope or a combination of these. The working chain 105 may also extend all the way to the fairlead 107. The pull-in wire 108 may be steel wire, polyester rope or a combination. It may comprise several segments of these.

Conveniently, the fairlead 107 is attached to the hull bracket 133 and the fairlead 107 may rotate about a vertical axis.

As seen in FIG. 1, the mooring chain extends between the anchor 2 and the chain tensioner 4. The pendant wire 6 is attached to the fairlead 7 at an upper end. The lower end of the pendant wire 6 is attached to the working chain 5. The working chain 5 extends around the pulley 100 of the chain tensioner 4 and is at the opposite end of the pendant wire 6 attached to the pull-in wire 8.

The pull-in wire 8 extends around a pulley 100 in the fairlead 7 and further to a winch 10 on a support or installation vessel 9.

Figure 28:
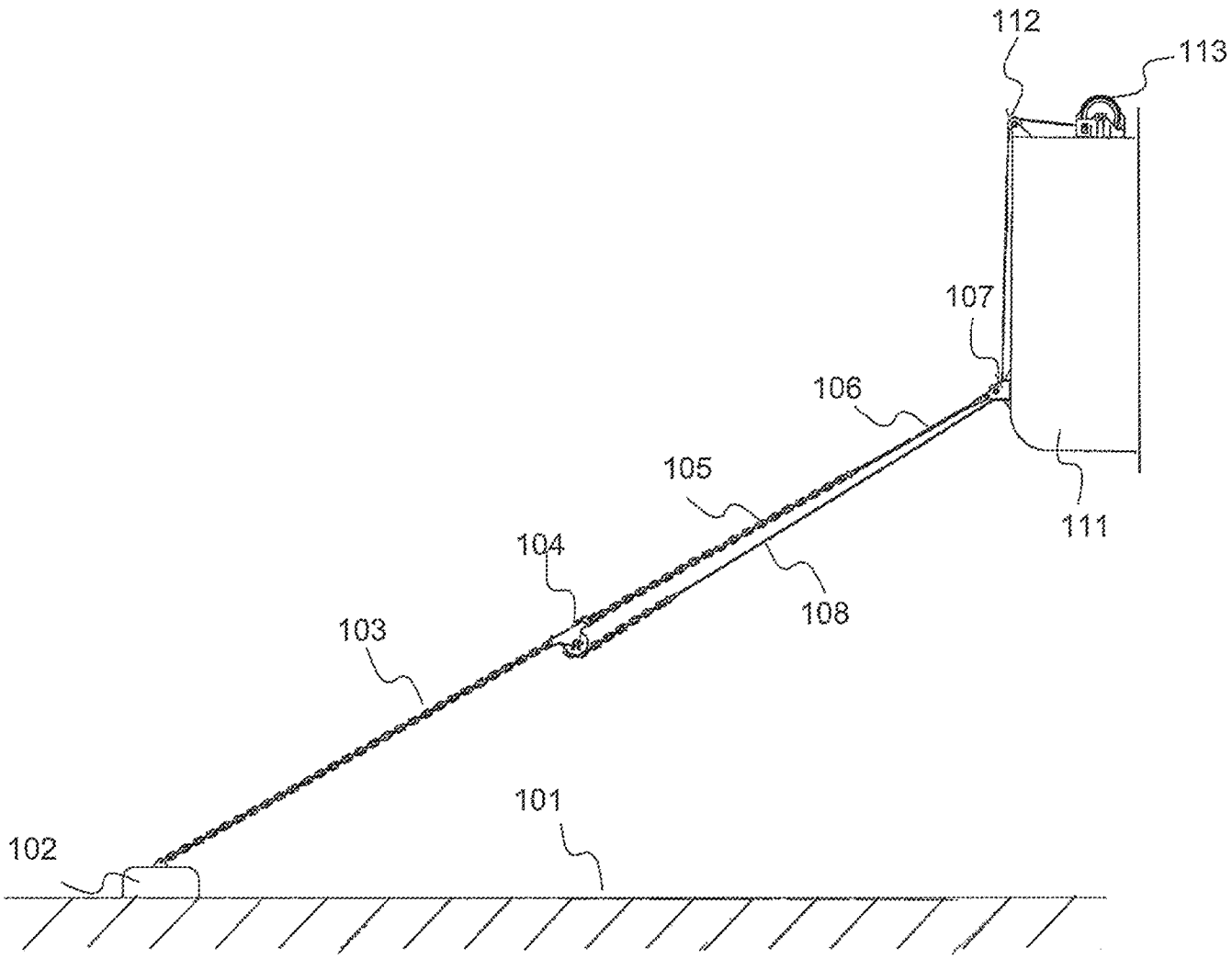
FIG. 28 shows a mooring tensioning arrangement of the invention according to the third embodiment with tensioning performed by a winch arranged on the floating structure.

FIG. 28 shows an alternative mooring arrangement. It is similar to the arrangement of FIG. 27 except that the pull-in wire 108 extends to a winch 113 on the floating structure 111 instead of to a winch on an installation vessel. A pulley 112 mounted at the edge of the deck of the floating structure 111 ensures proper guiding of the pull-in wire 108. Alternatively, the winch 113 may be located on the edge of the deck with the pull-in wire 108 extending directly downwards. In this case the pull-in wire 108 is not required, as shown and explained in connection with FIG. 50.

The arrangements of FIGS. 27 and 28 may be used as alternatives, but they may also be used in stages, where the first part of the tensioning is done with the arrangement of FIG. 27 and the pull-in wire 108 is then transferred to the winch 113 on the floating structure 111 so that the final tensioning is done with the arrangement of FIG. 28. This is especially convenient when the final tensioning has to be done after all the moorings have been installed.

Figure 29:
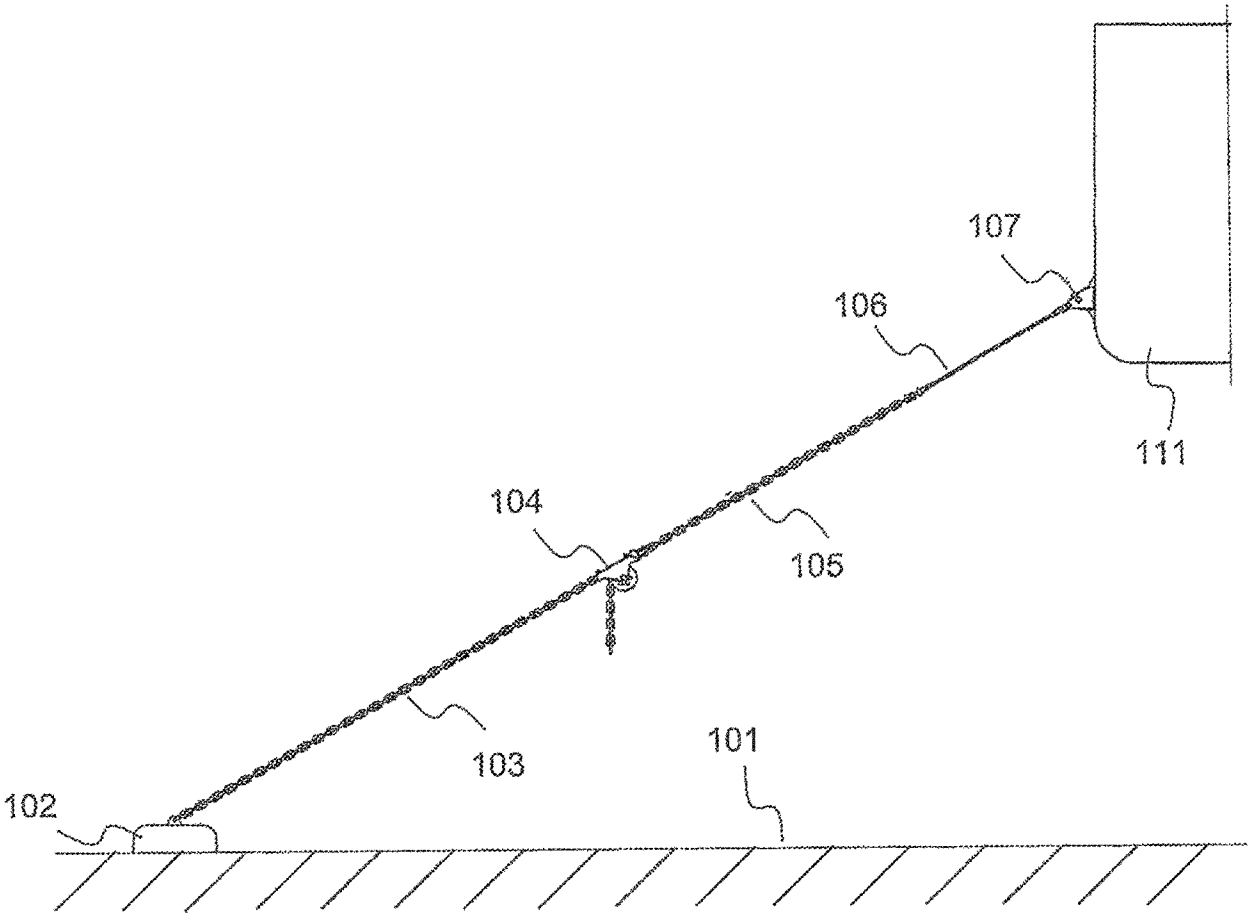
FIG. 29 shows a mooring arrangement that has been tensioned according to the invention after the tensioning has been completed in a first configuration.

FIG. 29 shows the mooring arrangement after the tensioning has been completed. The pull-in wire 108 will then typically be removed and FIG. 29 shows that the pull-in wire 108 has been detached from the working chain 105 and removed.

Figure 30:
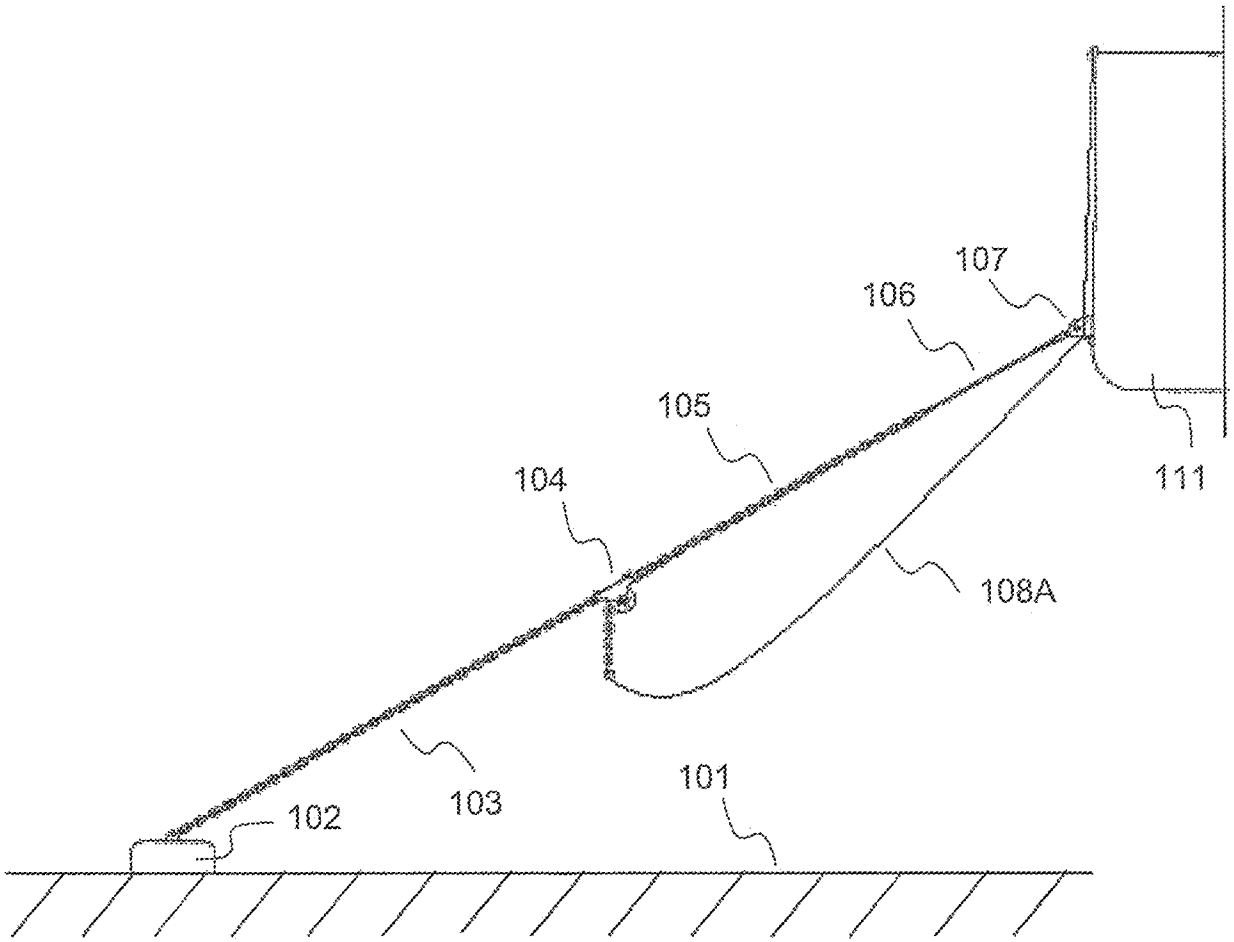
FIG. 30 shows a mooring arrangement that has been tensioned according to the invention after the tensioning has completed in a second configuration.

FIG. 30 shows an alternative to removing the pull-in wire 108. Here a forerunner 108*a* of the pull-in wire 108 has been left as a non-tensioned length.

Figure 31A:
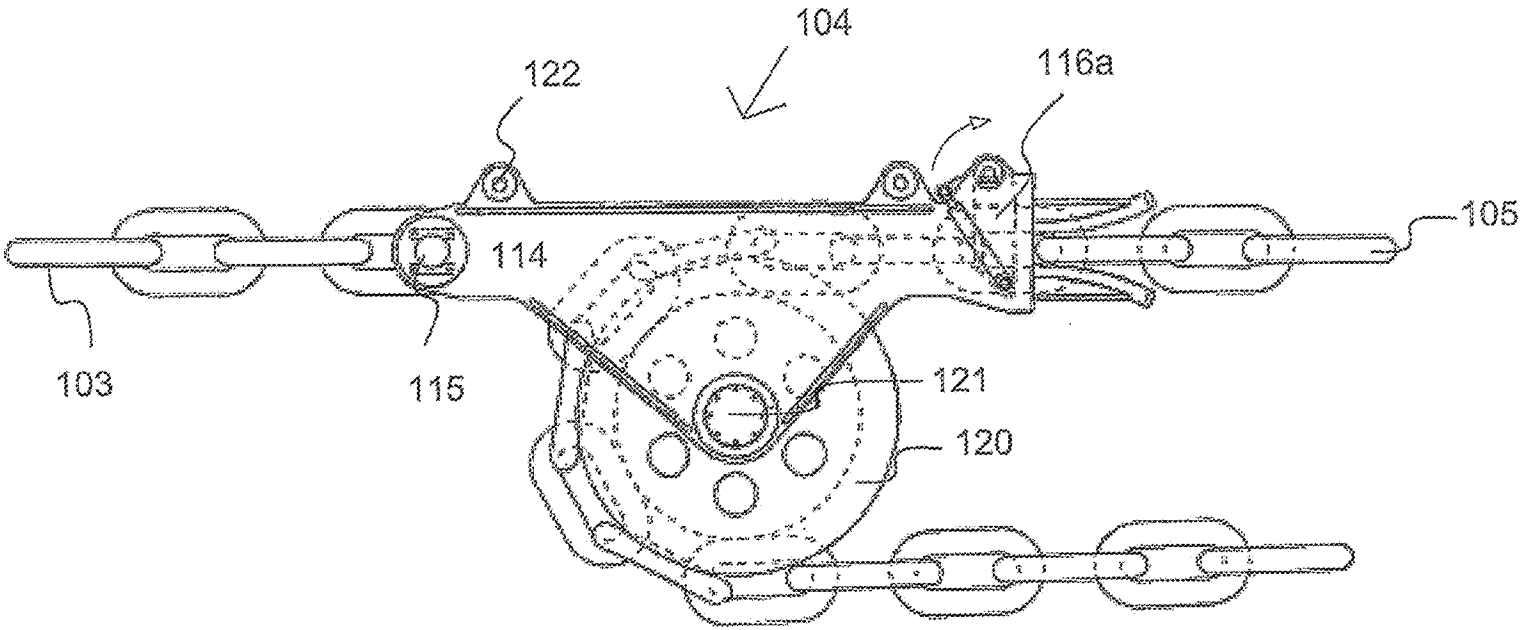
FIGS. 31*a-b* show a mooring tensioner to be used in the present invention with a chain passing through, FIGS. 32*a-b* show a mooring tensioner to be used in the present invention with a wire or rope passing through, FIGS. 33*a-b* show a fairlead of the present invention in a first embodiment.

FIGS. 31*a* and *b* show the chain tensioner 104 in detail. Although it acts as the main component during the tensioning of the mooring, it also includes a chain stopper 116, which has the function locking the two mooring line parts together to maintain a specific length.

The chain tensioner 104 comprises a steel structure 114 that is solid enough to act as a member of the mooring line and as such can withstand at least the same Minimum Breaking Load (MBL) as the mooring chain 103. The steel structure 114 has a channel 114*a* through which the working chain 105 can pass. At one end the steel structure 114 is connected to the mooring chain 103 with a connecting bolt 115. Any kind of connecting links, shackles or other connecting elements may be used.

At the other end where the working chain 105 enters the channel 114*a* of the steel structure 114 there is a chain stopper 116. The chain stopper 116 is shown with a single latch 116*a* but may consist of two latches, as is known per se. The single latch 116*a* is connected to a spring 119 that biases the single latch 116*a* towards a closed position, to ensure safe closing of the single latch 116*a*. Additionally, there may be a temporarily installed hydraulic cylinder 118, which is capable of opening the single latch 116*a* if the chain has to be paid out.

The hydraulic cylinder 118 may be operated from the installation vessel 109 or an ROV (not shown). After the tensioning is finished, the hydraulic cylinder 118 is preferably removed to avoid fouling and corrosion due to prolonged exposure to sea water.

At the upper end, i.e. towards the floating structure 111 there is a guide 117 to guide the working chain 105 into the channel 114*a*.

The chain tensioner 4 also has a chain tensioner pulley 100 that is rotatable about a shaft 21 that is mounted in the structure 14. The purpose of the chain tensioner pulley 100 is to guide the working chain 5 out of the chain tensioner 4 and back towards the fairlead 7.

Figure 31B:
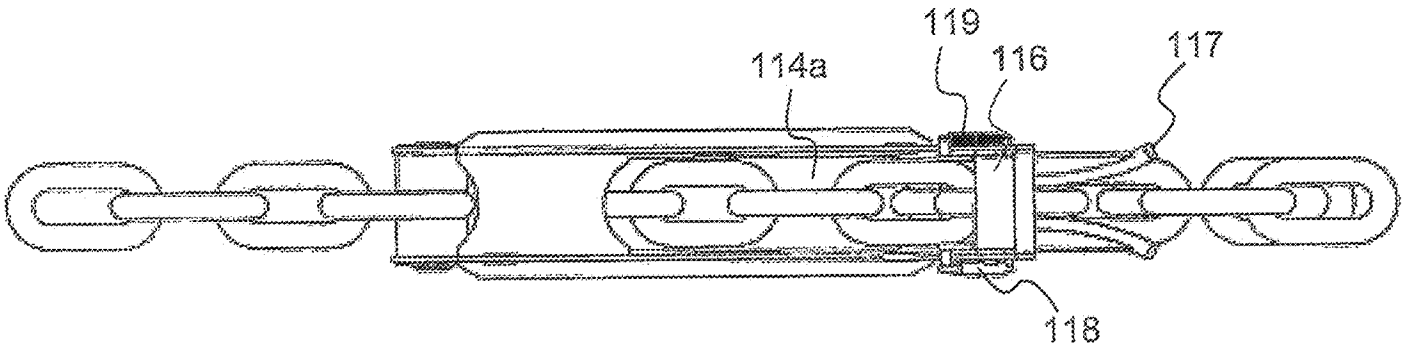
Figure 32A:
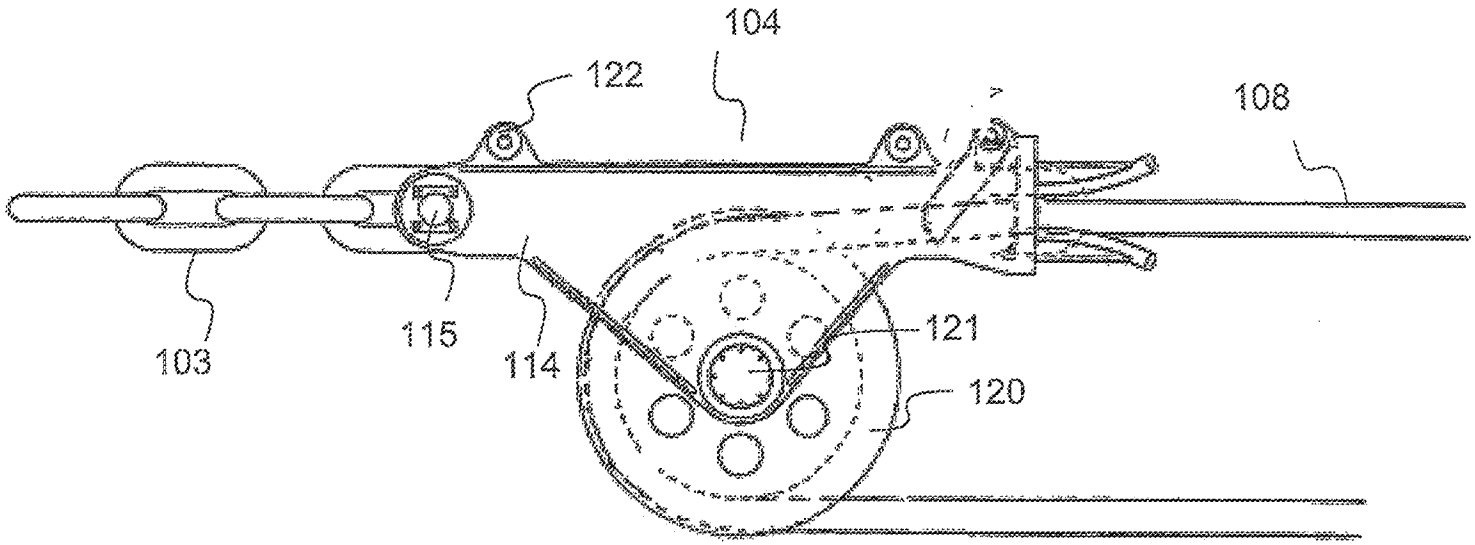

In FIGS. 32*a* and *b* the same chain tensioner 104 is shown as in FIG. 31 but with the pull-in wire 108 running through the channel 114*a*, as will be the case during the installation phase. The single latch 116*a* is open at this stage.

Figure 33A:
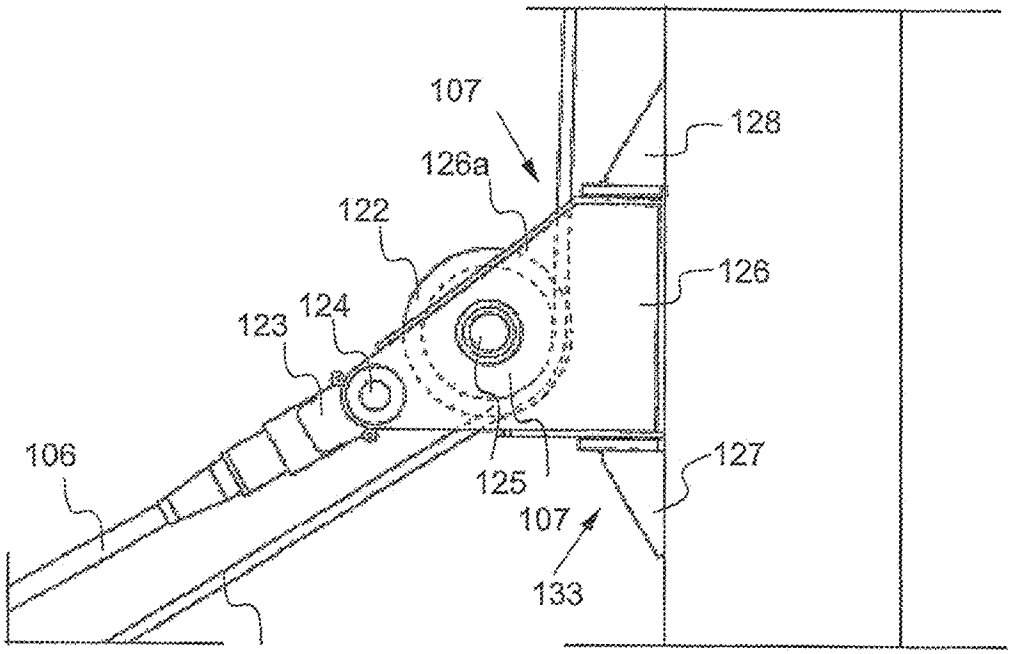

FIGS. 33*a* and *b* show the hull bracket 133 and the fairlead 107. The fairlead that comprises a steel structure 126 and a fairlead pulley 122. The hull bracket 133 comprises a lower hull support 127 and an upper hull support 128. A vertical shaft 129 connects the steel structure with the lower hull 127, upper hull support 128, so that the steel structure 126 can rotate about a vertical axis.

At the outer end of the steel structure 126 the pendant 106 is attached by means of a bolt 124 that attaches an end termination 123 of the pendant wire to the steel structure 126. The end termination 123 can rotate about the bolt 124 in a vertical plane.

The fairlead pulley 122 is rotatable supported in the steel structure 126 by a shaft 125. The steel structure 126 has a channel 126*a* that receives the pull-in wire 108, which extends about the fairlead pulley 122.

The hull bracket 133, the steel structure 126 and a bolt 124 and the vertical shaft 129 are all part of the mooring load line and have to be strong enough to carry the mooring load.

Figure 33B:
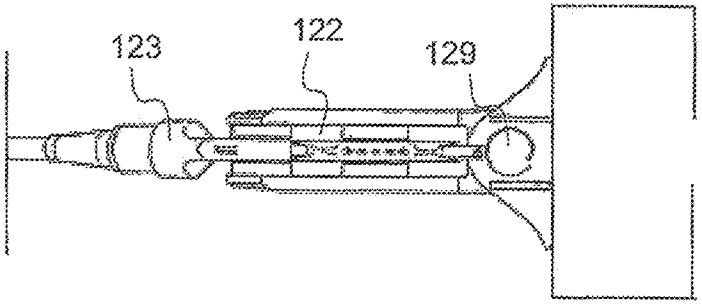
Figure 34A:
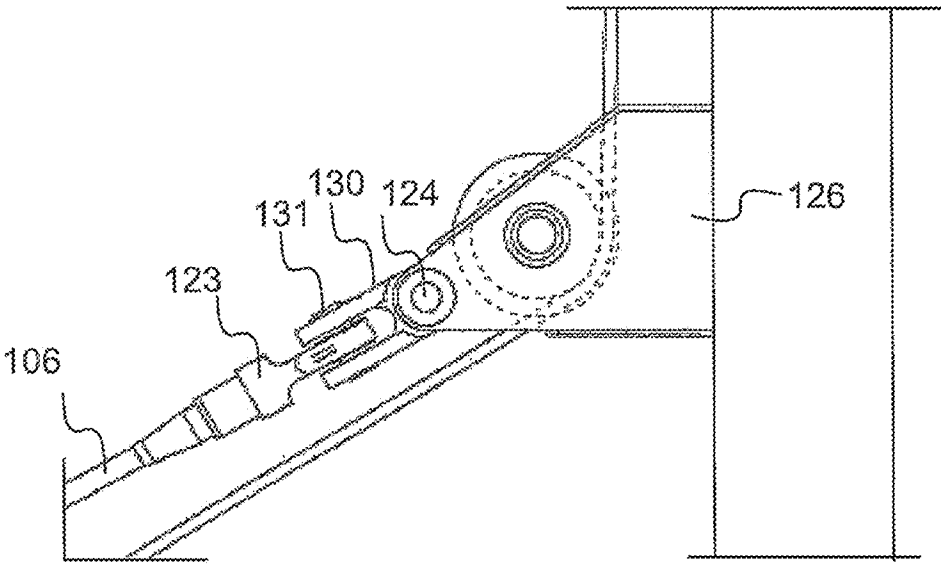
FIGS. 34*a-b* show a fairlead of the present invention in a second embodiment.
Figure 34B:
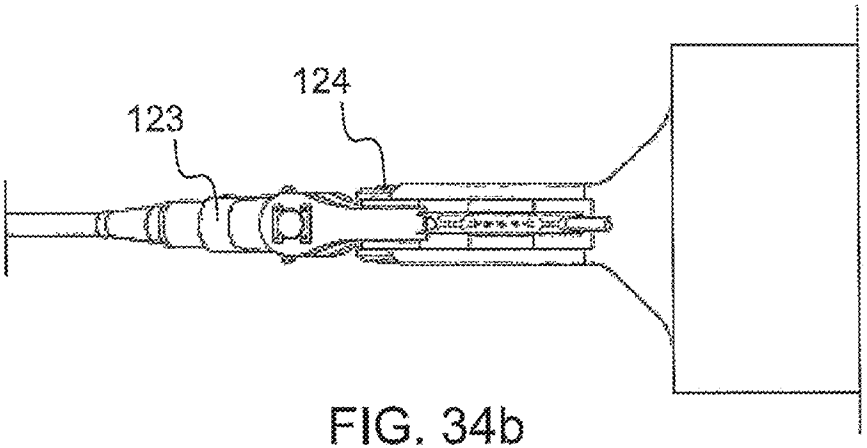

An alternative fairlead construction can be seen in FIGS. 34*a* and *b*. Here the steel structure 126 is welded to the hull and is not capable of rotating in a horizontal plane as in FIG. 33. Instead, a connecting link 130 with a vertical shaft 131 has been added between the end termination 123 and the bolt 124, to endure free movement in two planes for the pendant 106.

Figure 35A:
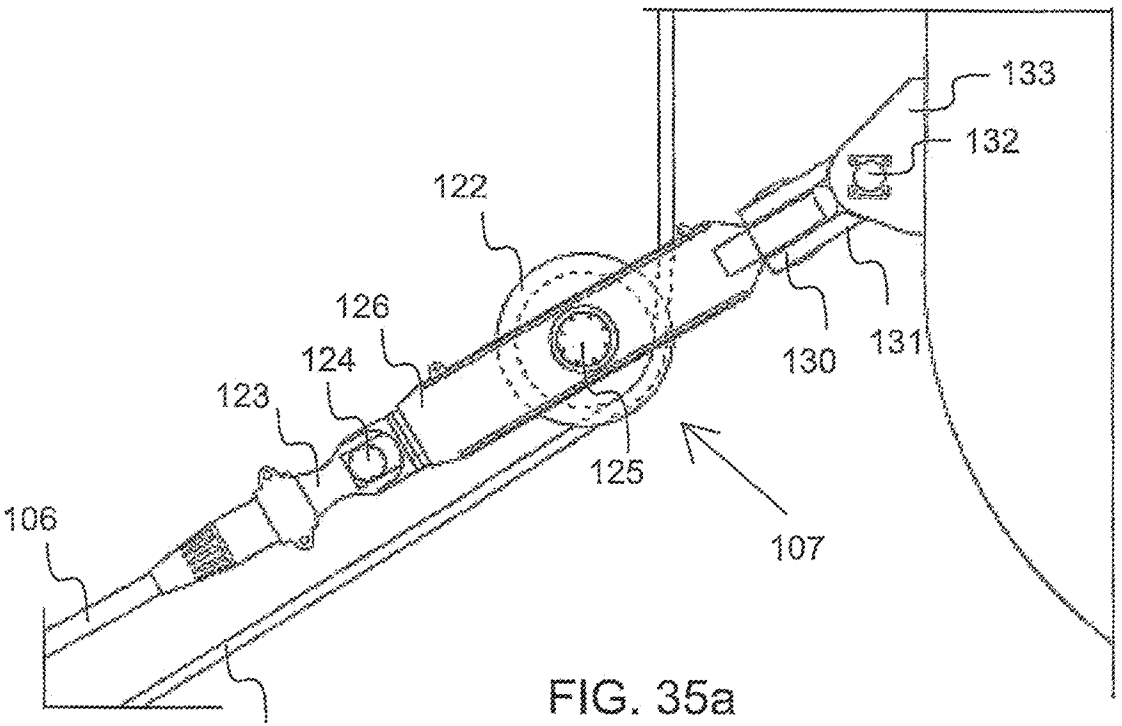
FIGS. 35*a-b* show a fairlead of the present invention in a third embodiment.
Figure 35B:
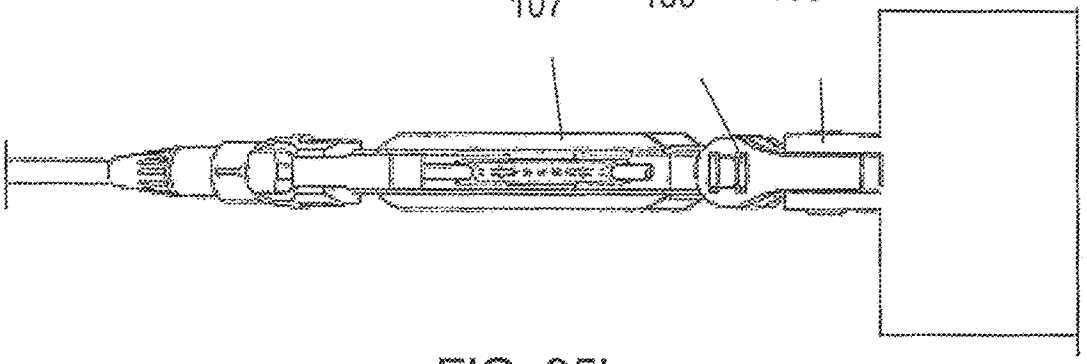

A further another alternative solution for the fairlead construction is shown in FIGS. 35*a* and *b*. As for the previous embodiments the pendant 106 with end termination 123 is connected to the steel structure 126 via a bolt 124. However, the steel structure 126 is connected to the hull via a hull bracket 133 and a connecting link 130. Two shafts 131, 132 ensures freedom of movement in two planes.

Figure 36B:
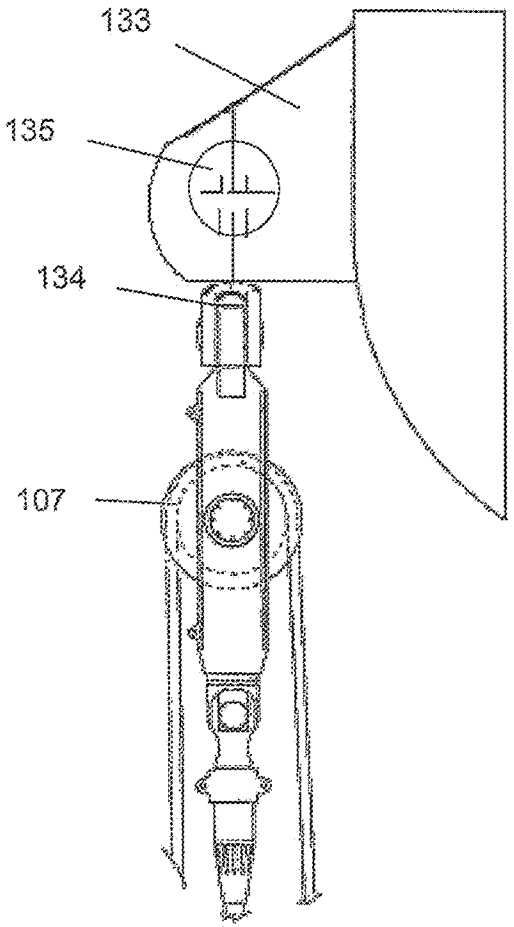
FIGS. 36*a-b* show a fairlead of the present invention in a fourth embodiment.
Figure 36A:
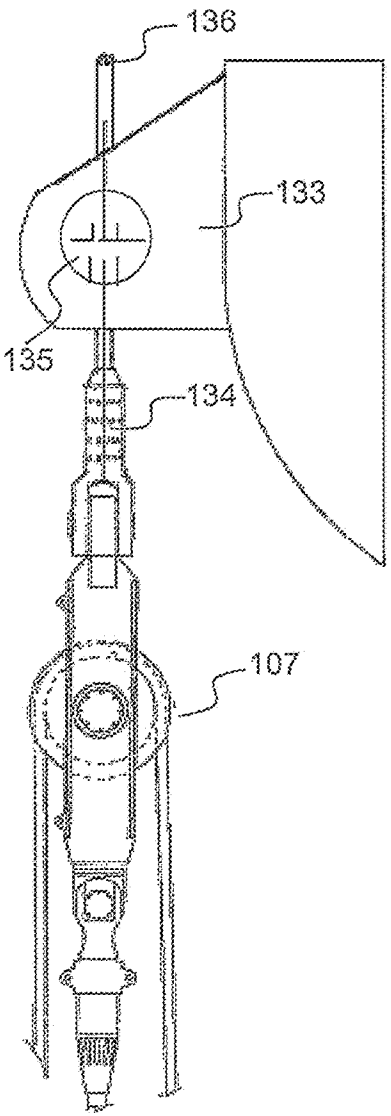

In the alternative embodiment of FIGS. 36*a* and *b*, the connecting link 130 and shaft 132 has been replaced by a connector comprising a male part 134 and a female part 135, the female part 135 being capable of retaining the male part 134 within a hole (not shown) in the female part 135. The female part 135 is rotatable about a horizontal axis with respect to the hull bracket 133.

A rope or wire 136 is initially connected at the end of the male part 134. The rope or wire 136 is fed through the hole in the female part, and by pulling the rope or wire 136, the male part 134 can be brought to enter the hole of the female part 135.

The male part 134 and female part 135 will engage typically with the intervention of ROV, a diver or by other mechanic means, depending on the environment.

The pendant 106 may in some cases be replaced by extending the working chain 105.

In some cases, the pendant 106 or working chain 105 may be fixed directly to the hull of the floating structure 111 by a bolt through a bracket. In such a case the fairlead pulley 122 may be arranged separately of the attachment of the pendant 106 or working chain to the hull.

The arrangement of the present invention has the benefit that the feeding of the pull-in line 8 over the pulleys 100 and 22 ensures both that the mooring line 3 and working chain 5 are in the same line and extends directly between the anchor 2 and the floating structure 11, and due to the fact that the system has the configuration of a block and tackle, the tensioning of the mooring arrangement can be done with double tension force by the winch 10 or 13 as compared to the prior art configurations.

In the case where the pull-in wire 108 is connected to the winch 110 on the installation vessel the tensioning can be done both by rotating the winch and by moving the installation vessel 109 relative to the floating structure 111. This will provide the possibility of achieving a much higher tension force than the winch can achieve alone. Instead of using the winch 110 as the point of attachment of the pull-in wire 108 on the installation vessel 109, the pull-in wire 108 can also be attached to the installation vessel 109 itself. This way an installation vessel 109 without a powerful winch can also be used to tension the mooring.

An installation sequence according to the third embodiment of the invention will now be described, referring to FIGS. 37*a*-43.

During the installation, a number of additional ropes, wires and winches than described above are typically used. These items will be described below.

Figure 37B:
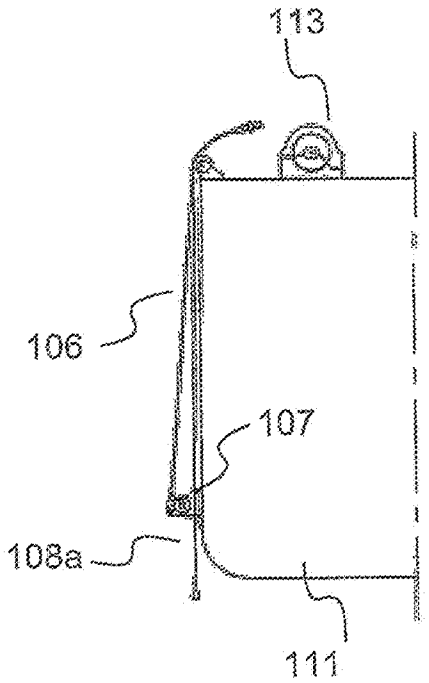
FIGS. 37*a-b* show a first step in the third embodiment of a method of tensioning according to the present invention.
Figure 37A:
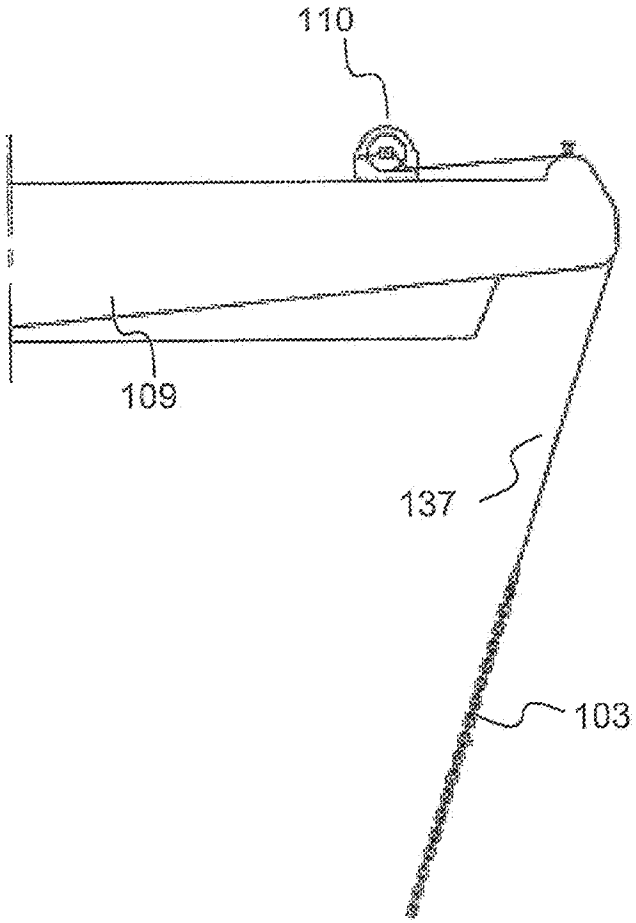

FIGS. 37*a* and *b* show the floating structure 111 at the start of the installation of the mooring arrangement. The pendant 106 is connected to the fairlead 107, a forerunner 108*a* of the pull-in wire 108 has been passed through the fairlead pulley 122. The installation vessel 109 or specialized anchoring vessel 102 has installed the anchor at the seabed. Typically, the mooring chain 103 has been left on the seabed attached to a wire 137 with a buoy (not shown) at the free end.

In FIGS. 37*a* and *b* the buoy and wire 137 have been picked up and the winch 110 of the installation vessel 109 is pulling in the mooring chain 103.

Figure 38B:
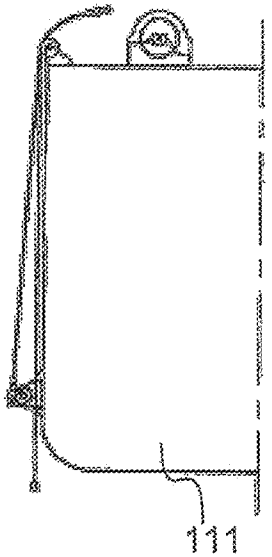
FIGS. 38*a-b* show a second step in the third embodiment of a method of tensioning according to the present invention, where a mooring tensioner has been attached to the mooring chain.
Figure 38A:
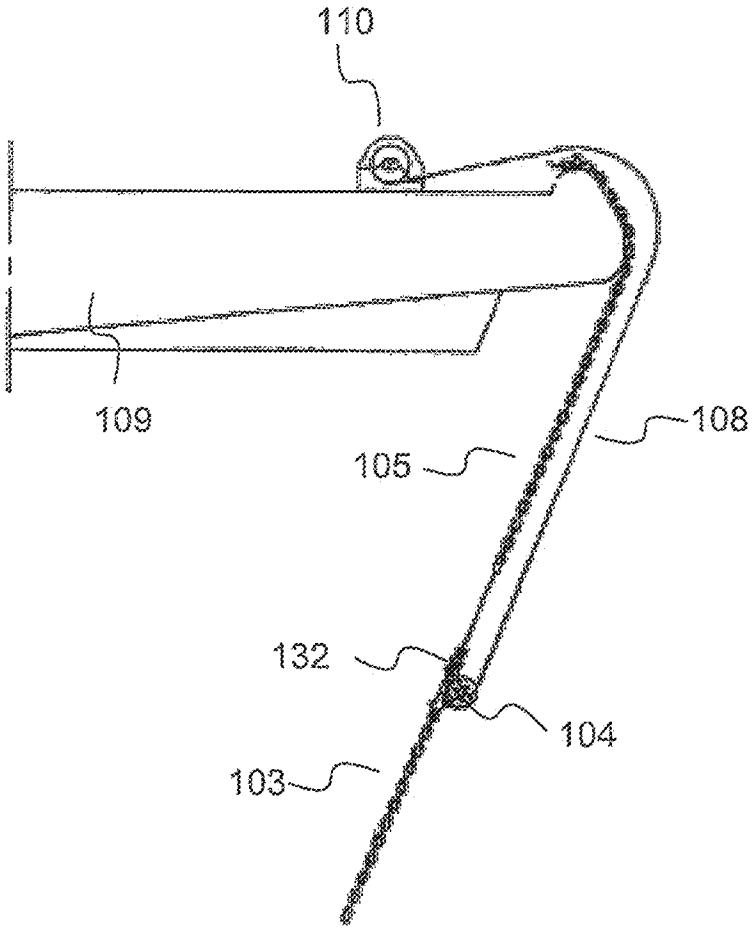

In FIGS. 38*a* and *b*, the chain tensioner 104 has been attached to the mooring line and the pull-in wire 108 has been fed through the chain tensioner 104. The pull-in wire 108 has the working chain 105 attached to the training end. The free end of both the pull-in wire 108 and the working chain 105 are on board the installation vessel 109, with the free end of the pull-in wire connected to the winch 110, and the free end of the working chain 105 is fixed to the installation vessel 109, typically in shark jaws (similar as shown in FIG. 4, 6, 7, 10).

The winch 110 on the installation vessel 109 now pays out and lowers the chain tensioner 104 to reduce the tension in the mooring chain 103. This operation conveniently takes place at a safe distance from the floating structure 111.

Figure 39:
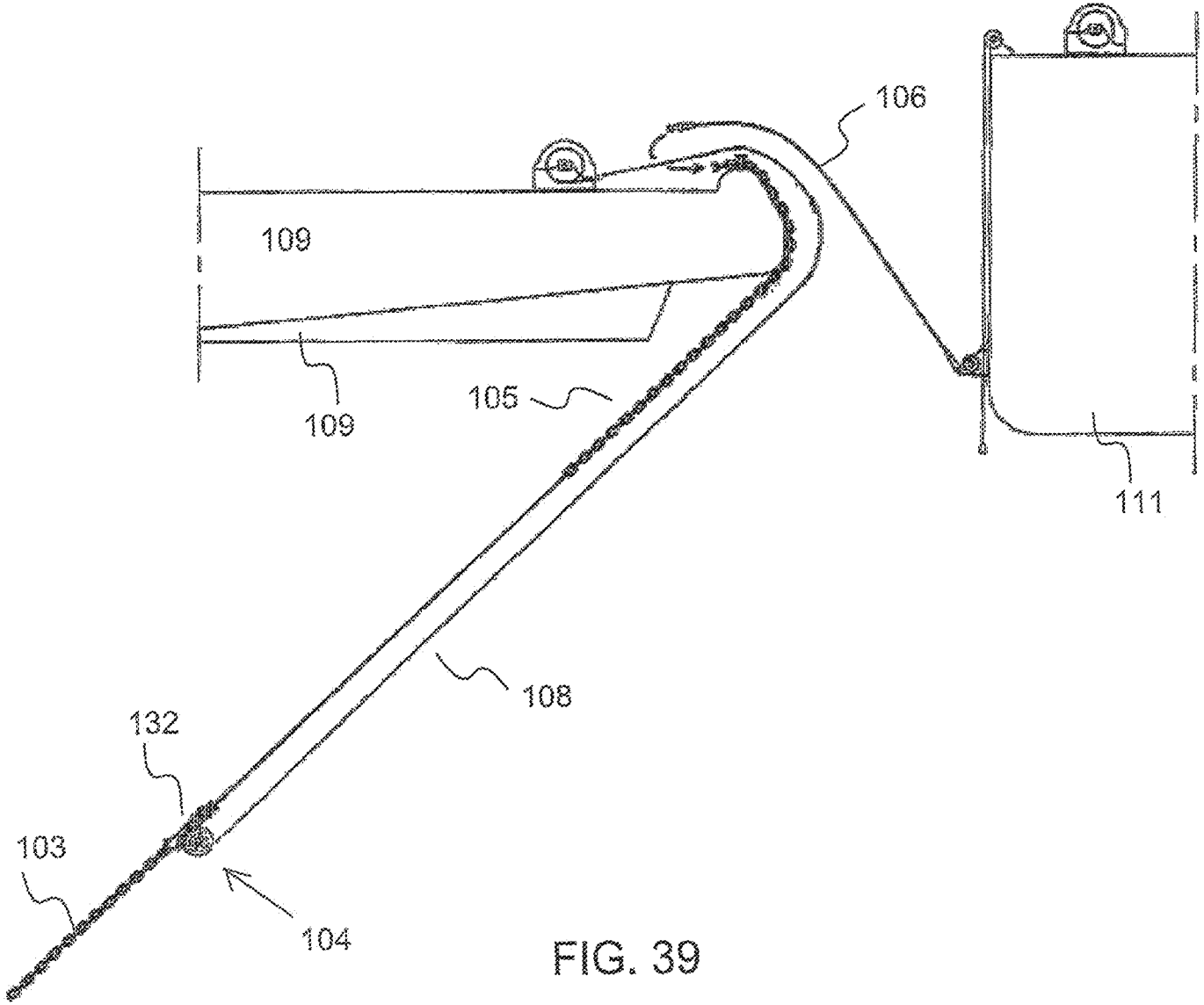
FIG. 39 shows a third step in the third embodiment of a method of tensioning according to the present invention, where a pendant is about to be coupled to a working chain.

In FIG. 39, the installation vessel 109 has moved closer to the floating structure 111. When close enough the free end pendant 106, which has been kept on board the FPSO, is transferred to the deck of the installation vessel 109. This free end is connected to the working chain 105.

Figure 40:
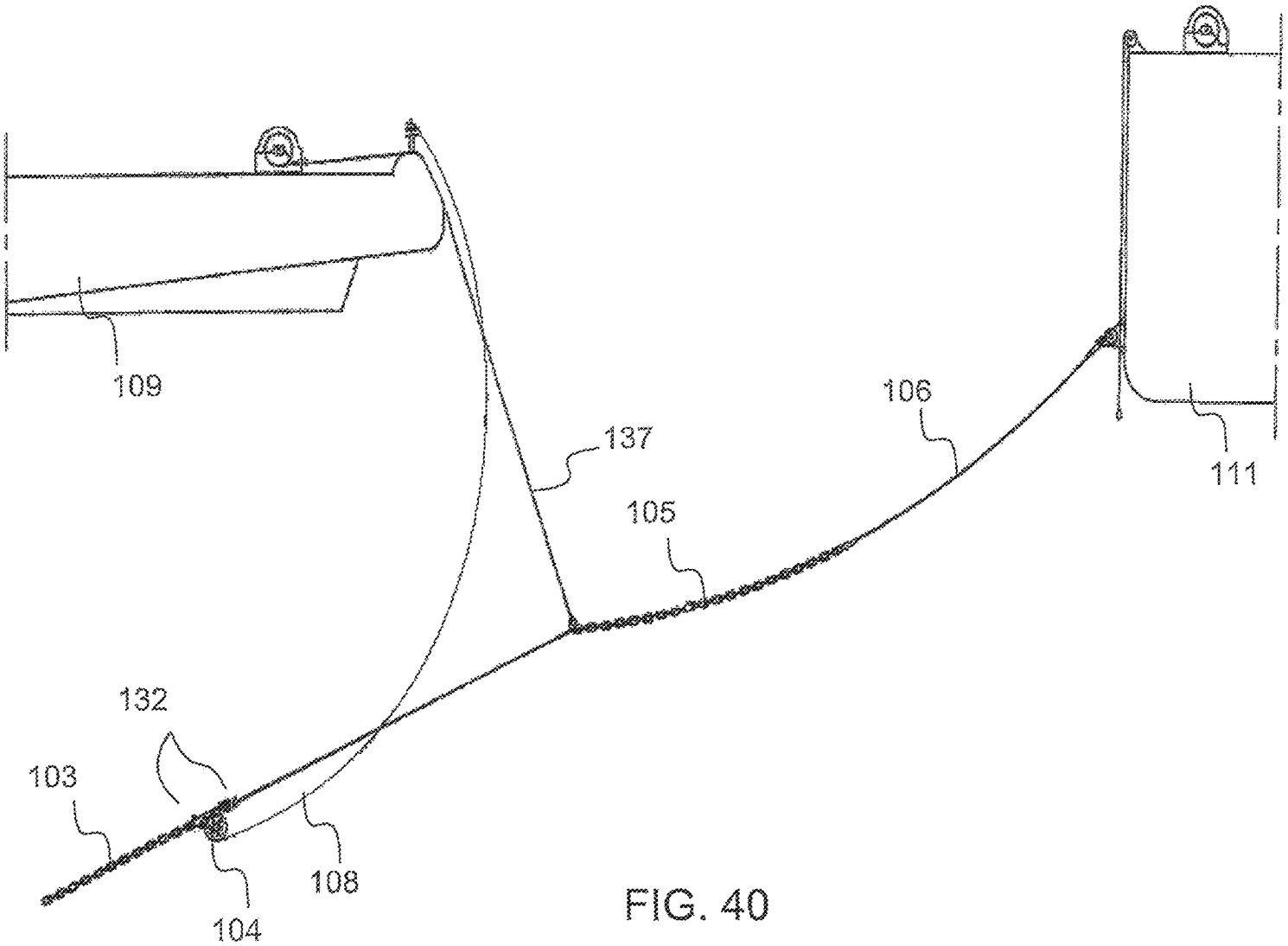
FIG. 40 shows a fourth step in the third embodiment of a method of tensioning according to the present invention, where the working chain and pull-in wire has been deployed into the sea.

In FIG. 40, the pendant 106 and the working chain 105 is lowered from the installation vessel 109 using a wire 137 that is connected to the winch 110 at one end and at the connection point between the working chain and the pull-in wire 108 at the other end. The upper end of the pull-in wire 108 has now temporarily been attached to the installation vessel 109. During the lowering of the connection point between the working chain 105 and the pull-in wire 108, the installation vessel 109 moves away from the floating structure 111.

Figure 41:
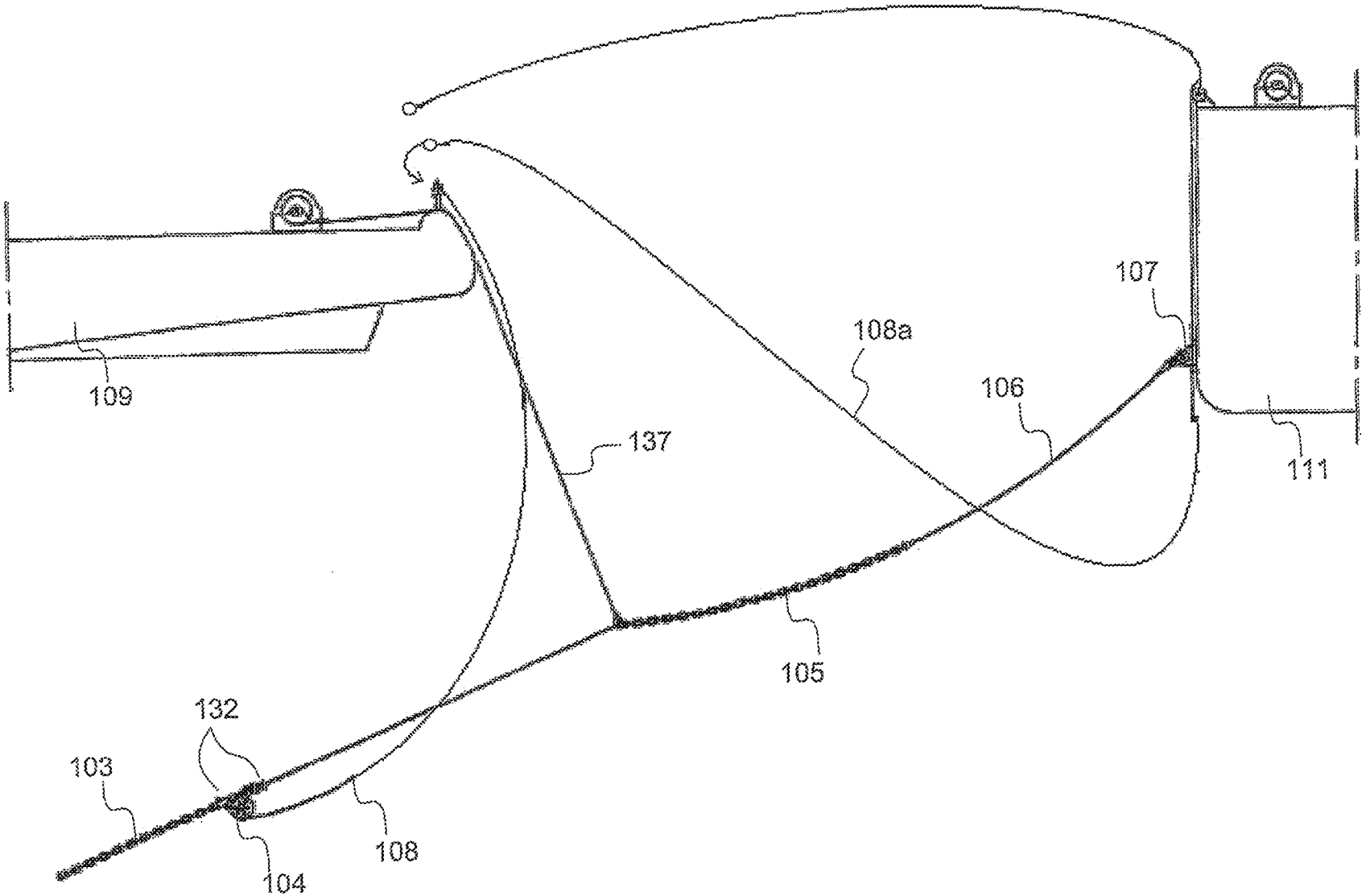
FIG. 41 shows a fifth step in the third embodiment of a method of tensioning according to the present invention, where a pull-in wire is about to be coupled to a winch on board the installation vessel.
Figure 42:
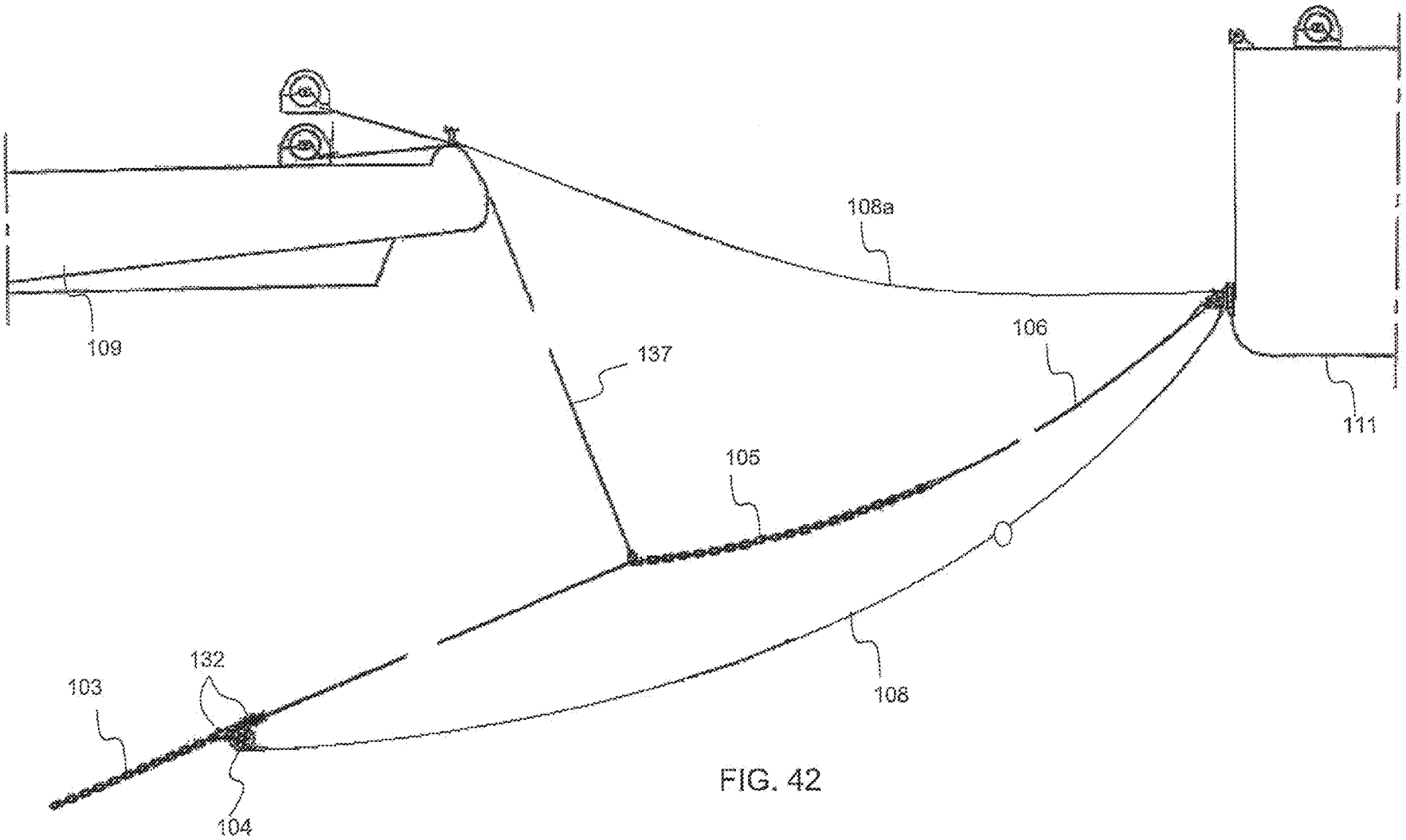
FIG. 42 shows a sixth step in the third embodiment of a method of tensioning according to the present invention, where the pull-in wire has been coupled to the winch on board the installation vessel.

As shown in FIG. 41, both ends of the forerunner 108*a* are transferred from the floating structure 111 to the installation vessel 109. The lower end of the forerunner 108*a*, i.e. the end that had been fed downwards through the fairlead 107, is connected with the upper end of the pull-in wire 108, that extends upwards from the chain tensioner 104. The other end of the forerunner, i.e. that extends upwards from the fairlead 107, is connected to the winch 110. FIG. 42 shows the pull-in wire 108 and the forerunner 108*a* connected.

Figure 43:
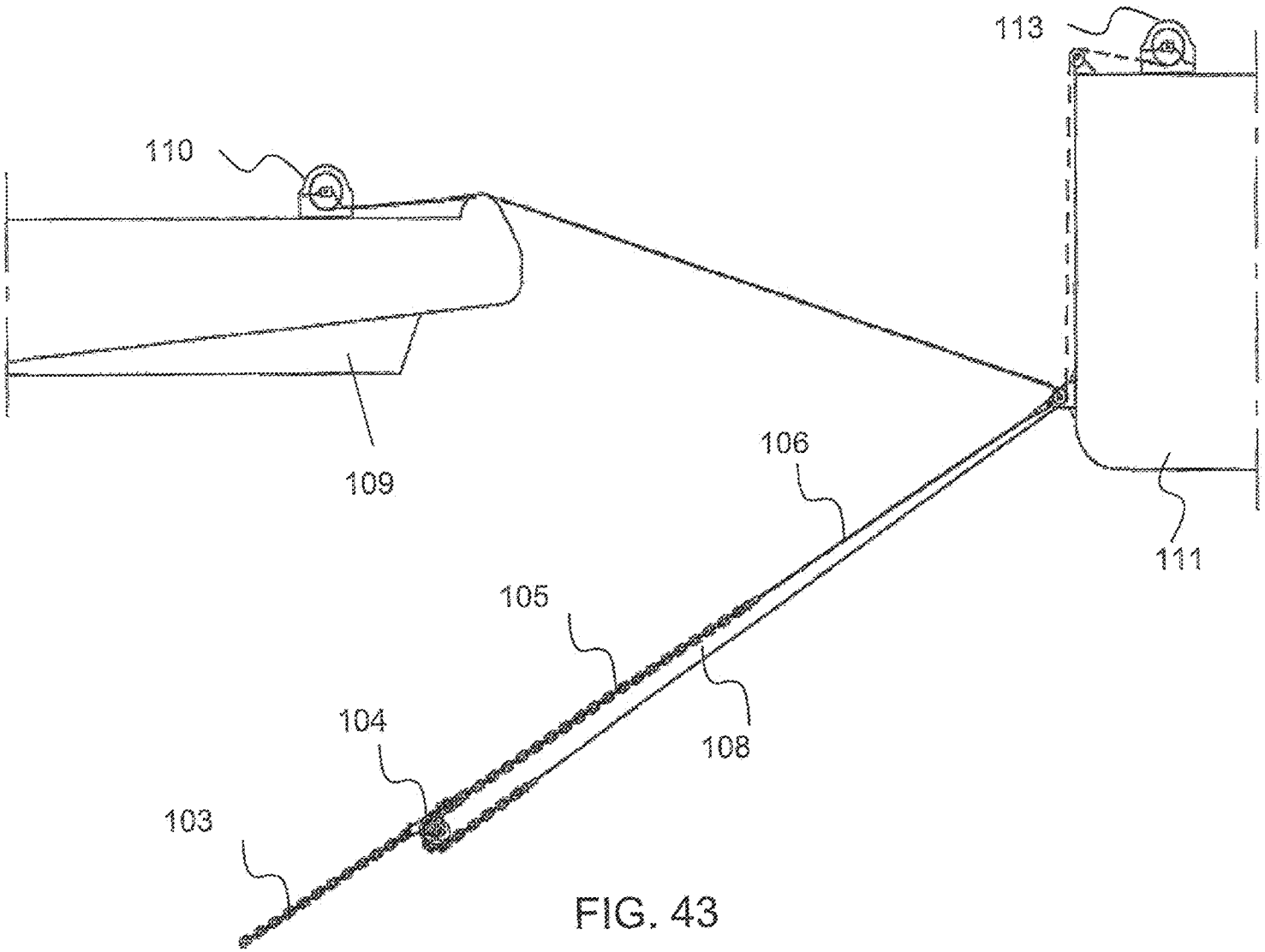
FIG. 43 shows a seventh step in third embodiment of a method of tensioning according to the present invention, where the pull-in wire is tensioned and thereby tensioning the mooring.

As shown in FIG. 43, the wire 137 has been detached, and the forerunner 108*a* has been wound in so that the pull-in wire 108 has reached the winch 110. The connection between the working chain 105 and the pull-in wire 108 has passed through the chain tensioner 104. Tensioning is now in progress by the winch 110 on the installation vessel 109 or alternatively by the winch 113 on the floating structure 111.

As stated above, after final tensioning has been completed, the pull-in wire 108 is usually removed, as shown in FIG. 29. The winch 113 on the floating structure 111 may also be removed. Alternatively, a short part of the pull-in wire 108 may be left for further work on the mooring line, as shown in FIG. 30.

An alternative installation method according to the third embodiment of the present invention will now be explained, referring to FIGS. 44*a*-49.

The main difference between this installation method and the one described above is that in the following all the tensioning of the mooring chain 103 is performed from the floating structure 111.

Figure 44B:
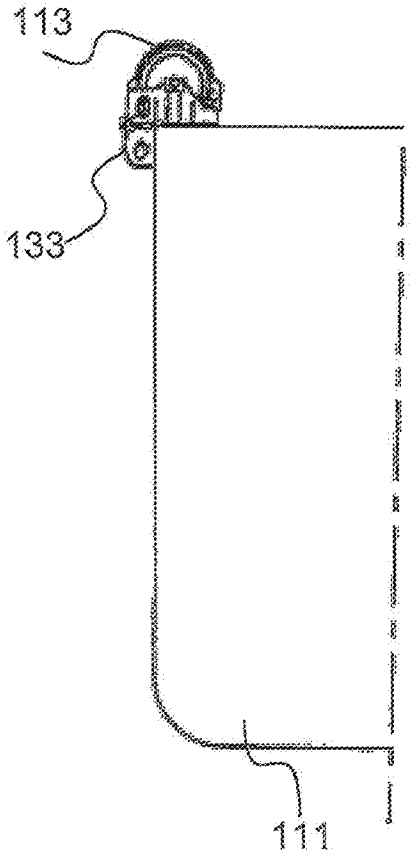
FIGS. 44*a-b* show a first step in a second configuration of the third embodiment of the method of tensioning according to the present invention.
Figure 44A:
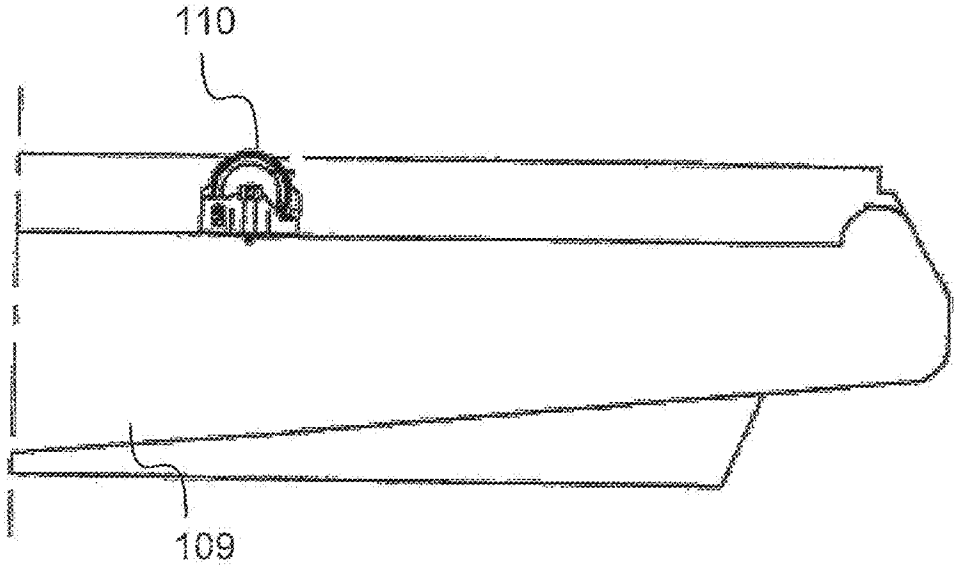

FIGS. 44*a*-*b* show the floating structure 111 with the winch 113, a hull bracket 133, which in this case is mounted close to the deck of the FPSO, for the work chain 105 or pendant 106 and the installation vessel 109 with the winch 110. This is the initial state of the installation operation.

Figure 45:
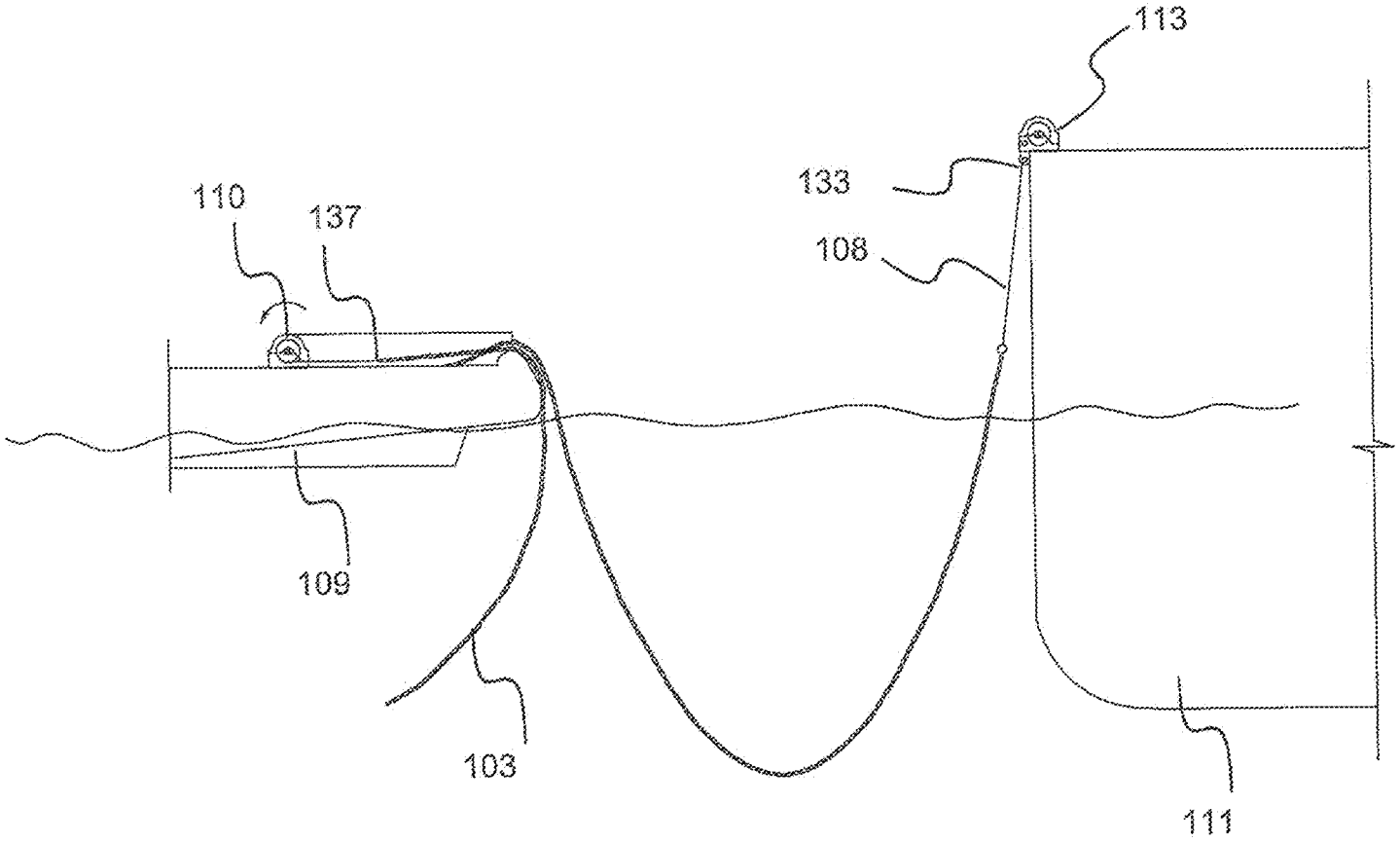
FIG. 45 shows a second step in the second configuration of the third embodiment of the method of tensioning according to the present invention, where a mooring chain has been brought up to the installation vessel and a working chain has been coupled to the floating installation.

In FIG. 45, the mooring chain 103 has been pulled up from the seabed and locked on the deck of the installation vessel 109. The installation of the anchor and retrieval of the mooring chain 103 is done in the same way as explained above with regard to FIG. 37. The free end of the pull-in wire 108 has been transferred to the installation vessel 109 and connected to the work chain 105 and is being pulled over towards the floating structure 111 using the winch 113.

Figure 46:
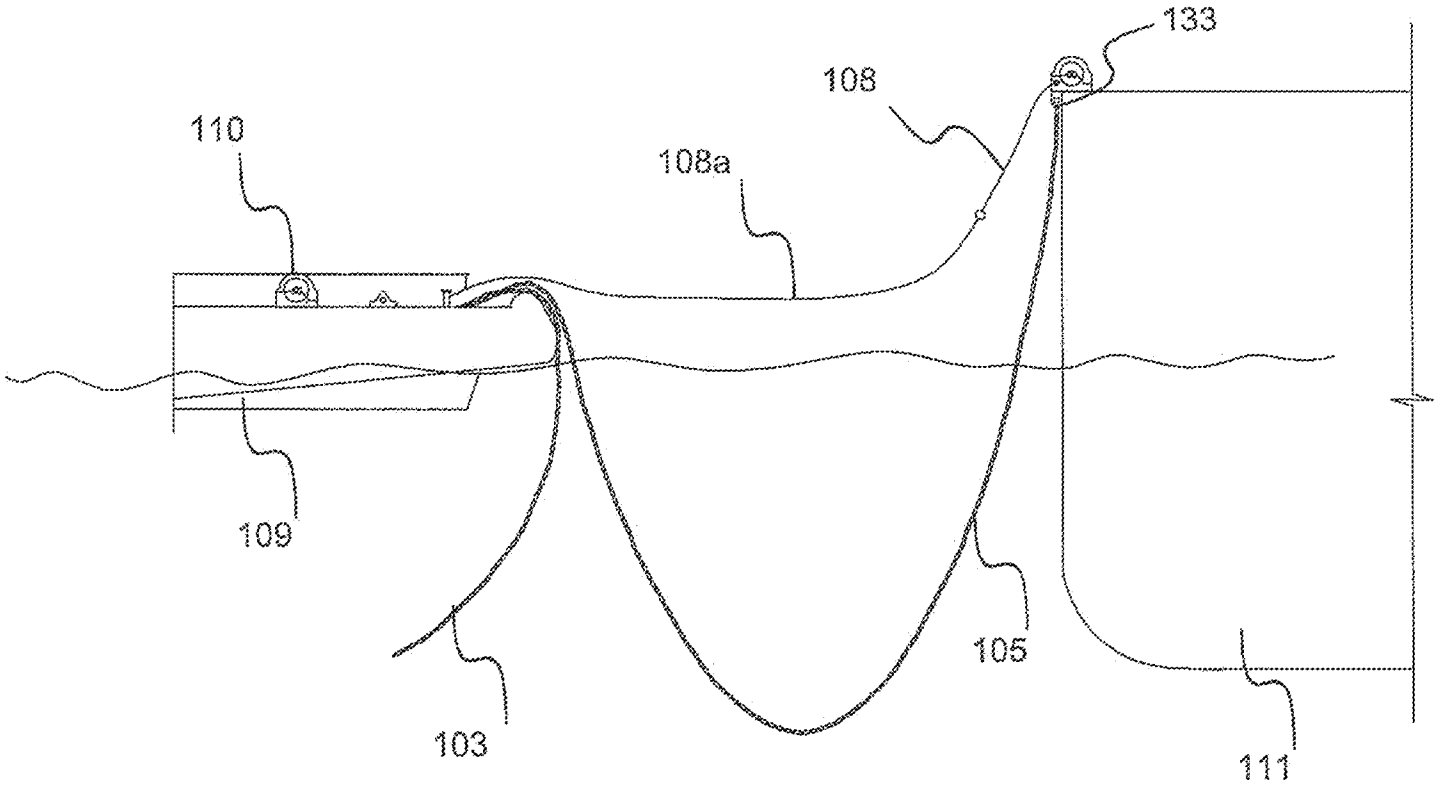
FIG. 46 shows a third step in the second configuration of the third embodiment of the method of tensioning according to the present invention, where a pull-in wire has been connected between a winch on the floating installation and the installation vessel.
Figure 47:
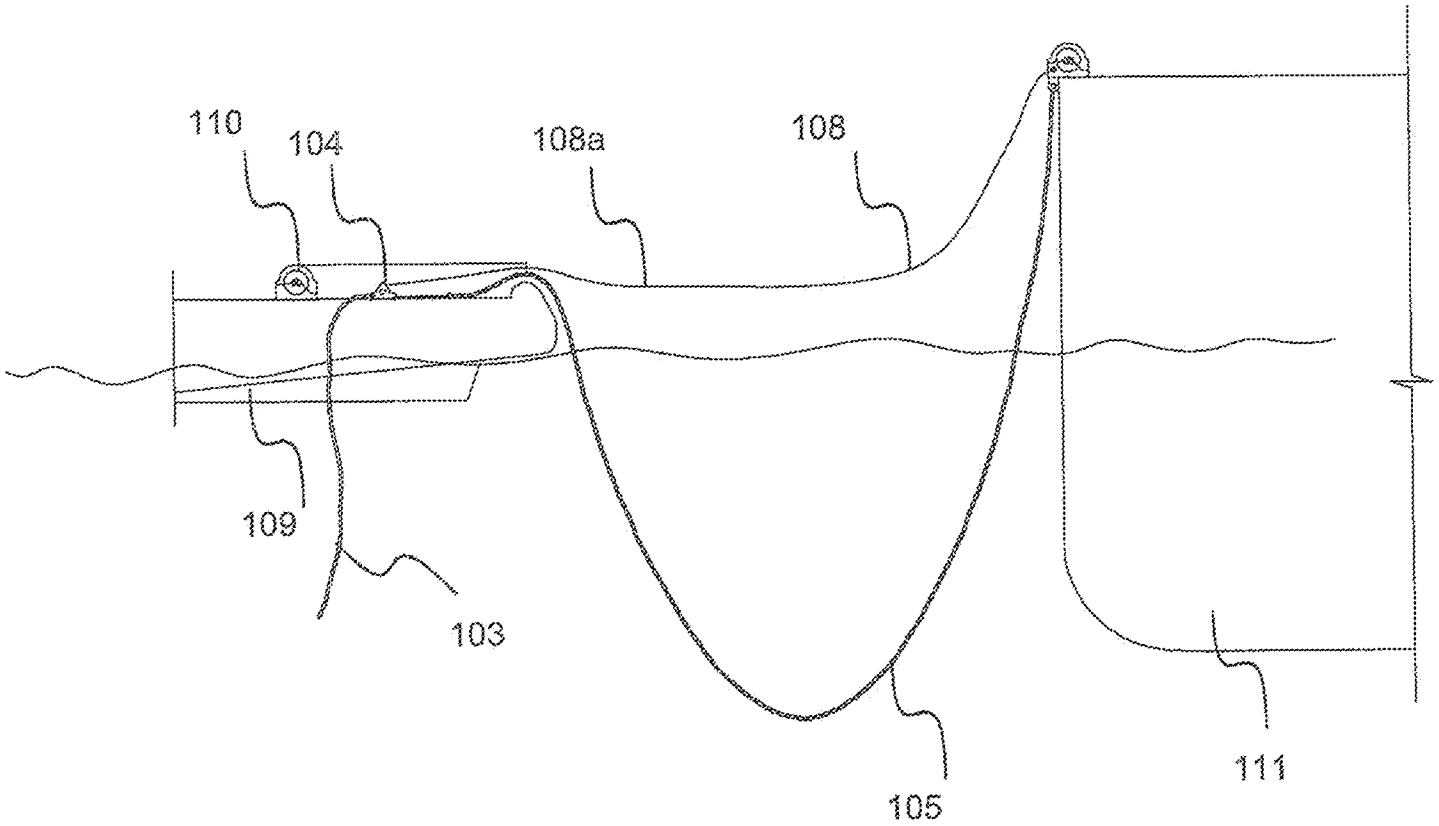
FIG. 47 shows a fourth step in the second configuration of the third embodiment of the method of tensioning according to the present invention, where a mooring tensioner has been connected to the mooring chain.

In FIG. 46, the working chain 105 has been connected to the hull bracket 133 with a bolt, shackle, H-link or any kind of connecting link. The other end of the working chain 105 is fixed to the installation vessel 109. The pull-in wire 108 is connected to one end of a forerunner 108*a* that has its opposite end attached to the installation vessel 109.

In FIG. 19, the mooring line 3 is connected to one end of the chain tensioner 4, which is resting on the deck of the installation vessel 9. The position of the mooring chain 3 is arbitrary as it will most likely be coming in from the stern of the vessel 9. The forerunner 8*a* is pulled over the pulley 100 of the chain tensioner 4, through the chain stopper 16, and is then connected to the working chain 5. The chain tensioner 4 is now ready to be deployed into the sea.

Figure 48:
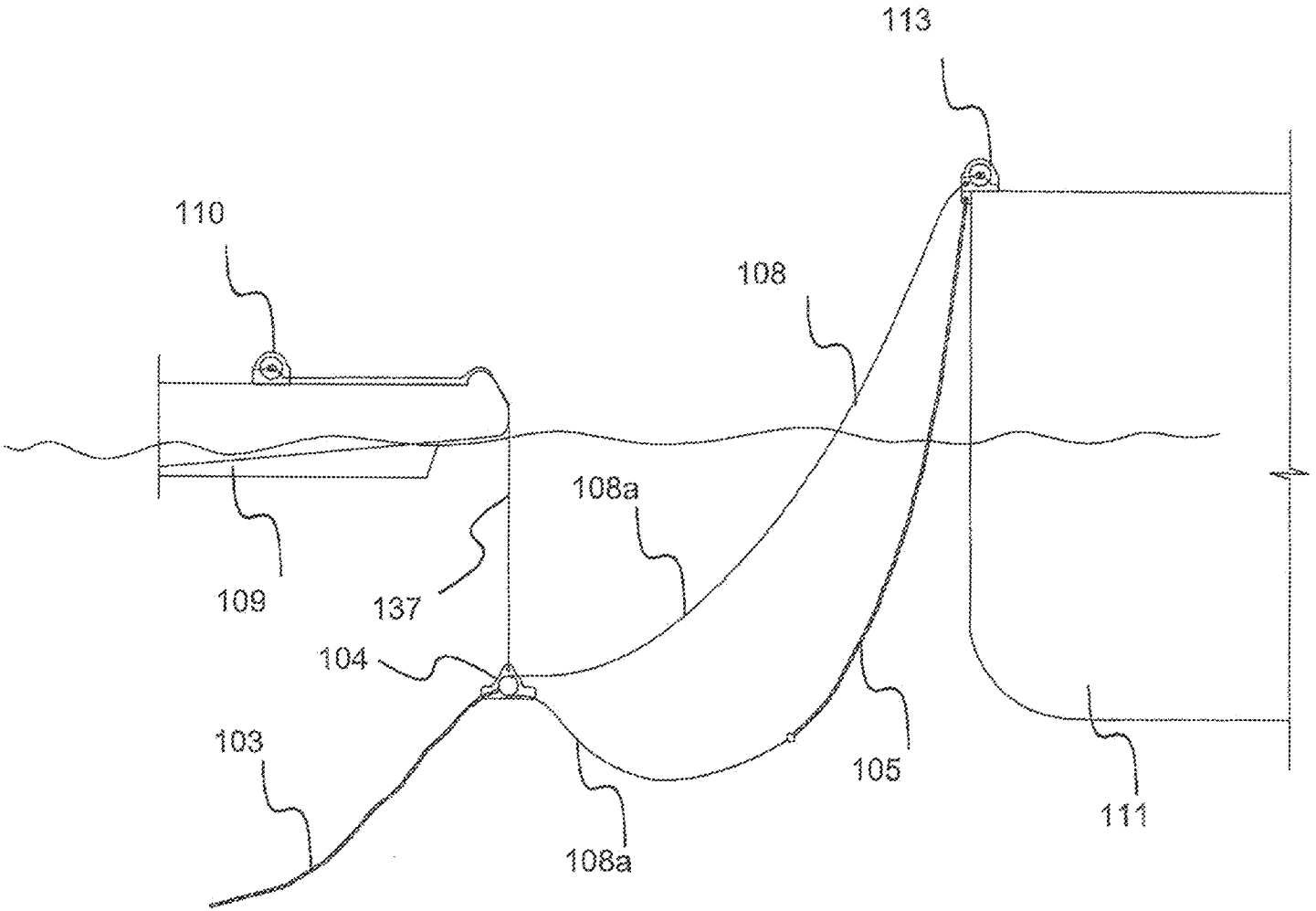
FIG. 48 shows a fifth step in the second configuration of the third embodiment of the method of tensioning according to the present invention, where the mooring tensioner, working chain and pull-in wire has been deployed to the sea.

In FIG. 48 the chain tensioner 104 together with the mooring chain 103, working chain 105, pull-in wire 108 and forerunner 108*a* are lowered from the installation vessel 109 with the winch 110 with a wire 137 that is attached to the chain tensioner 104.

Figure 49:
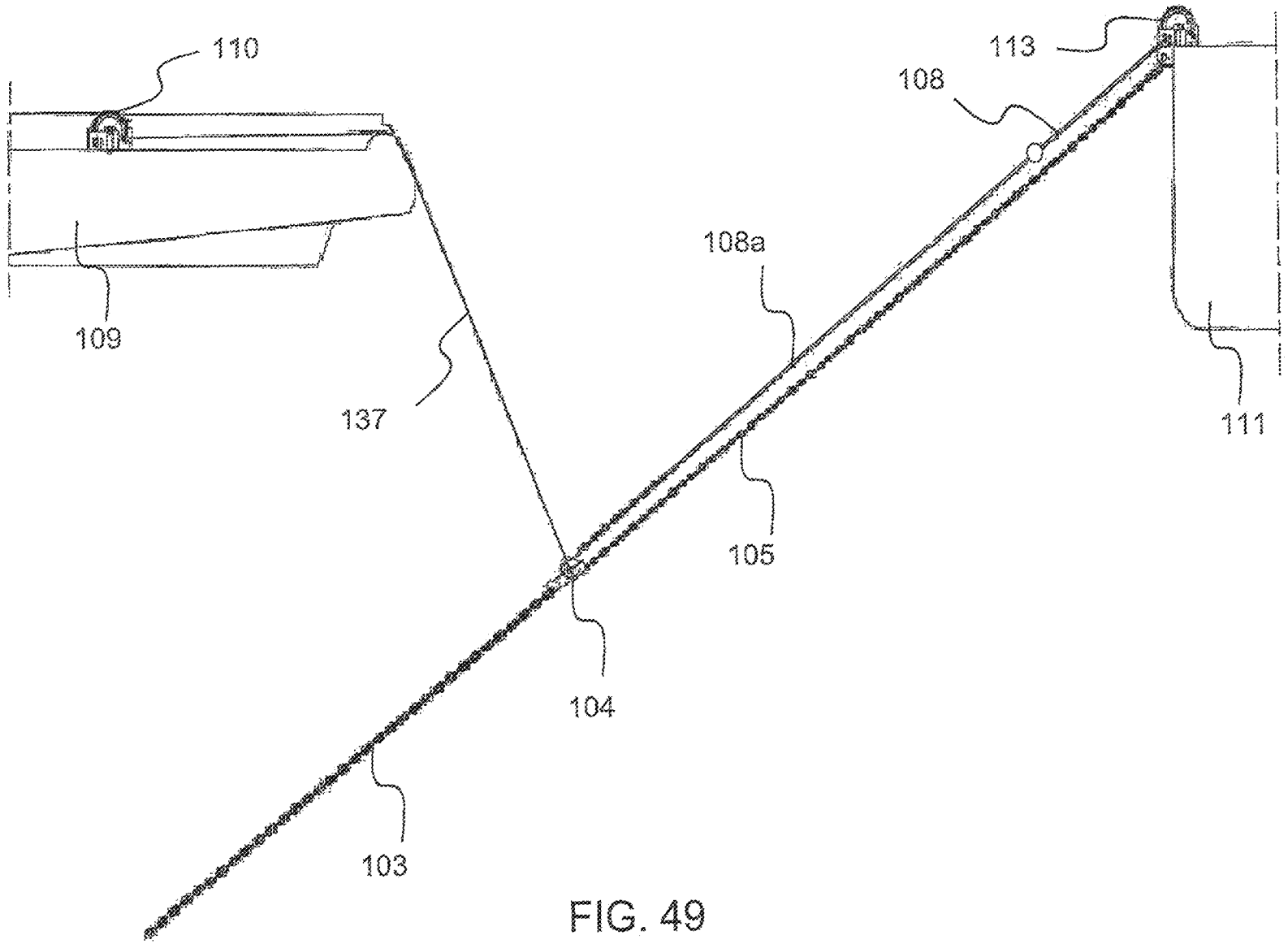
FIG. 49 shows a sixth step in the second configuration of the third embodiment of the method of tensioning according to the present invention, where the pull-in wire is about to be tensioned.

In FIG. 49, the winch 113 is pulling in the working chain 105 through the chain tensioner 104 to tension the mooring chain 103.

Figure 50:
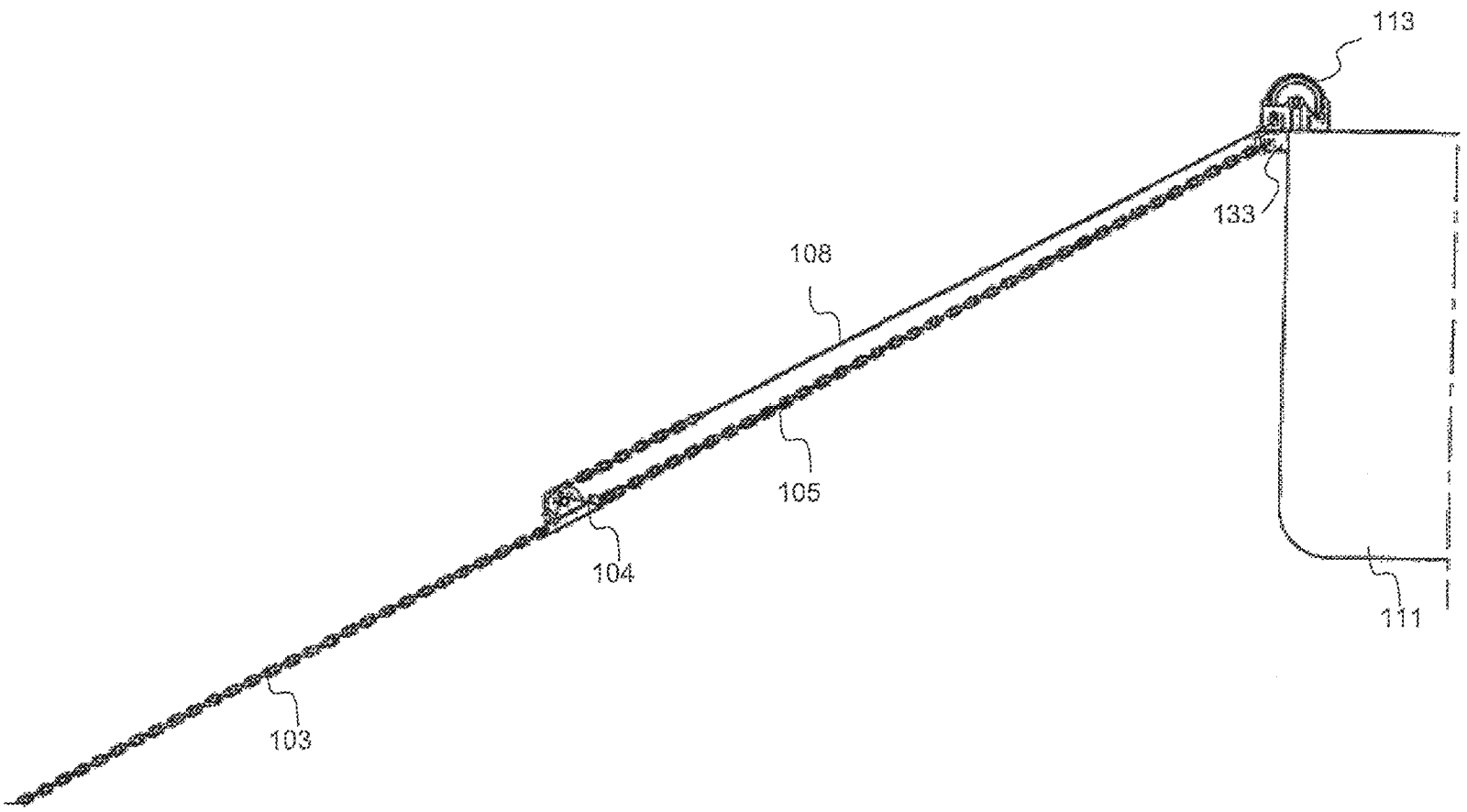
FIG. 50 shows a seventh step in the second configuration of the third embodiment of the method of tensioning according to the present invention, where the pull-in wire and the working chain is tensioning the mooring chain, using a winch on the floating structure.

In FIG. 50, the installation vessel 109 has disconnected from the chain tensioner 104 and final tensioning is performed by the winch 113 on board the floating structure 111. All of the pull-in wire 108 is now on the drum of the winch 113 when final tension is achieved.

Figure 51:
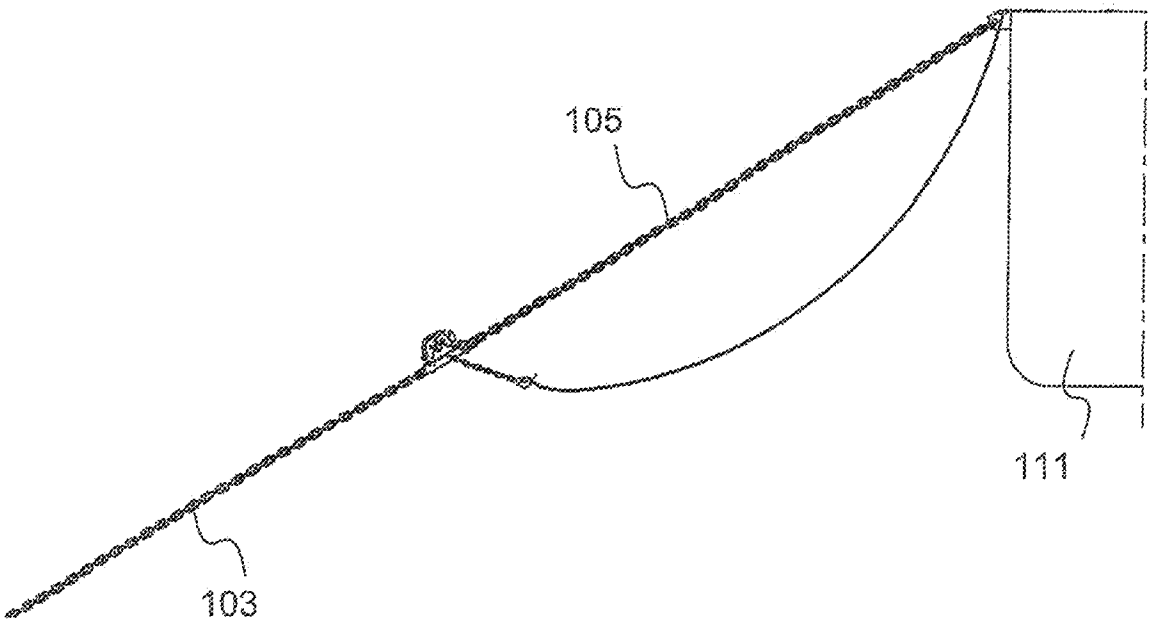
FIG. 51 shows the mooring after completing the tensioning using the second configuration of the third embodiment of a method of tensioning according to the present invention, where

FIG. 51 shows the finished mooring. The forerunner 108*a* has been attached at its upper end to the FPSO for further tensioning operations if required. This line may, however, be removed. The winch 113 has also been removed.

As an alternative to using the pull-in wire 108, forerunner 108*a*, only one may be used. This requires disconnection of the pull-in wire 108 from the working chain 105 after the tensioning operation.

Figure 52:
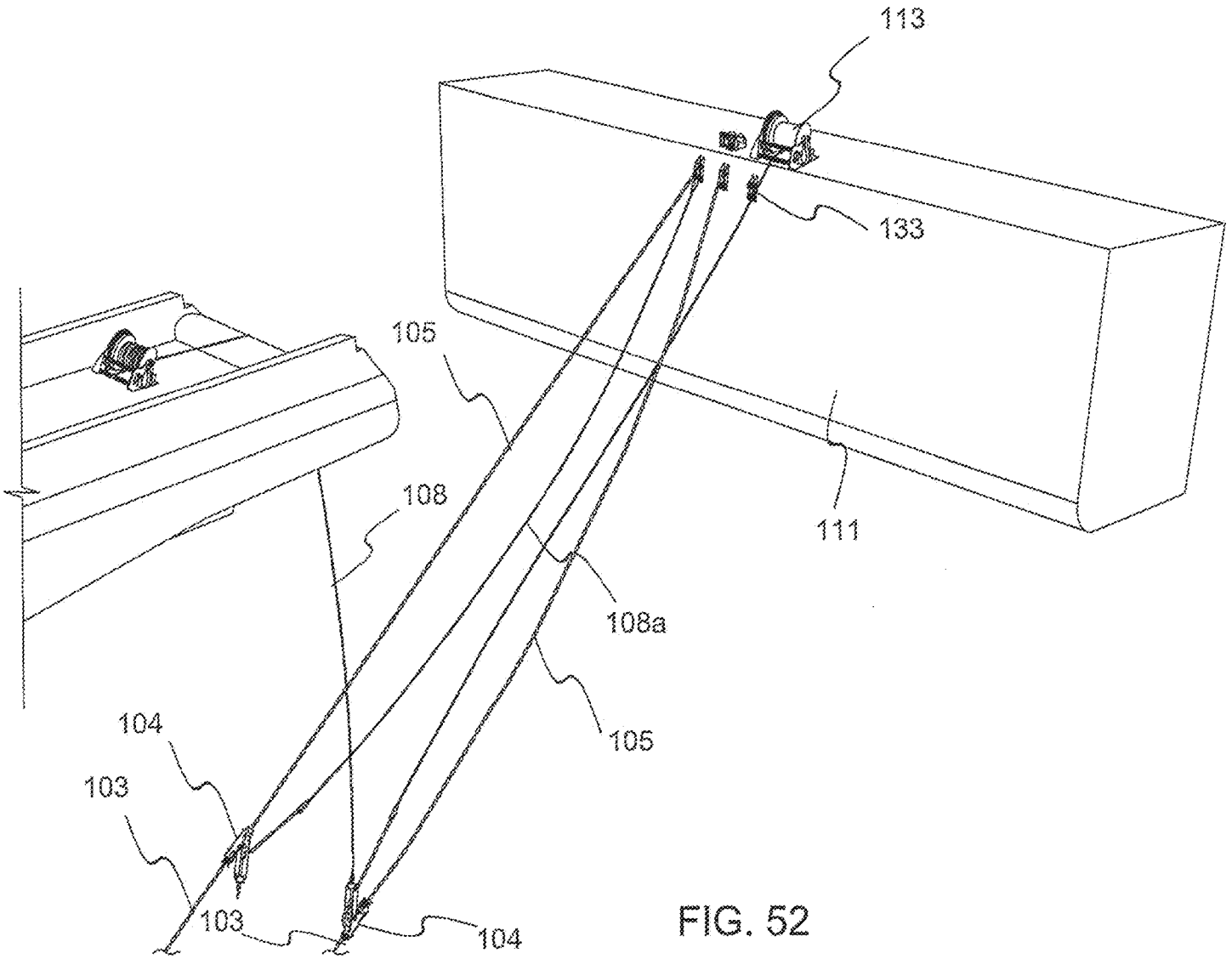
FIG. 52 shows a cluster of moorings, with a first mooring completed, a second mooring about to be tensioned and a third mooring yet not installed.

FIG. 52 shows a cluster for three mooring lines. One has already been installed and tensioned, and the second is under tensioning and a third mooring has not yet been initiated. The winch 113 on the floating structure 111 is fixed in one position and can handle all mooring lines from this position.

Figure 53:
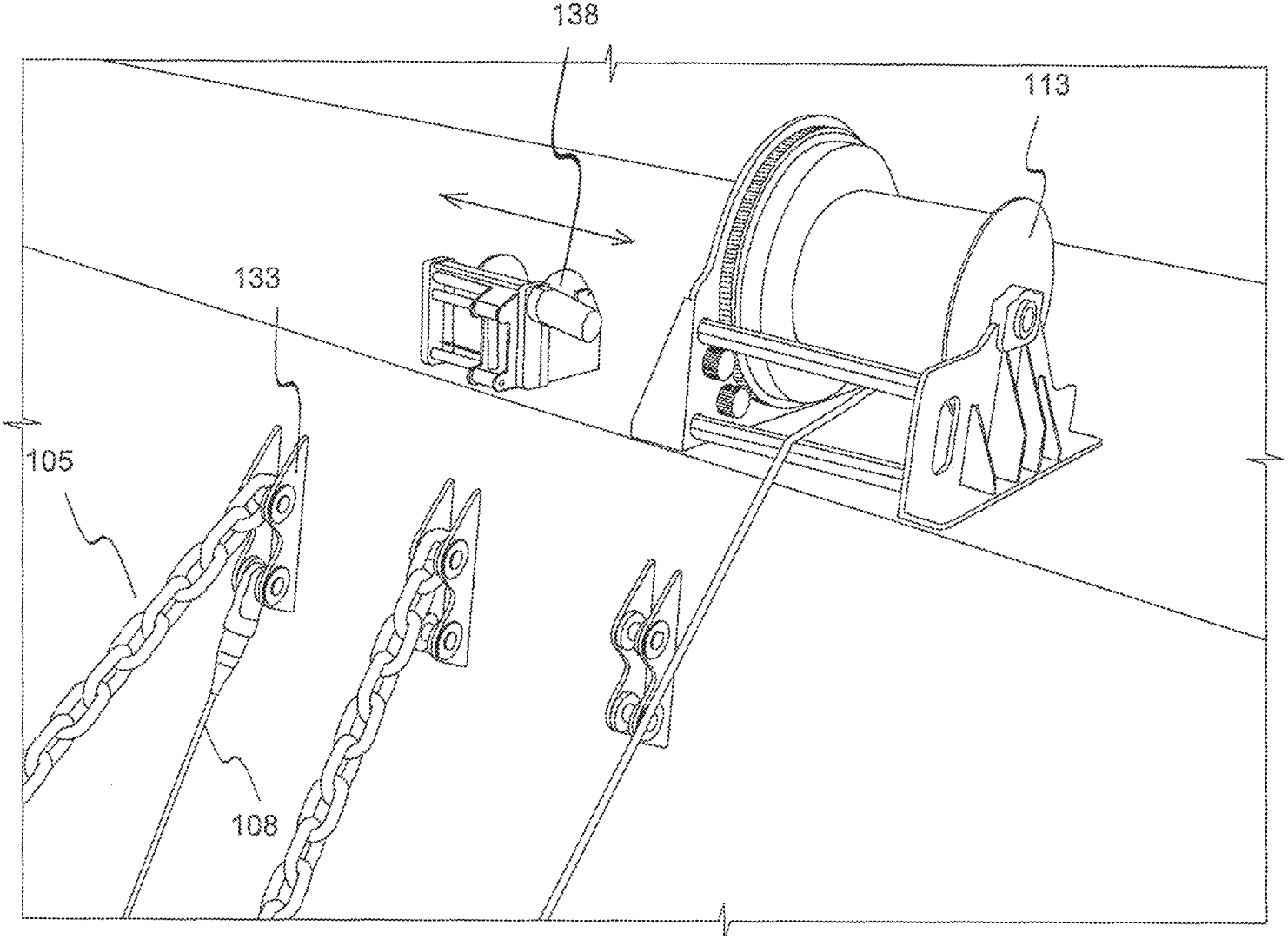
FIG. 53 shows a close-up of the upper parts of the moorings in FIG. 24 and a tensioning winch.

FIG. 53 is a close-up of the mooring line interface to the floating structure 111. The installation winch is fixed in one position. An auxiliary winch 138*a* may be used for pulling in the working chain 105 during the initial stages of the operation. This auxiliary winch 138*a* can be moved to suitable positions each hull bracket 133. The figure shows that the forerunner 108*a* is fixed to a hull bracket 133.

Figure 32B:
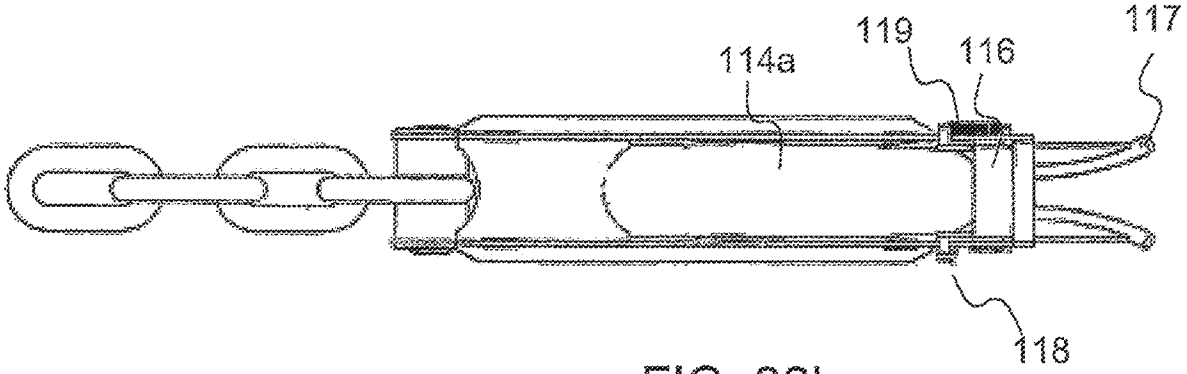
Figure 54:
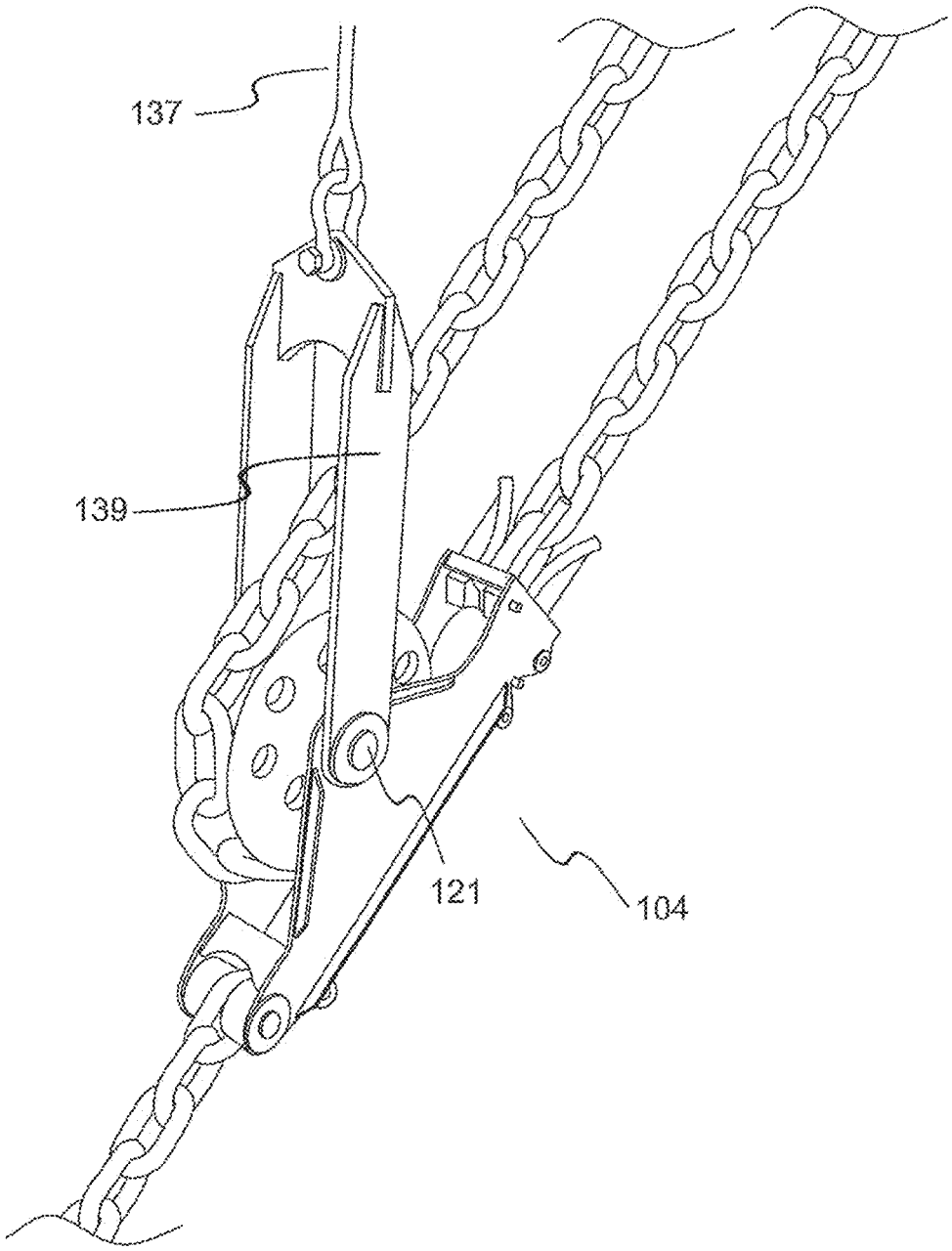
FIG. 54 shows an alternative mooring tensioner.

FIG. 54 shows a modified version of the chain tensioner 104 as compared with FIGS. 31 and 32. Here a lifting yoke 139 has been added for lifting or holding the chain tensioner 104 by a wire 137 from the installation vessel 109. Conveniently, the lifting yoke 139 is rotatable attached to the chain tensioner 104 at a common rotation axis with the pulley 121. This ensures that the chain tensioner 104 does not rotate if the pulling force from the wire 137 or the working chain 105 changes.

Figure 55:
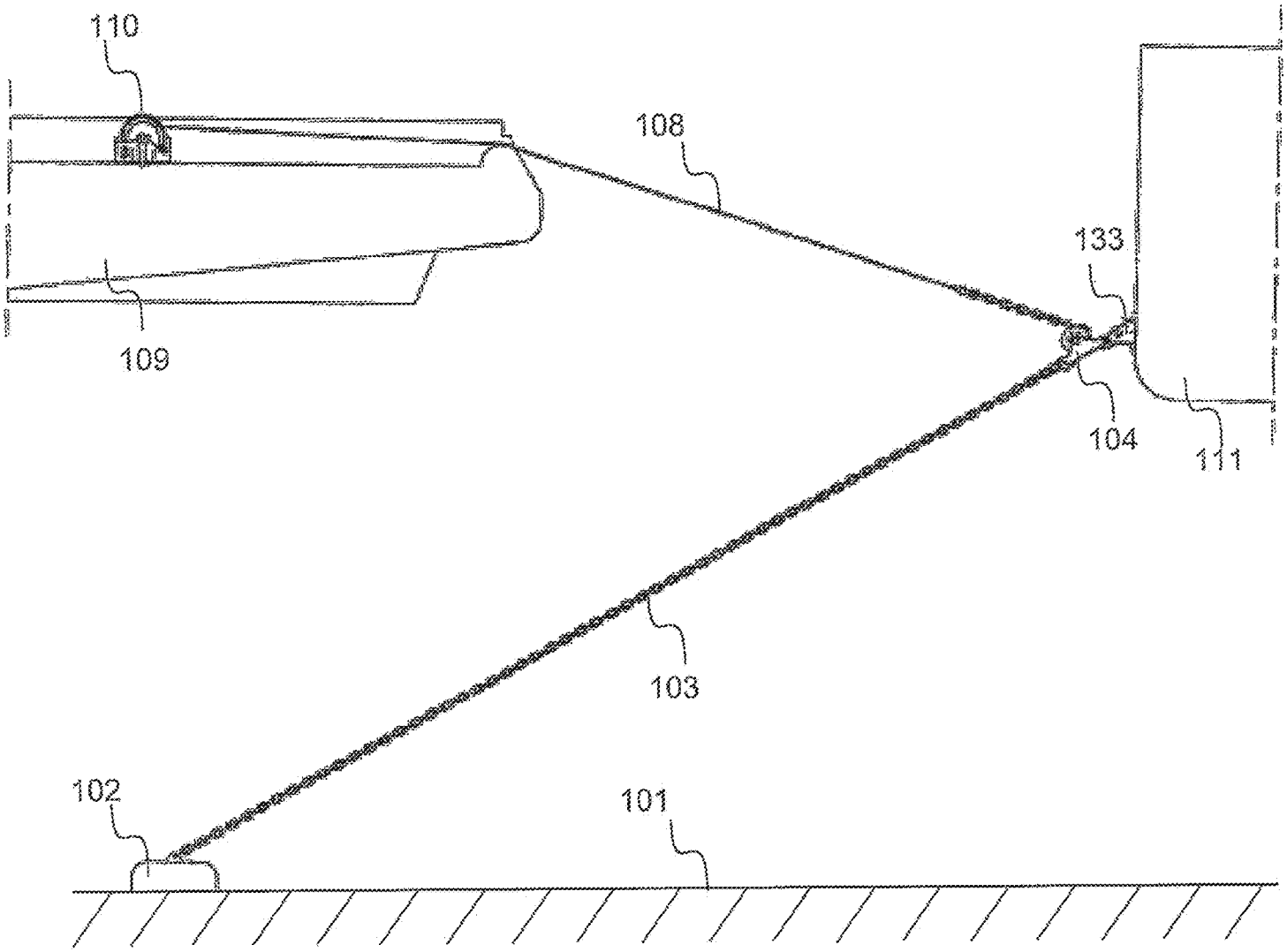
FIG. 55 shows a tensioning arrangement according to a fourth embodiment of the present invention.

The fourth embodiment of the present invention can be seen in FIG. 55 where the chain tensioner 104 has been attached to the floating structure 111 via the hull bracket 133 possibly via a link or shackle.

In this embodiment, the installation vessel 109 installs and tensions the mooring chain 103 via a pull-in wire 108 that at one end is connected to the winch 110 or a fixed point on the installation vessel 109. In the latter case, the mooring is tensioned using the bollard pull of the installation vessel 109.

A typical installation method for this embodiment will be explained referring to FIGS. 56*a*-59.

Figure 56B:
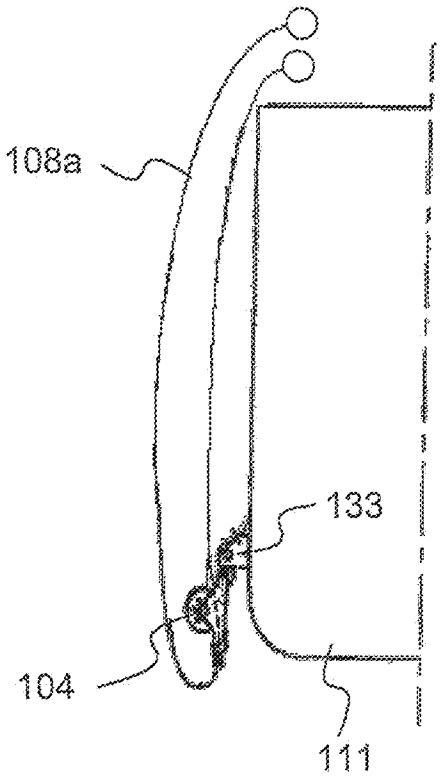
FIGS. 56*a-b* show a first step in a first installation method for installing a tensioning arrangement according to the fourth embodiment of the present invention.
Figure 56A:
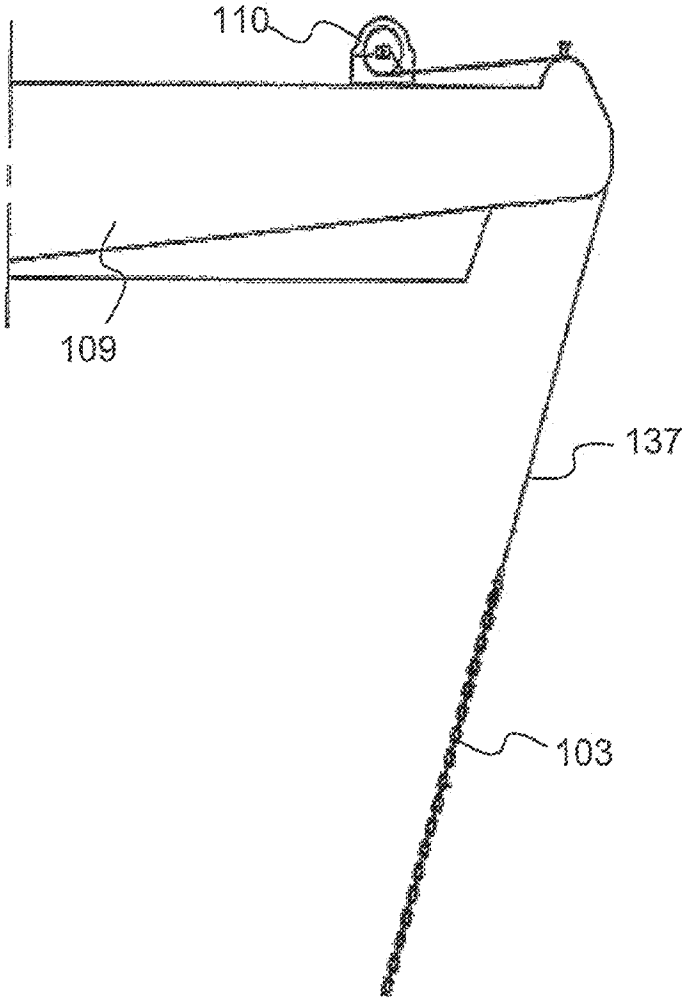

In FIGS. 56*a*-*b*, the chain tensioner 104 has been installed with a forerunner 138 passing through it. The installation vessel 9 is pulling up the mooring chain 103 from the seabed, which has been installed as explained in connection with FIG. 37 above.

Figure 57:
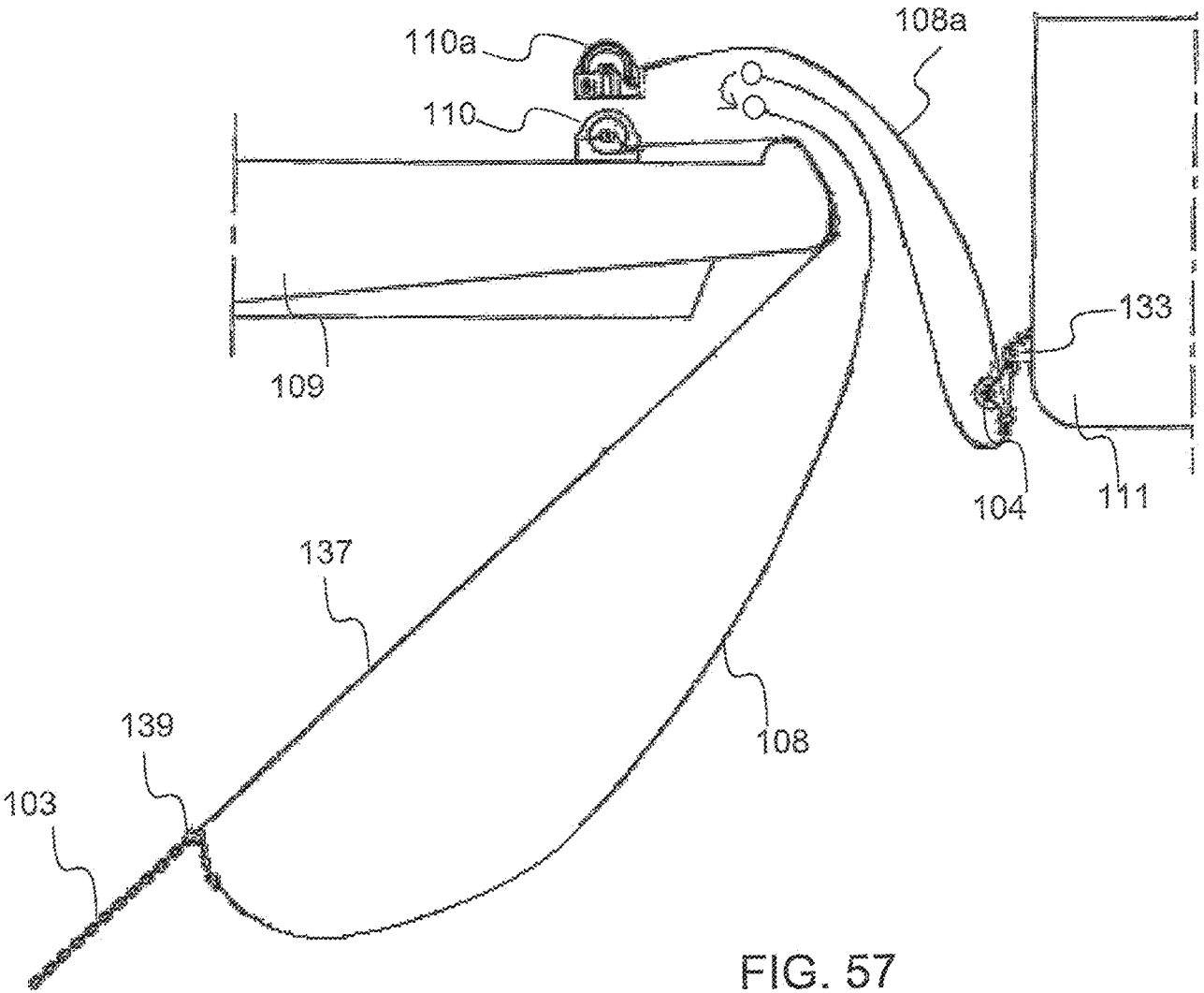
FIG. 57 shows a second step in the first installation method for installing a tensioning arrangement according to the fourth embodiment, where a pull-in wire is about to be coupled to the mooring chain and a winch.

In FIG. 57, the installation vessel 9 has already pulled the mooring chain 103 to the deck and attached a hook 139 to the mooring chain 103. The hook 139 is attached to a wire 137 running from the winch 110 and the mooring chain 103 has been lowered. As the installation vessel 109 moves closer to the floating structure 111 while the winch 110 pays out the wire 137 to reduce the tension in the mooring chain 103. The forerunner 138 is passed from the floating structure 111 and connected to another winch 110*a* at one end, i.e. the end on the upper side of the chain tensioner 104. The other end, i.e. the end on the lower side of the chain tensioner 104 is connected to the upper end of the pull-in wire 108.

Figure 58:
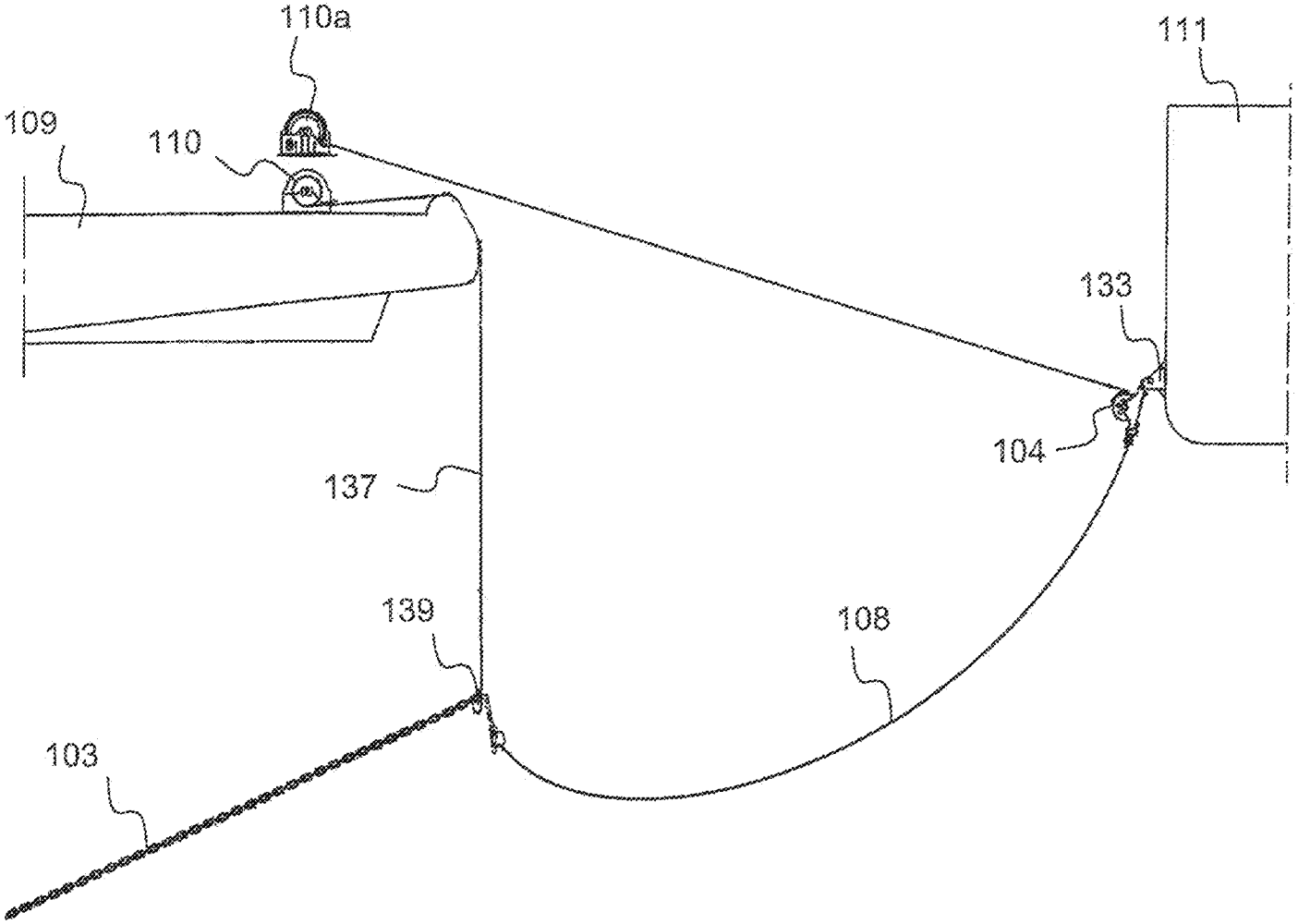
FIG. 58 shows a third step in the first installation method for installing a tensioning arrangement according to the fourth embodiment, where the pull-in wire is about to be deployed to the sea.

In FIG. 58 the installation vessel 109 has moved away from the floating structure 111, the forerunner 138 has been pulled onto to the winch 110*a* and the mooring chain 103 is being held by the winch 110 via the wire 137 and hook 139.

Figure 59:
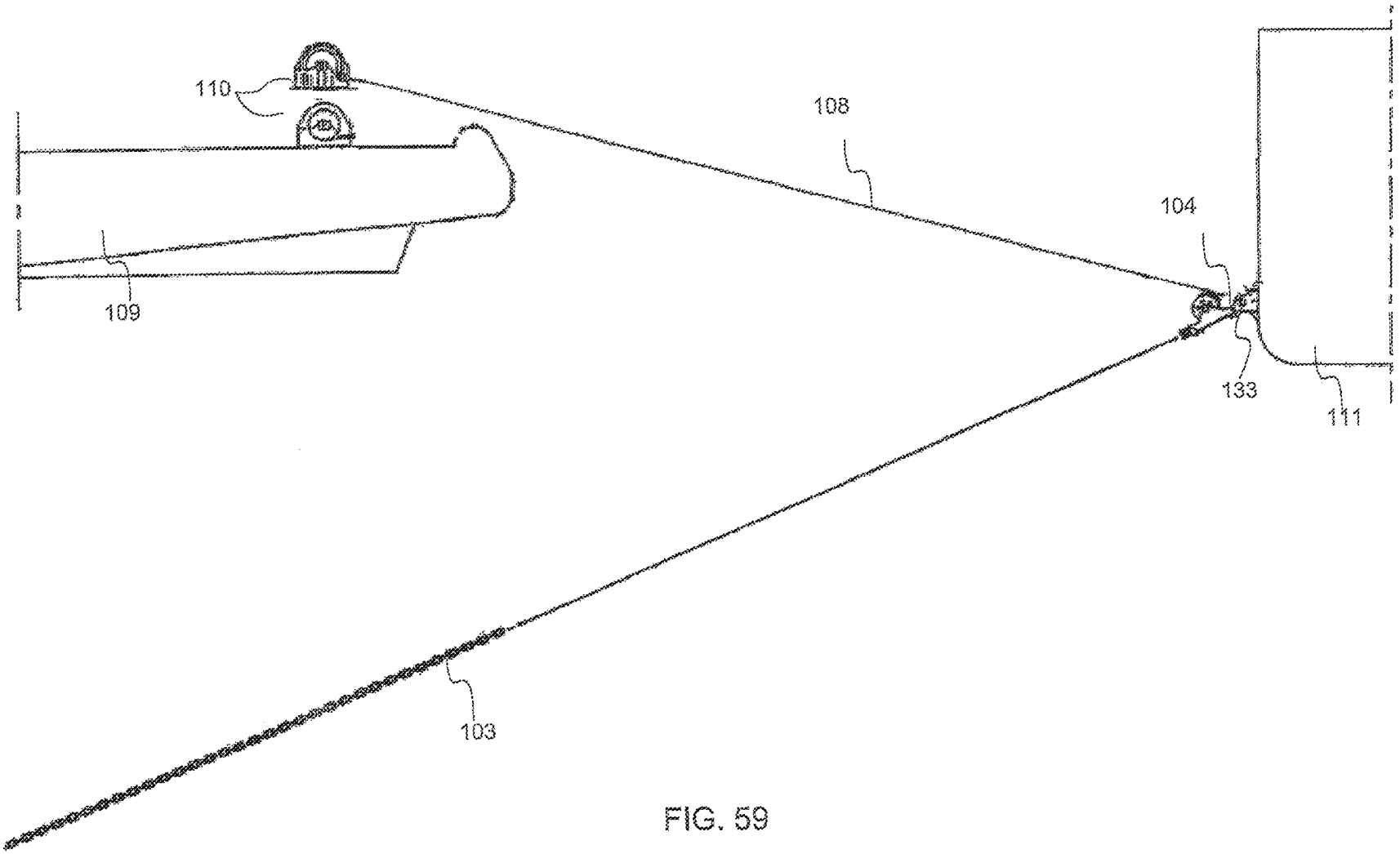
FIG. 59 shows a fourth step in the first installation method for installing a tensioning arrangement according to the fourth embodiment, where the pull-in wire is being tensioned.

In FIG. 59, the hook 139 and wire 137 has been disconnected. Tension is now on the pull-in wire 108 and mooring chain 103 via the chain tensioner 104. The pull-in wire 108 is pulled in until the upper end of the mooring chain 103 has passed through the chain tensioner 104, as shown in FIG. 55, which represents the final tensioning. After final tensioning, the pull-in wire 108 is disconnected from the mooring chain 103.

A further alternative method to the one described in FIGS. 56-59 can be seen in FIGS. 60-64.

Figure 60B:
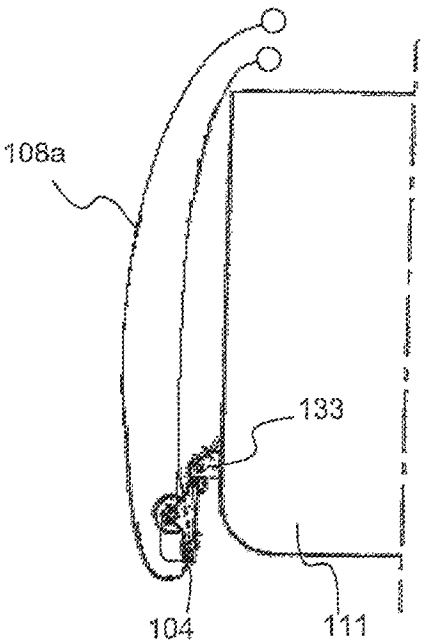
FIGS. 60*a-b* show a first step in a second installation method for installing a tensioning arrangement according to the fourth embodiment.
Figure 60A:
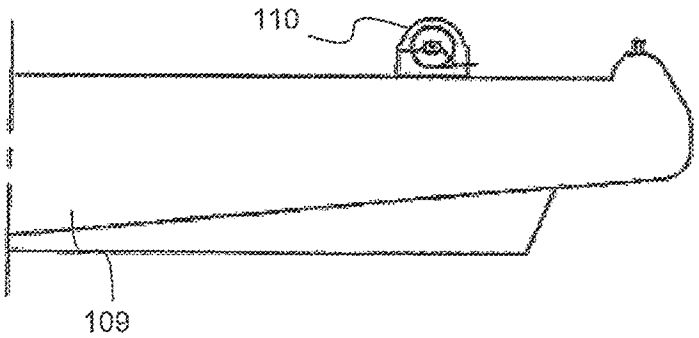

In FIGS. 60*a*-*b*, the installation vessel 109 approaches the floating structure 111. On the floating structure 111 the chain tensioner 104 is attached to the floating structure 111 via a hull bracket 133 via a possible link, shackle or shaft. A forerunner 138 has been installed through the chain tensioner 104.

Figure 61:
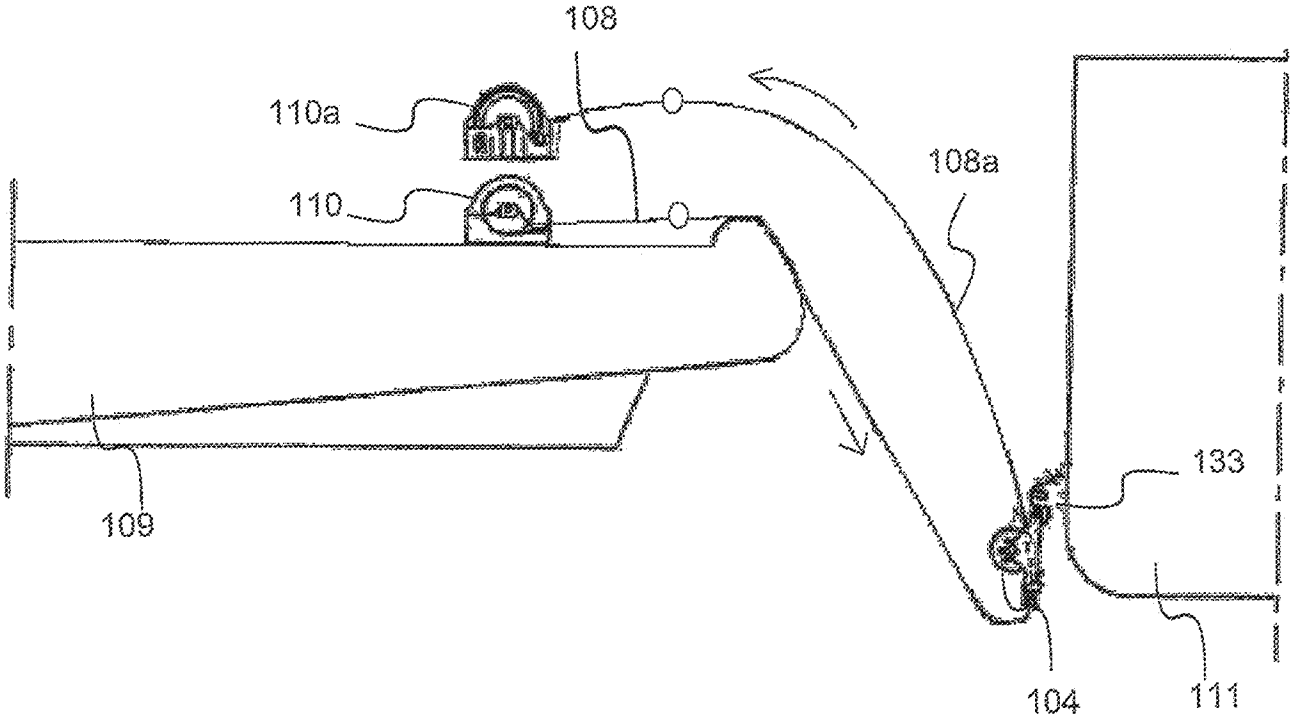
FIG. 61 shows a second step in the second installation method for installing the tensioning arrangement according to the fourth embodiment, where a pull-in wire has been coupled between two winches on the installation vessel.

In FIG. 61, the installation vessel 109 moves closer to the floating structure 111 and both ends of the forerunner 138 are transferred to the installation vessel 109. One end of the forerunner 138, i.e. the end emerging from the lower side of the chain tensioner 104, is connected to the pull-in wire 108. The pull-in wire 108 is spooled onto the winch 110. The other end of the forerunner 138, i.e. the one emerging from the upper side of the chain tensioner 104, is connected to another winch 110*a*. By paying out the pull-in wire 108 and pulling in on the other winch 110*a*, the pull-in wire 108 passes through the chain tensioner 104.

Figure 62:
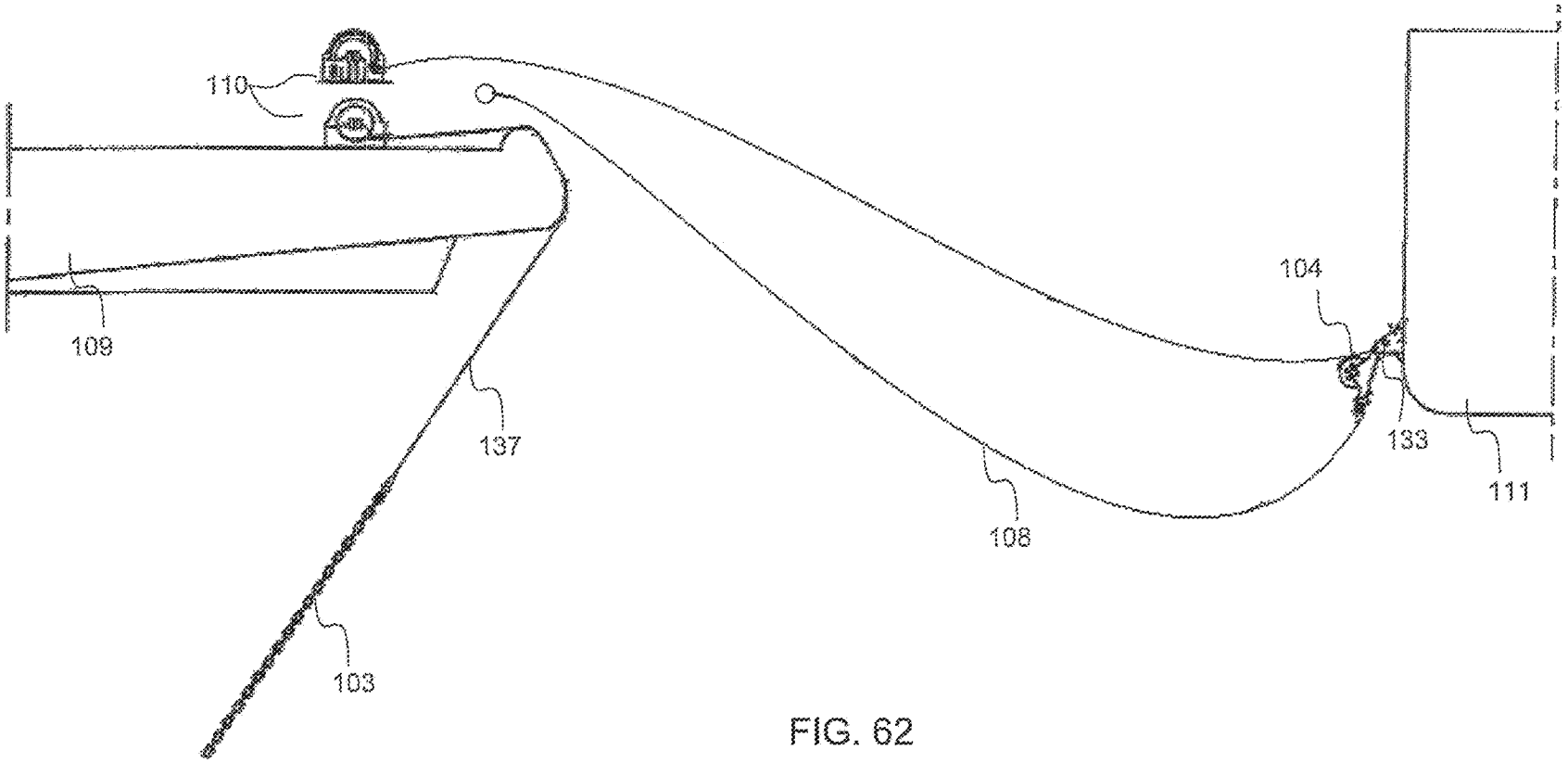
FIG. 62 shows a third step in the second installation method for installing the tensioning arrangement according to the fourth embodiment, where a mooring chain has been coupled to one of the winches.

In FIG. 62, the installation vessel 109 moves away from the floating structure 111 while paying out the pull-in wire 108. The mooring chain 103 is pulled up from the seabed with a wire 137 and the winch 110. The mooring chain 103 and anchor 102 have been installed, and the mooring chain 103 has been retrieved as explained above in connection with FIG. 37.

Figure 63:
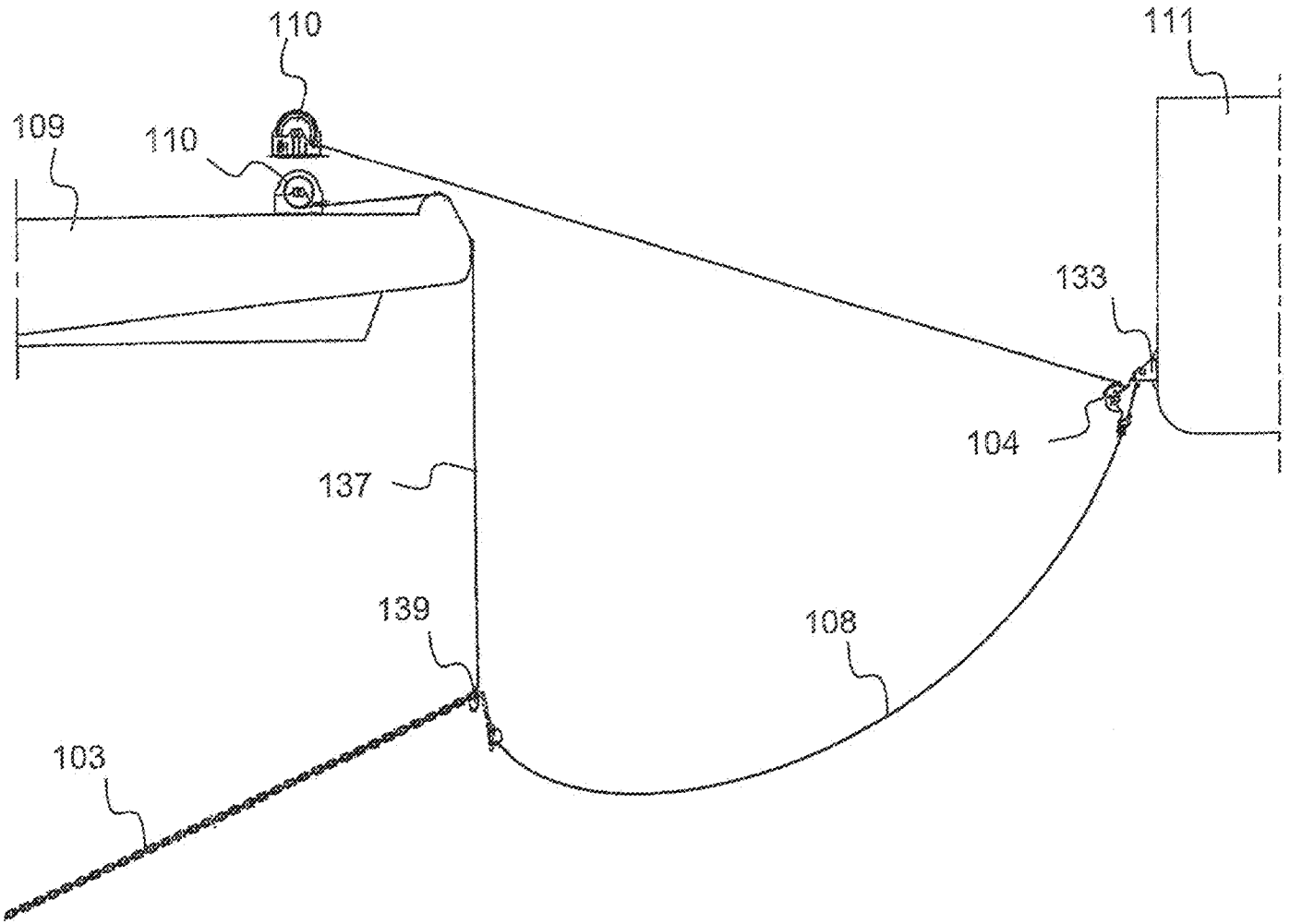
FIG. 63 shows a fourth step in the second installation method for installing the tensioning arrangement according to the fourth embodiment, where the pull-in wire and the mooring chain has been connected.

In FIG. 63, the installation vessel 109 has already pulled the mooring chain 103 to the deck and attached a hook 139 to the mooring chain 103. The hook 139 is attached to a wire 137 running from the winch 110 and the mooring chain 103 has been lowered. The pull-in wire 108 has been attached at one end to the mooring chain 103 and the mooring chain 103 is in the process of being tensioned by the winch 110 by pulling the pull-in wire 108.

Figure 64:
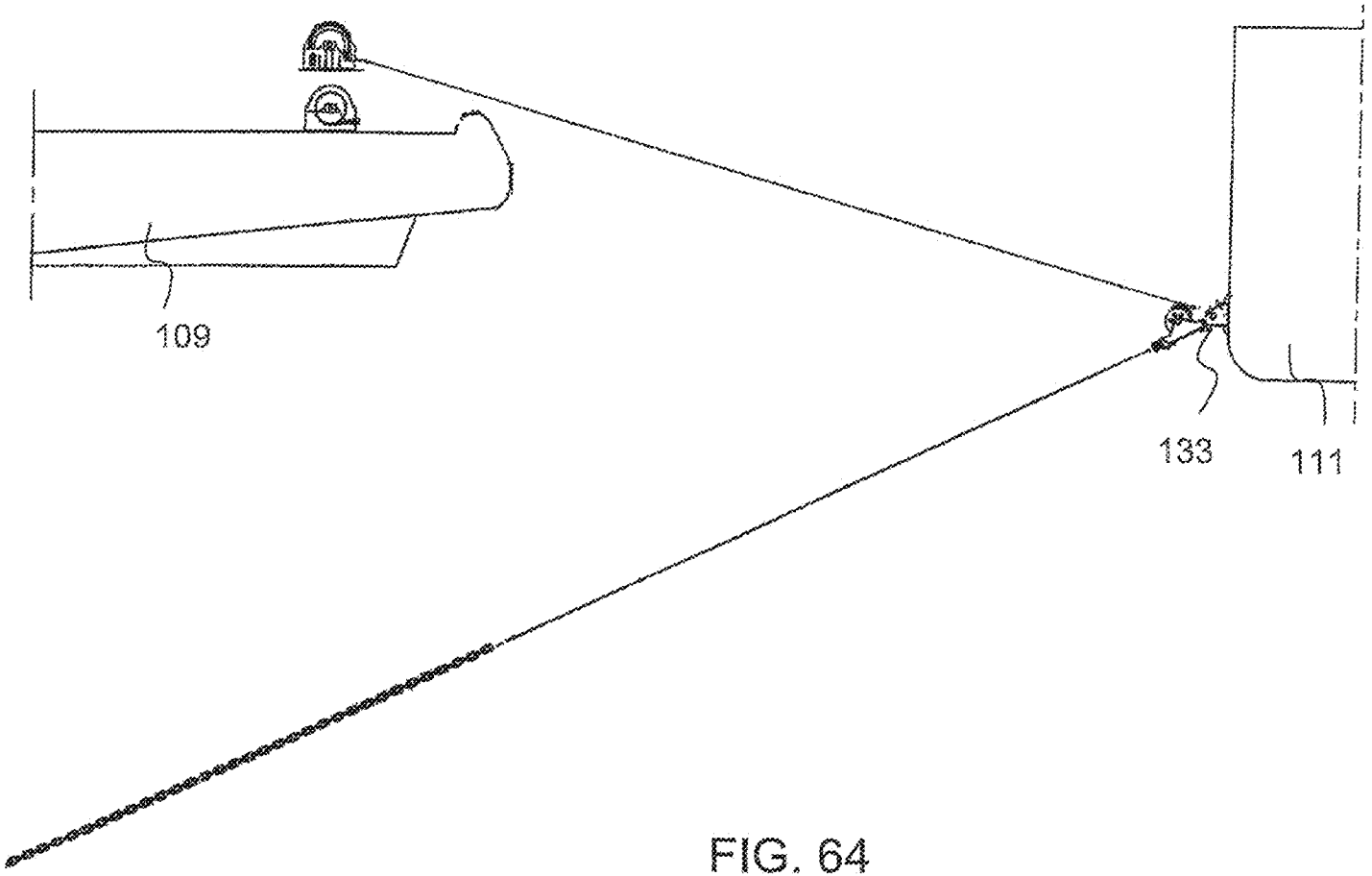
FIG. 64 shows a fifth step in the second installation method for installing the tensioning arrangement according to the fourth embodiment, where the pull-in wire is being tensioned.

In FIG. 64, the hook 139 and wire 137 have been disconnected, tension is now on the pull-in wire 108 and mooring chain 103 via the chain tensioner 104. The tensioning will continue until the upper end of the mooring chain 103 has passed through the chain tensioner 104.

Final tensioning can be done as shown and described in connection with FIG. 55. After final tensioning, the pull-in wire 108 is disconnected from the mooring chain 103, as explained above.

It is to be understood that the present invention is not to be limited by the embodiments of the invention described herein. Indeed, those skilled in the art will readily understand that various modifications and embodiments of the invention may be made and practiced without departing from the scope of the invention.

What is claimed is:

1. A mooring tensioning arrangement for a floating structure or vessel, the mooring tensioning arrangement comprising:

an anchor, a mooring line, and a fairlead chain stopper arrangement arranged on the floating structure or vessel;

a midwater pulley device;

at least one of a winch and a vessel;

wherein the mooring line is attached to an anchor at a first end and attached to the at least one of a winch and a vessel at a second end, the mooring line extending from the anchor through the fairlead chain stopper arrangement;

wherein the midwater pulley device is positioned on a part of the mooring line extending between the anchor and the fairlead chain stopper arrangement; and wherein the fairlead chain stopper arrangement comprises a chain stopper interacting with the mooring line and a chain wheel guiding the mooring line through the fairlead chain stopper arrangement and back towards the midwater pulley device and from the midwater pulley device towards the at least one of a winch and a vessel.

2. The mooring tensioning arrangement according to claim 1, wherein the mooring line comprises a mooring chain and a first installation wire, the mooring chain extending at least between the anchor and the fairlead chain stopper arrangement and the first installation wire is attached to the mooring chain and extending at least through the midwater pulley device to the at least one of a winch and a vessel.

3. The mooring tensioning arrangement according to claim 1, wherein the mooring line has a portion thereof that extends between the anchor and the fairlead chain stopper arrangement and the mooring line has a portion thereof that extends between the fairlead chain stopper arrangement and the midwater pulley device, wherein the portion of the mooring line extending between the anchor and the fairlead chain stopper arrangement and the portion of the mooring line extending between the fairlead chain stopper arrangement and the midwater pulley device are substantially parallel.

4. The mooring tensioning arrangement according to claim 1, wherein the arrangement further comprising a second installation wire fixedly attached to the floating structure or vessel at a first end and attached to the at least one of a winch and a vessel at the opposite, second end.

5. The mooring tensioning arrangement according to claim 1, wherein the mooring line further comprises a portion that extends from the midwater pulley device to a second wire pulley arranged on the floating structure or vessel.

6. The mooring tensioning arrangement according to claim 1, wherein the midwater pulley device comprising a connector adapted to be releasable connected to the mooring line.

7. The mooring tensioning arrangement according to claim 1, wherein the midwater pulley device is fixedly connected to the mooring line.

8. The mooring tensioning arrangement according to claim 1, wherein the chain stopper and the chain wheel being coupled together in a manner such that the part of the mooring line extending through the chain stopper is forming a tangential line to the chain wheel in every possible positions of the chain stopper.

9. The mooring tensioning arrangement according to claim 2, wherein at least one of the fairlead chain stopper arrangement, the fixed point, and a second wire pulley is arranged at a hull of the floating structure or vessel.

10. The mooring tensioning arrangement according to claim 1, wherein the at least one of a winch and a vessel is a winch arranged on an installation vessel or on the floating structure.

11. A method for tensioning a mooring tensioning arrangement for a floating structure or a vessel according to claim 1, the method comprising:

a) transferring a first installation wire to and from the at least one of a winch and a vessel, wherein the first installation wire is extending through the fairlead chain stopper arrangement;

b) pulling in the mooring chain by the at least one of a winch and a vessel;

c) connecting the first installation wire and the mooring chain together to a mooring line;

d) lowering the mooring line from the at least one of a winch and a vessel into the sea;

e) tensioning the mooring line by the at least one of a winch and a vessel and the fairlead chain stopper arrangement;

f) transferring a second installation wire between the floating structure and the at least one of a winch and a vessel;

g) extending the mooring line around the midwater pulley device; and h) tensioning the mooring line by the at least one of a winch and a vessel.

12. The method for tensioning a mooring arrangement on a floating structure or vessel according to claim 11, the method comprising:

i) before performing step h), lowering the midwater pulley device to the mooring chain.

13. The method for tensioning a mooring arrangement on a floating structure or vessel according to claim 11, further comprising:

j) connecting the second installation wire and the mooring line together at the at least one of a winch and a vessel between step f) and g).

14. A method for removing a mooring tensioning arrangement for a floating structure or vessel according to claim 1, the method comprising:

a) removing the mooring line from at least one of the second wire pulley and the midwater pulley device;

b) pulling in the mooring line until the mooring chain part is situated on the vessel;

c) cutting the mooring chain in a suitable length; and d) lowering a third mooring chain part into the sea, wherein the third mooring chain part is hanging freely from the fairlead chain stopper arrangement.

15. A mooring tensioning arrangement for a floating structure or vessel, the mooring tensioning arrangement comprising an anchor, a mooring chain, a chain tensioner and a working chain, the chain tensioner having a chain tensioner pulley, the mooring chain being attached at a first end to the anchor and at a second end to the chain tensioner, the working chain being attached at a first end to the floating structure or vessel and extending over the chain tensioner pulley, and the working chain being attached to at least one of a winch and a vessel at a second end; the working chain having a portion that extends between an attachment to the floating structure or vessel and the chain tensioner pulley, and a portion that extends from the chain tensioner pulley towards the at least one of a winch and a vessel, wherein the portions are substantially parallel.

16. The mooring tensioning arrangement according to claim 15, wherein the portion that extends from the chain tensioner pulley towards the at least one of a winch and a vessel of the working chain extends over a fairlead pulley that is attached to the floating structure or vessel close to, or at the same position as, the attachment of the first end of the working chain to the floating structure or vessel, so that the portion that extends from the chain tensioner pulley towards the at least one of a winch and a vessel of the working chain extends substantially parallel with the portion that extends between the attachment to the floating structure or vessel between the chain tensioner pulley and the fairlead pulley.

17. The mooring tensioning arrangement according to claim 15, wherein the at least one of a winch and a vessel is situated close to the attachment of the first end of the working chain to the floating structure or vessel, so that the portion that extends from the chain tensioner pulley towards the at least one of a winch and a vessel of the working chain extends substantially parallel with the portion that extends between the attachment to the floating structure or vessel between the chain tensioner pulley and the at least one of a winch and a vessel.

18. The mooring tensioning arrangement according claim 15, wherein the mooring chain or the working chain is coupled to a pull-line, which in turn is coupled to the at least one of a winch and a vessel.

19. The mooring tensioning arrangement according to claim 15, wherein the chain tensioner comprises a chain stopper that is adapted to lock the mooring chain or the working chain and prevent the same from moving relative to the chain tensioner.

20. The mooring tensioning arrangement according to claim 15, wherein the at least one of a winch and a vessel is a winch on an installation vessel or a winch on the floating structure or vessel.

21. A method for tensioning a mooring tensioning arrangement for a floating structure or vessel according to claim 15, wherein a tensioning force is imposed on the mooring chain, which force is directed towards the floating structure or vessel.

22. The method according to claim 21, wherein the tensioning force is acting via a block and tackle configuration, which multiplies the tensioning force on the mooring chain.

23. The method according to claim 21, wherein the tensioning force is created by at least one of a winch and a vessel, which is a winch on an installation vessel or a winch on the floating structure or vessel.

* * * * *